US009990781B2

(12) United States Patent
Haidar et al.

(10) Patent No.: US 9,990,781 B2
(45) Date of Patent: Jun. 5, 2018

(54) VEHICLE INFORMATION SYSTEM

(71) Applicant: Vinli, Dallas, TX (US)

(72) Inventors: Mahmoud Haidar, Dallas, TX (US); Scott Clifton Harper, Dallas, TX (US); Powell McVay Kinney, Dallas, TX (US); Samer Alkhoury Fallouh, Dallas, TX (US); Kyle Justin Turney, Dallas, TX (US); Nathanael Lloyd Gingrich, Dallas, TX (US); Benjamin David Moore, Dallas, TX (US); Daniel Thomas Hall, Dallas, TX (US)

(73) Assignee: Vinli, Dallas, TX (US)

( * ) Notice: Subject to any disclaimer, the term of this patent is extended or adjusted under 35 U.S.C. 154(b) by 0 days. days.

(21) Appl. No.: 14/848,316

(22) Filed: Sep. 8, 2015

(65) Prior Publication Data

US 2016/0071333 A1 Mar. 10, 2016

Related U.S. Application Data

(60) Provisional application No. 62/046,857, filed on Sep. 5, 2014.

(51) Int. Cl.
*G07C 5/00* (2006.01)
*G07C 5/08* (2006.01)

(52) U.S. Cl.
CPC ..... *G07C 5/008* (2013.01); *G07C 5/006* (2013.01); *G07C 5/0808* (2013.01)

(58) Field of Classification Search
CPC ..... G07C 5/008; G07C 5/006; G07C 5/0808
USPC ..... 701/29.3
See application file for complete search history.

(56) References Cited

U.S. PATENT DOCUMENTS

| | | | | |
|---|---|---|---|---|
| 8,897,952 | B1 * | 11/2014 | Palmer | G07C 5/008 701/29.1 |
| 2004/0230356 | A1 | 11/2004 | Namaky | |
| 2008/0082221 | A1 | 4/2008 | Nagy | |
| 2012/0044527 | A1 | 2/2012 | Panko | |
| 2013/0246135 | A1 | 9/2013 | Wang | |
| 2014/0200760 | A1 * | 7/2014 | Kaufmann | G07C 5/008 701/29.3 |
| 2015/0307107 | A1 * | 10/2015 | Tamari | G07C 5/0808 701/32.4 |

OTHER PUBLICATIONS

International Search Report and Written Opinion for International Application No. PCT/US2015/049040, mailed from he International Searching Authority dated Dec. 14, 2015 (12 pages).

* cited by examiner

*Primary Examiner* — Brian P Sweeney
(74) *Attorney, Agent, or Firm* — Kirby Drake

(57) ABSTRACT

A vehicle information system is described. The vehicle information system may include an OBD interface device configurable for communication with a vehicle computer system. The OBD interface device may include at least a first transmitter and a first receiver. One or more communication protocols may be configured for communication between at least one of the OBD interface device and a client electronic device, the OBD interface device and a server computer, and the OBD interface device and a wireless receiver. An application programming interface may be configured to allow interaction between the OBD interface device and at least one of a server computer and a client electronic device.

13 Claims, 57 Drawing Sheets

SPECIFICATIONS

| | |
|---|---|
| Physical Interface | On Board Diagnostics II |
| Protocols | SAE J1850 PWM (Ford vehicles) |
| | SAE J1850 VPW (General Motors vehicles) |
| | ISO 9141-2 (Chrysler, European, and Asian vehicles) |
| | ISO 14230 KWP2000 (Keyword Protocol 2000) |
| | ISO 15765 (CAN) |
| Wireless Interface | Bluetooth LE, 2.4GHz WiFi, LTE Cellular, GPS |
| Bluetooth | Bluegiga BLE113A |
| | Bluetooth v4.0 (up to 8 connections) |
| | +0 dBm transmit power / -93 dBm receiver sensitivity |
| | CE, FCC, IC, South Korea, and Japan qualified |
| WiFi | Dragino HE |
| | 150Mbps 2.4GHz |
| | Compatible with 802.11b/g/n |
| | Sensitivity @PER: 135M: -65dBm@10%PER, 65M: -65dBm@10%PER |
| | Running mainline OpenWRT Linux 3.10 kernel |
| Cellular & GNSS | Gemalto Cinterion PLS8 |
| | GSM/GPRS/EDGE: 850/900/1800/1900MHz |
| | UMTS/HSPA+: 850/AWS/1900MHz |
| | LTE: 700/850/AWS/1900MHz |
| | Standalone/Assisted GPS |
| Microcontroller | STMicroelectronics STM32F103 |
| | ARM 32-bit Cortex™-M3 72 MHz |
| | 128KB Flash Memory |
| | CAN interface (2.0B Active) |
| | Low power, Debug over SWD/JTAG |
| Sensor | Accelerometer Freescale MMA8453Q |
| | 3-Axis, 10b/8b Digital |
| | Output Data Rates from 1.56Hz to 800Hz |
| | 3 embedded channels of motion detection: Freefall/Pulse/Jolt |

FIG. 28

VEHICLE INFORMATION SYSTEM

CROSS-REFERENCE TO RELATED APPLICATIONS

This application claims priority to and the benefit of U.S. provisional patent application No. 62/046,857, filed on Sep. 5, 2014, the disclosure of which is herein incorporated by reference in its entirety.

TECHNICAL FIELD

The technical field may generally relate to vehicle information and related data management, and more particularly to a platform for collecting, transmitting, and analyzing vehicle and/or vehicle operator information.

BACKGROUND

Vehicle technology, and in particular vehicle information technology, may become outdated as soon as a vehicle leaves an assembly line. Further, new vehicle technology often may only be implemented in new vehicles. Additionally, information available from consumer or business vehicles and related vehicle computer systems may not be easily collected for broader use and analysis. The ability to interface with vehicles and vehicle computer systems and collect desired data may often be hindered by hardware and/or communication protocol limitations. Thus, there may be a need for vehicle information hardware, software, systems, and/or platforms to facilitate collection, transmission, analysis, and general use of vehicle information and/or vehicle operator information.

BRIEF SUMMARY

In part, the disclosure relates to various devices that can be connected to, attached to, coupled with or to, suspended from, or otherwise in communication with an on board diagnostic output of a vehicle such as a car. Each device can include various housing configurations, whereby each housing defines a cavity to include one or more circuit boards, one or more transceivers, one or more antennas, one or more processors, one or more memory storage devices, one or more vehicle system communication protocols, one or more power sources, one or more wireless communication protocols, one or more busses or communication channels and other components and interfaces as described herein. The housings can include one or more curved or flat panels that define a first endface and a second endface and surfaces that connect thereto to define a cavity or volume.

In one embodiment, the device can be implemented as a dongle or plug that can attach to the on board diagnostic output port of a vehicle and communicate data about the car to a server, a communication device in the car, a mobile device, or other devices and collect and relay information about the vehicle, third party information relevant to the use of the vehicle, the drivers and passengers of the vehicle, historic events relating to the vehicle, travel paths and navigation and GPS information, and other information of interest to supply a data feed to one or more software applications that transform and use such data. The software applications can transform data from the vehicle and generate various signals and outputs in response thereto to provide navigation, security, tracking, repair, personalization and other services.

In part, the disclosure relates to a vehicle information system. The system includes an OBD interface device configurable for communication with a vehicle computer system, the OBD interface device comprising a first transmitter and a first receiver; one or more communication protocols configured for communication between at least one of: the OBD interface device and a client electronic device, the OBD interface device and a server computer, and the OBD interface device and a wireless receiver; and an application programming interface configured to allow interaction between the OBD interface device and at least one of: a server computer and a client electronic device. In one embodiment, the system further includes a vehicle information platform configurable for communication with the OBD interface device and to receive vehicle information from the OBD interface device.

In one embodiment, the system further includes a vehicle information platform application store comprising downloadable vehicle information platform applications and accessible via one or more client electronic devices. In one embodiment, the OBD interface device includes a housing comprising a user facing endface and an engine facing endface, the engine facing enface comprising an OBD connector and a support, the OBD connector and support arranged to suspend the OBD interface device relative to an OBD output port of a vehicle; and an OBD interface in electrical communication with the OBD connector; wherein the first transmitter and the first receiver comprise one or more of a cellular antenna, GPS antenna, or Wi-Fi antenna.

In one embodiment, the vehicle information platform provides a suite of cloud-based vehicle services. The platform can include one or more servers such as application servers or clusters thereof to perform the application related steps and process and transform vehicle data from an OBD interface device. In one embodiment, the suite of cloud-based vehicle services includes one or more of: a road side assistance service, a maintenance service, a diagnostic service, a communication service, a behavior service, a safety service, an infotainment service, location-based services, data collection services, and infrastructure services.

In one embodiment, the system further includes a software development kit for developing vehicle information platform applications operable on a client electronic device operating system. The devices and systems described herein can be used to perform various software and data transformation applications. In one embodiment, the vehicle information system further includes a vehicle information platform application operable with the OBD interface device to provide vehicle fleet tracking features.

In one embodiment, the vehicle fleet tracking features include providing one or more of: vehicle location, fuel consumption, speed, location history, duration of trip, VIN, year, make, and model. In one embodiment, the system includes a vehicle information platform application operable with an OBD interface device to create a virtual geofence around a vehicle. In one embodiment, the system further includes a vehicle information platform application operable with an OBD interface device to provide vehicle trip information features.

In one embodiment, the trip information features include providing one or more of: trip review, real-time trip playback, driving behavior recognition, and trip sharing. In one embodiment, the system further includes a vehicle information platform application operable with the OBD interface device to provide vehicle diagnostic features. In one embodiment, the vehicle diagnostic features include providing one or more of: maintenance locations, error codes, diagnostic descriptions, diagnostic metrics, and transmission of diagnostic information to a maintenance location. In one embodiment, the system further includes a vehicle information platform application operable with an OBD interface device to provide driver monitoring features.

In one embodiment, the driver monitoring features include providing one or more of: vehicle location tracking, speed notifications, geofence trigger notifications, location history, and notification history. In one embodiment, the system further includes a vehicle information platform application operable with an OBD interface device to provide home parameter adjustment features.

In part, the disclosure relates to a method of operating an OBD interface device with a vehicle information platform. The method includes requesting, via an OBD interface device, vehicle information from a vehicle computer system; receiving, at OBD interface device, the vehicle information from the vehicle computer system; transmitting, from the OBD interface device, the vehicle information to a vehicle information platform; performing one or more operations on the vehicle information at the vehicle information platform; and transmitting results from the one or more operations on the vehicle information to a client electronic device.

In one embodiment, the method further includes transmitting a curated stream of data from the OBD interface device to the vehicle information platform; wherein the curated stream of data comprises a collected set of parameters from the vehicle computer system based on at least one of an initial priority and a priority generated by a vehicle information platform application; and wherein the curated stream of data is adaptable based on a vehicle model and the set of parameters collected by the OBD interface device from the vehicle computer system is configurable based on parameters supported by the vehicle model.

In one embodiment, the method further includes defining a set of boundaries for a space which a vehicle can occupy in accordance with a vehicle information platform application rule; maintaining a vehicle state cache, comprising a set of at least one of parameters and messages, used to determine whether the vehicle is inside the set of boundaries; and triggering an event in response to determining that the vehicle moved outside the set of boundaries.

In one embodiment, the method further includes receiving location-based information from the OBD interface device; providing the location-based information and telemetry information via an application programming interface for use in a vehicle information platform application.

In one embodiment, the method further includes collecting vehicle-model-specific data from a plurality of OBD interface devices across a plurality of cohorts; and analyzing the vehicle-model-specific data to determine potential failures in the vehicle model for the plurality of cohorts. In one embodiment, the method further includes generating a driver score based on vehicle information received from a plurality of OBD interface devices; wherein the vehicle information is from a plurality of vehicles having the same model; and wherein the driver score is further based on a geographic area of the vehicles.

In part, the method includes authorization and revocation implementation features. In one embodiment, the method further includes authorizing a vehicle information platform application to access the OBD interface device by: adding the OBD interface device to a list of available devices for the vehicle information platform application; verifying permission for the vehicle information platform application to access the OBD interface device; and validating a token associated with the OBD interface device with the vehicle information platform.

In one embodiment, the method further includes revoking authorization for a vehicle information platform application to access the OBD interface device by: receiving an indication to revoke authorization; removing the OBD interface device from the vehicle information platform application; and initiating system-wide revocation of the authorization.

In one embodiment, the method further includes authenticating a call to the vehicle information platform from a vehicle information platform application by verifying an application ID and an application secret of the vehicle information platform application.

In part, the disclosure relates to an OBD interface device. In one embodiment, the device includes a housing comprising a user facing endface and an engine facing endface, the engine facing enface comprising an OBD connector and a support, the OBD connector and support arranged to suspend the OBD interface device relative to an OBD output port of a vehicle; one or more of a cellular antenna, GPS antenna, or Wi-Fi antenna; an OBD interface in electrical communication with the OBD connector; and one or more of a Bluetooth module and a Wi-Fi module.

In part, the disclosure relates to a vehicle information system. The system includes a base unit in communication with a vehicle computer system, the base unit comprising at least a first transmitter and a first receiver; a back pack unit in communication with the base unit, the backpack unit comprising at least a second transmitter and a second receiver; one or more communication protocols configured for communication between at least one of: the base unit and the back pack, the base unit and a client electronic device, the base unit and a server computer, the base unit and a wireless receiver; the backpack unit and a client electronic device, the backpack unit and a server computer, and the backpack unit and a wireless receiver; and an application programming interface configured to allow interaction between at least one of the base unit and the backpack, and at least one of a server computer and a client electronic device. In one embodiment, the backpack is an OBD interface device. In one embodiment, the backpack is a modular interface or networking component that couples to one or more OBD interface devices. In one embodiment, the backpack and base unit are one device.

In part, the disclosure relates to a method for vehicle information management. The method includes requesting, via a backpack in communication with a base unit, vehicle information from a vehicle computer system; receiving, at the base unit, the vehicle information from the vehicle computer system; receiving, at the backpack, the vehicle information from the base unit; transmitting, from at least one of the base unit and the backpack, the vehicle information to a vehicle information platform; performing one or more operations on the vehicle information at the vehicle information platform; and transmitting results from the one or more operations on the vehicle information to a client electronic device.

In part, the disclosure relates to a method for vehicle information management. The method includes requesting, via an on board diagnostic interface device in communication with a base unit, vehicle information from a vehicle computer system; receiving, at the on board diagnostic interface device, the vehicle information from the vehicle computer system; receiving, at the on board diagnostic interface device, the vehicle information from the base unit; transmitting, from at least one of the base unit and the on board diagnostic interface device the vehicle information to a vehicle information platform; performing one or more operations on the vehicle information at the vehicle information platform; and transmitting results from the one or more operations on the vehicle information to a client electronic device. In one embodiment, the base unit and the on board diagnostic interface device are the same device.

In an embodiment, a vehicle information system may include a base unit in communication with a vehicle computer system. In one embodiment, the base unit connects to an on board diagnostic ("OBD") port or output on a vehicle. The base unit may include at least a first transmitter and a first receiver. The system may further include a back pack unit in communication with the base unit. The backpack unit may include at least a second transmitter and a second receiver. The system may further include one or more communication protocols configured for communication between at least one of: the base unit and the back pack, the base unit and a client electronic device, the base unit and a server computer, the base unit and a wireless receiver; the backpack unit and a client electronic device, the backpack unit and a server computer, and the backpack unit and a wireless receiver. Additionally, the system may include an application programming interface configured to allow interaction between at least one of the base unit and the backpack, and at least one of a server computer and a client electronic device.

In an embodiment, a method for vehicle information management may include requesting, via a backpack in communication with a base unit, vehicle information from a vehicle computer system. The method may further include receiving, at the base unit, the vehicle information from the vehicle computer system. The method may also include receiving, at the backpack, the vehicle information from the base unit. Additionally, the method may include transmitting, from at least one of the base unit and the backpack, the vehicle information to a vehicle information platform. Moreover, the method may include performing one or more operations on the vehicle information at the vehicle information platform. Further, the method may include transmitting results from the one or more operations on the vehicle information to a client electronic device.

In an embodiment, a computer program product may reside on a computer readable storage medium having a plurality of instructions stored thereon, which, when executed by a processor, cause the processor to perform operations for vehicle information management. The operations may include requesting, via a backpack in communication with a base unit, vehicle information from a vehicle computer system. The operations may further include receiving, at the base unit, the vehicle information from the vehicle computer system. The operations may also include receiving, at the backpack, the vehicle information from the base unit. Additionally, the operations may include transmitting, from at least one of the base unit and the backpack, the vehicle information to a vehicle information platform. Moreover, the operations may include performing one or more operations on the vehicle information at the vehicle information platform. Further, the operations may include transmitting results from the one or more operations on the vehicle information to a client electronic device.

In an embodiment, a computing system for vehicle information management may include one or more processors. The one or more processors may be configured to request, via a backpack in communication with a base unit, vehicle information from a vehicle computer system. The one or more processors may further be configured to receive, at the base unit, the vehicle information from the vehicle computer system. The one or more processors may also be configured to receive, at the backpack, the vehicle information from the base unit. Additionally, the one or more processors may be configured to transmit, from at least one of the base unit and the backpack, the vehicle information to a vehicle information platform. Moreover, the one or more processors may be configured perform one or more operations on the vehicle information at the vehicle information platform. Further, the one or more processors may be configured to transmit results from the one or more operations on the vehicle information to a client electronic device.

The details of one or more implementations are set forth in the accompanying drawings and the description below. Other features and advantages will become apparent from the description, the drawings, and the claims.

BRIEF DESCRIPTION OF THE DRAWINGS

FIG. 28 depicts an example set of specifications for an OBD interface device in accordance with the present disclosure;

DETAILED DESCRIPTION

Overview

Figure 42:
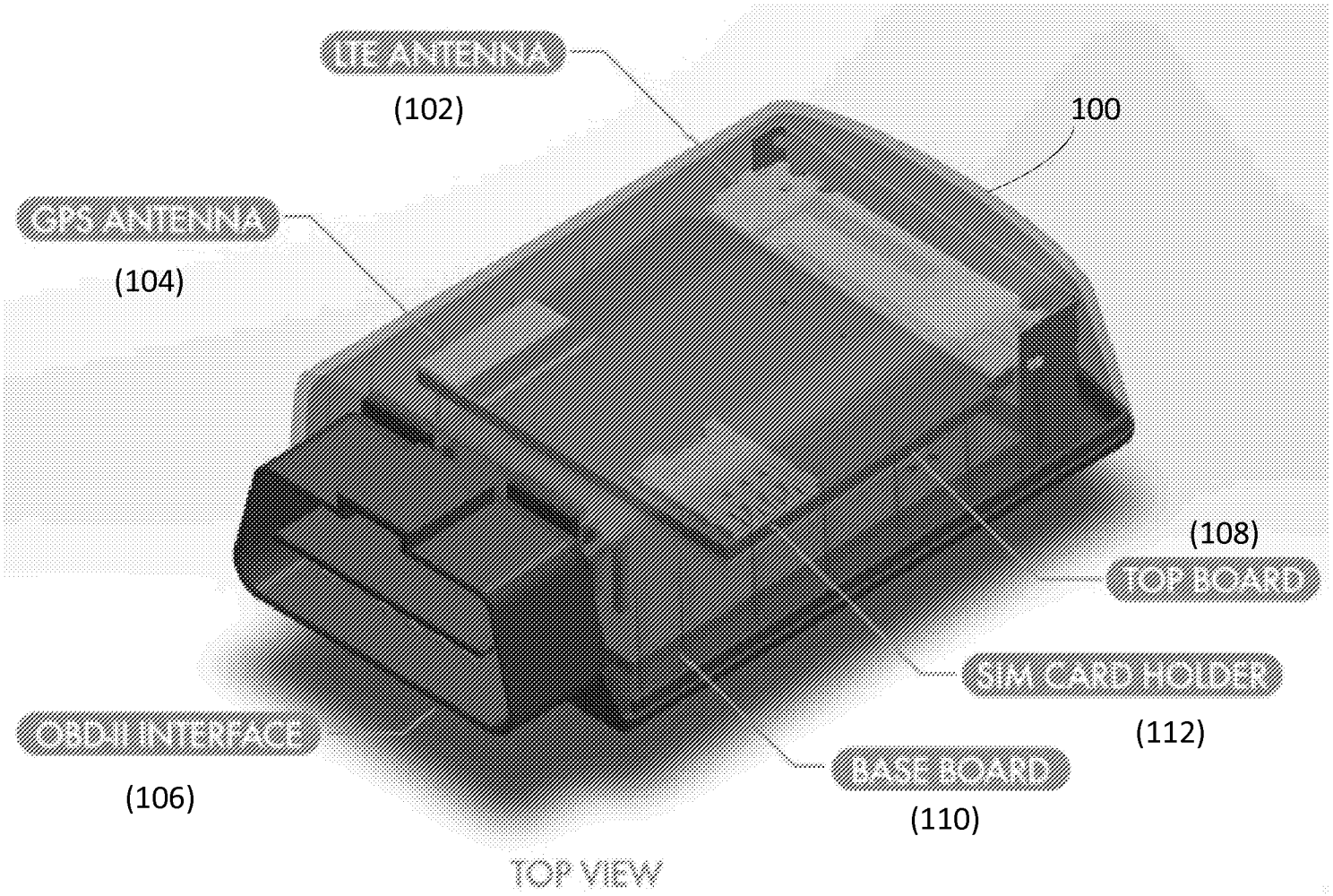
FIG. 42 is a top view of an OBD interface device in accordance with an embodiment of the present disclosure.

A vehicle information system may include an on-board diagnostics (OBD) interface device. On-board diagnostics may refer to features for a vehicle, such as an automobile, for determining or indicating various vehicle failures, errors, or metrics in and providing related diagnostic information via an interface. Referring now to FIG. 42, a top view of an OBD interface device 100 is shown. OBD interface device 100 may be configured to interface with an OBD port of an automobile or other vehicle and to pull diagnostic information from the OBD port. For example, OBD interface device 100 may include an OBD-II interface 106, which may plug into an OBD port of a vehicle. The OBD port of the vehicle may be in communication with a vehicle computer system, which may be designed and implemented by the vehicle manufacturer.

OBD interface device 100 may include a cellular antenna 102, such as an LTE antenna. Cellular antenna 102 may be configured to communicate with one or more cellular base stations, thereby providing OBD interface device 100 with a connection to the internet. OBD interface device 100 may further include a GPS antenna 104, which may be configured to communicate with one or more satellite systems or location-based systems, thereby providing OBD interface device 100 with location-based information. OBD interface device 100 may further include a top board 108 and a base board 110, on which one or more OBD interface device components (e.g., cellular antenna 102, GPS antenna 104, etc.) may be communicatively mounted. In an embodiment, OBD interface device 100 may include SIM card holder 112 which may accept and interface with a SIM card for cellular account access and management. Cellular antenna 102, GPS antenna 104, and SIM card holder 112 may be mounted on top board 108.

Figure 43:
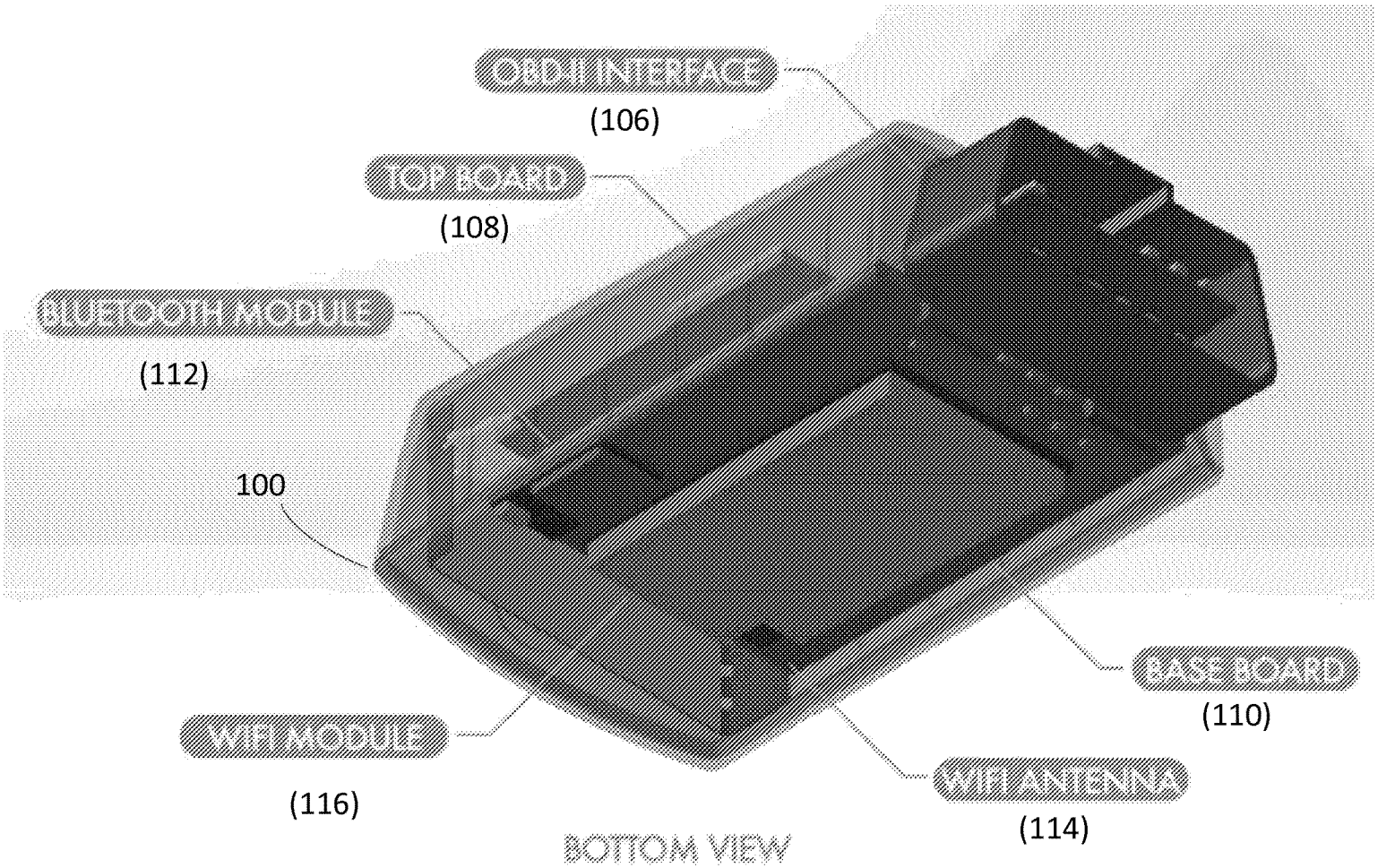
FIG. 43 is a bottom view of an OBD interface device in accordance with an embodiment of the present disclosure.

Referring now to FIG. 43, a bottom view of an OBD interface device 100 is shown and depicts OBD-II interface 106, top board 108, and base board 110 from the bottom view. OBD interface device 100 may further include Bluetooth module 112, which may be configured to provide wireless communication capability with one or more client electronic devices (e.g., a smartphone) or other devices via the Bluetooth protocol. OBD interface device 100 may also include Wi-Fi antenna 114 and Wi-Fi module 116, which may individually or in combination be configured to provide wireless communication capability with one or more client electronic devices (e.g., a smartphone) or other devices via various Wi-Fi related protocols. Bluetooth module 112, Wi-Fi antenna 114, and Wi-Fi module 116 may be mounted on base board 110. Referring now also to FIG. 28, an example set of specifications for an OBD interface device in accordance with the present disclosure is shown.

In this way the OBD interface device may include one or more transmitters and receivers which may communicate over one or more communication protocols (e.g., LTE, Bluetooth, Wi-Fi, etc.) with one or more of a client electronic device (e.g., a smartphone or tablet), a server computer, or a wireless receiver. As discussed below, the OBD interface device may be part of a vehicle information system which further includes a vehicle information platform and an application programming interface (API) configured to allow interaction between the OBD interface device and at least one of a server computer and a client electronic device.

In an embodiment, the OBD interface device may include a base unit and a backpack unit ("backpack") on which may each include various components. Referring now to FIGS. 9-16, various views of the base unit in accordance with the present disclosure are shown. The base unit may communicate with or may become communicatively coupled to a vehicle computer system (in, e.g., an automobile). The units are modular in nature and can be combined and connected using various mechanical, magnetic, or other attachment devices. The base unit may become communicatively coupled to an onboard diagnostic port of a vehicle.

Referring now to FIGS. 1-9, various views of the backpack in accordance with the present disclosure are shown. The backpack may communicate with or may become communicatively coupled to the base unit. In this way, the base unit and the backpack may be modular and may interlock. Further, the base unit and/or the backpack may include a printed circuit board and may have wireless communication capability.

Referring now to FIGS. 17-21, various views of the base unit and the backpack, both connected and disengaged, are shown. The base unit and/or the backpack may communicate via a standard protocol. Data received through the onboard diagnostic port or otherwise from the vehicle computer system may be authenticated and/or validated. The data may be sent from the base unit and/or the backpack with a vehicle identification number (VIN number) associated with a particular vehicle.

The base unit may include a Bluetooth communication unit and may be plugged unto an onboard diagnostics (OBD) port of a vehicle. Bluetooth communications may be sent to a smart phone which may have various applications installed for performing operations on vehicle information received. The backpack may include a cellular communication unit (e.g., GSM chip, 3G cellular chip, 4G cellular chip). The back of the base unit may include a port where the backpack can be plugged in, and the backpack may then access all the data that the base unit accesses from the vehicle computer system. The backpack may also include a Wi-Fi communication unit or chip. These examples are provided for illustrative purposes only as either the base unit or backpack may be configured to include multiple wireless communication units to allow for cellular, Wi-Fi, or other network communication capability.

Using the techniques and features described herein, new vehicle information technology and related components may be implemented in millions of cars currently on the road as well as in new cars. A small device (e.g., an OBD interface device such as OBD interface device 100 or an OBD interface device such as a base unit and/or backpack) may connect a car to modern technology (e.g., cellular networks, smart phones, etc.). The device may allow for access to applications and services for cars. The device may work on cars manufactured after 1996. The device may plug into a car under the dash. Plugging in the device may be simple and as easy as plugging a USB device into a computer. An application catalogue may be downloaded and related applications may be used almost immediately.

A service provider, which may administer a vehicle information platform through which vehicle information is collected, may have a database showing which VIN numbers are associated with each particular OBD interface device. This information may not be shared with developers that develop applications on or through the vehicle information platform. In this way, the vehicle information for each particular vehicle and owner may be anonymized. In some situations, developers may have access to VIN numbers and make/model/year of vehicles, in order to create, for example, predictive maintenance applications, as described below. In an implementation, an identity (e.g., ID number, hardware address, etc.) of a particular OBD interface device may propagate through the vehicle identification system and/or platform so that collected data can be mined and analyzed.

In an implementation, OBD data or other vehicle information received from the vehicle computer system through the OBD interface device may be translated and any user, business, consumer, or developer that can access the port on the base unit and/or backpack may receive the data for further analysis and use.

In an implementation where the OBD interface device includes a base unit/backpack configuration, the base unit may be responsible for actual communication to the vehicle. Devices downstream from the base unit may not have knowledge that the base unit is plugged into the vehicle. For example, the car the base unit may be collecting information from a car, e.g., RPM, speed, load value, throttle position. A user may desire to collect this information rapidly, e.g., four times a second or five times a second. The backpack may receive configurations and/or selections on those parameters from the user and may collect the corresponding data from the car. The car may also have an abundance of other information on various parameters that may not be as important to the user. As time goes on, maybe every minute or two minutes, the backpack may receive the current fuel level or O2 sensor voltage, or other information that is not changing very quickly. In this way, the vehicle information system may allow a user to collect certain data quickly and more regularly, and ignore other data. In this way, the vehicle information system may handle data more intelligently. The base unit may collect and transmit a proprietary or custom stream of data to a backpack, which may stream or provide the data to a smartphone over a cellular protocol, over Bluetooth, Wi-Fi, or any other protocol, to the vehicle information platform, and ultimately to any client application.

While the OBD interface device may be discussed herein as having a configuration such as that of OBD interface device 100 or having a base unit/backpack configuration, it should be noted that the techniques, features, and functionality described herein may generally be achieved with either configuration, and discussion of one or more features in the context of one configuration is not intended limit the one or more features from being integrated into the other configuration.

In an implementation, an OBD interface device may communicate with a car and query certain data (e.g., speed, RPM, etc.) based on user selection or default settings. The backpack may prioritize those queries (e.g., related to throttle, speed, or other high-priority, high-frequency queries). For example, a user may specify information desired through a client application or certain queries may be encoded on the base unit and may be default queries out of the box. A set of default queries may be set on the OBD interface device which may, on an application by application basis, specify which queries are the priorities. For example, if a developer created an application that is concerned with only fuel consumption, the application may receive fuel level only as regularly as possible and may not receive any other information. In this way, the OBD interface device may allow for application-specific prioritization of that data available from the car and the base unit and may override the default querying of other data in order to more quickly query for the desired data (e.g., fuel consumption).

In an embodiment, the backpack may include a processor that receives query instructions from user applications and overrides default query instructions stored in a memory. A custom configuration protocol may be used to send information between the base unit and the backpack. The base unit may query data at a rate instructed by the backpack, which may have been selected by a user through a user application. In this way, a user may customize what data is received at the backpack.

In an implementation, if two drivers often drive the same car, the vehicle identification platform may determine which driver is driving based on the driver behavior and driver score information (as discussed below). Further, in an implementation, different backpacks may be used by different drivers for driver identification purposes as each backpack may be associated with a different identifier. In an implementation, a backpack may include a toggle or other type of switch which may indicate different drivers.

In an implementation, additional add-on hardware and/or additional applications may be used with the base unit and/or backpack that may allow a user to make an emergency call. An add-on device may include a speaker and microphone may be separate from the OBD interface device or base unit and/or backpack. The add-on device may communicate with the OBD interface device or base unit and/or backpack the over Bluetooth and may be placed on the driver's dashboard or elsewhere in the car. Other external wireless peripherals may also be used.

One or more applications or services may be provided by the vehicle information platform and corresponding API, as described below. For example, an "eCall" service or application may be an automatic crash detection service that works with the vehicle information platform and may be less expensive than currently available services that are similar.

For example, in an implementation, the vehicle information platform may allow for self-reporting of vehicle health and maintenance. For example, when a check engine light switches on, the vehicle information platform may receive an indication from OBD interface device and supply the indication or related information to a particular user application. For example, the check engine light or issue may be associated with a diagnostic trouble code (DTC code). The vehicle information platform may send the DTC code, a history of previous DTC codes, or recent driving habits, etc. to the owner or to a mechanic who can view the information in, e.g., a client or smart phone application.

Figure 38:
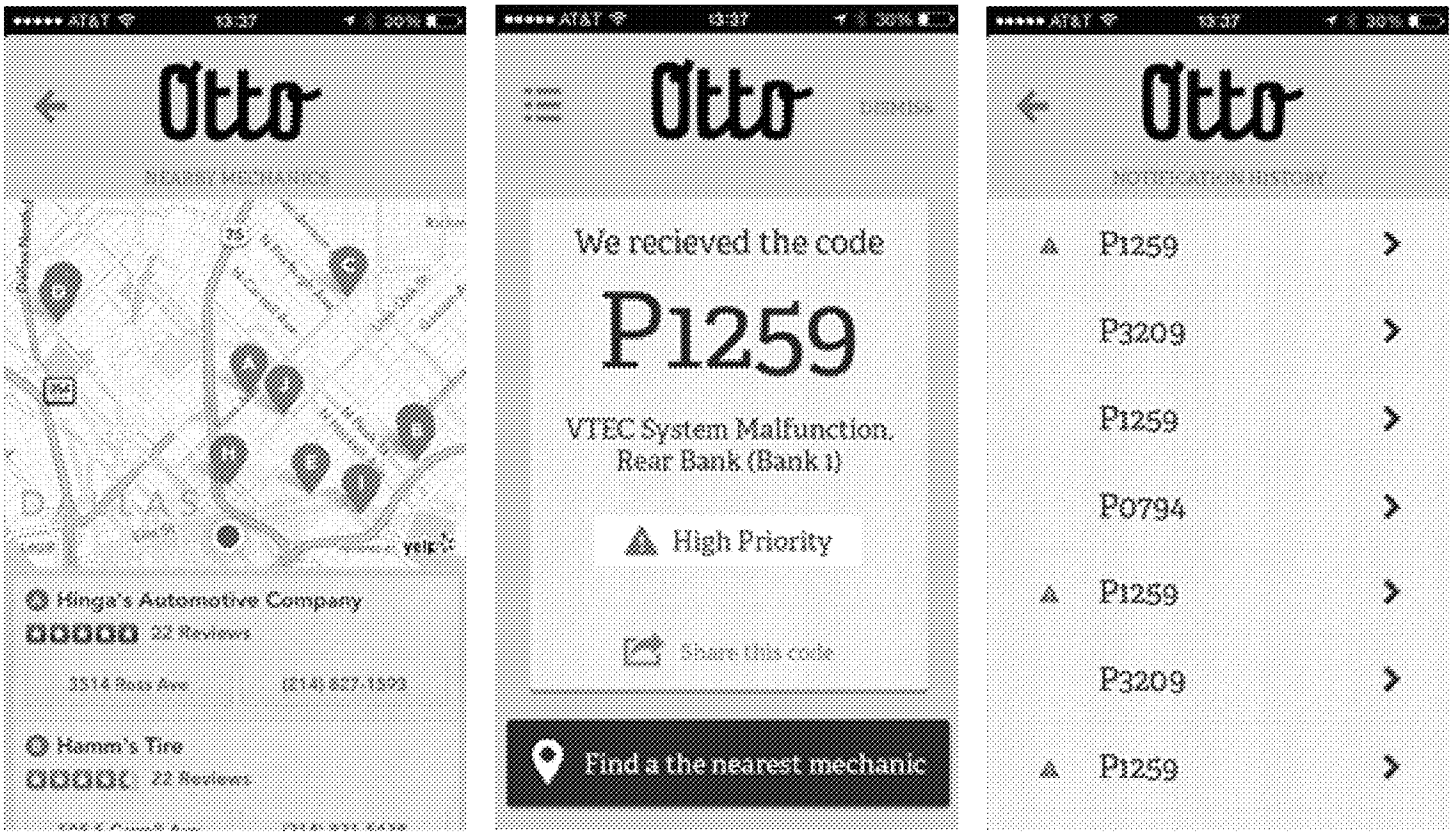
FIG. 38 depicts example diagnostic/maintenance application GUIs in accordance with the present disclosure.
Figure 39:
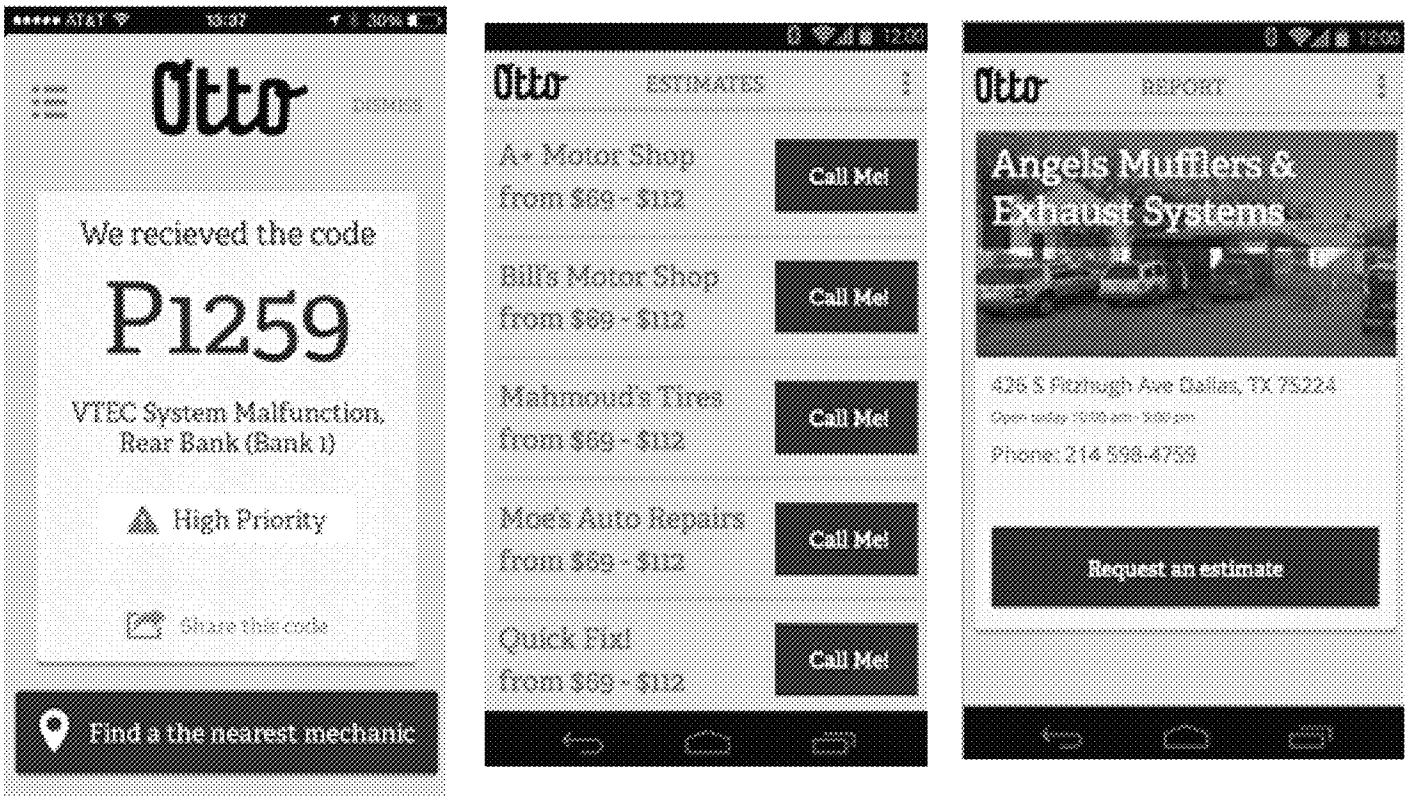
FIG. 39 also depicts example diagnostic/maintenance application GUIs in accordance with the present disclosure.

The mechanic may bid on a price to perform any associated maintenance. The mechanic may also report back to the platform to indicate the work performed to fix the problem (e.g., associated with the DTC code). Referring now also to FIGS. 38-39, example diagnostic/maintenance application GUIs in accordance with the present disclosure are shown. As shown, the services provided by the vehicle information platform may be used to diagnose vehicle failures and receive maintenance estimates from mechanics, among other things. The service provider may then collect similar information for multiple instances of the DTC code and report the data back to the manufacturer. In an implementation, the data collected by the service provider from a large population of vehicles may become valuable, and the service provider may sell the information collected on each make/model/year vehicle to the manufacturer for further analysis. This transfer of data from the OBD interface device to the vehicle information platform, mechanic, and/or manufacturer (or, e.g., bidirectional vehicle data transfer) may be facilitated by one or more applications designed by developers to work with the vehicle identification platform.

In an implementation, the OBD interface device may check periodically (e.g., every second, two seconds, etc.) to see if a dashboard indicator (e.g., check engine light) has been caused to switch on. The resulting information may be sent to the vehicle information platform, which may include and event-based system or application. The event based system may, in response to determining that a dashboard indicator has been switched on or that a DTC code has been triggered, send a text message to a vehicle owner or mechanic, or otherwise operate on or transmit the information in accordance with preferences set in the vehicle information system. Based on a certain chain of events selected in a client application or programmed as rules in the platform, a user may configure a set of conditions (e.g., engine light on, if being driven excessive miles) and have a report sent to a mobile and/or client account with related information that has been requested.

Figure 41:
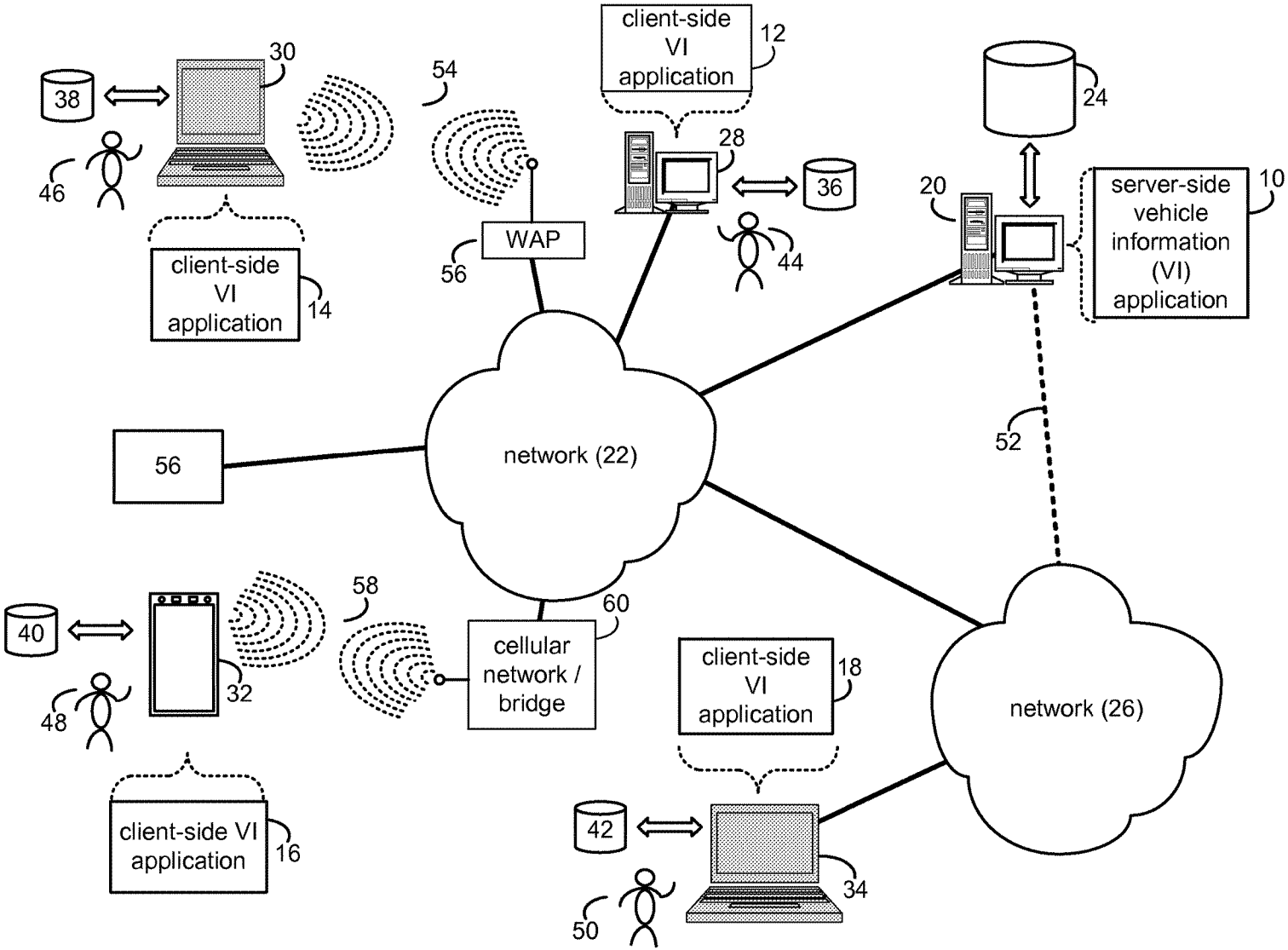
FIG. 41 is an overview of a system that can execute one or more vehicle information processes in accordance with the present disclosure.

Referring to FIG. 41, there is shown a server-side vehicle information (VI) application 10 and client-side VI applications 12, 14, 16, and 18. Server application 10 and/or one or more of client applications 12, 14, 16, and/or 18 may execute one or more processes configured to carry out one or more of the features described herein, including running the vehicle information platform. Server application 10 may be referred to as a process configured to carry out one or more of the features described herein, such as vehicle information process 10. Further, one or more of client applications 12, 14, 16, and 18 may be referred to as a process configured to carry out one or more of the features described herein, such as vehicle information processes 12, 14, 16, and/or 18.

The vehicle information process may be a server-side process (e.g., server-side vehicle information process 10), a client-side process (e.g., client-side vehicle information process 12, client-side vehicle information process 14, client-side vehicle information process 16, or client-side vehicle information process 18), or a hybrid server-side/client-side process (e.g., a combination of server-side vehicle information process 10 and one or more of client-side vehicle information processes 12, 14, 16, 18).

The base unit and backpack devices described herein may be onboard diagnostic (OBD) devices extendable with interchangeable devices. It should be noted that this is not a limitation of the present disclosure and the base unit and backpack devices may be configured to connect, communicate, or otherwise operate with a vehicle computer system without using an OBD port (e.g., wirelessly, through direct computer connection, etc.). OBD devices for commercial or personal use may be packaged as either single units relying on wireless communication with a host device or may be part of a larger device connected by a fixed wire. As such standard OBD devices may not be extensible and may be single-purpose devices relying on host applications or post-processing of data to enable extended features or new forms of utilization.

As such, there may be a need for an extensible hardware platform that allows for additional functionality to be added to a base OBD device. This platform may incorporate standards for both physical and electrical interface with a base unit and other peripheral devices. Third-party manufacturers may create application-specific peripheral devices based on these standards without having to develop direct OBD interfaces for each application.

Figure 1:
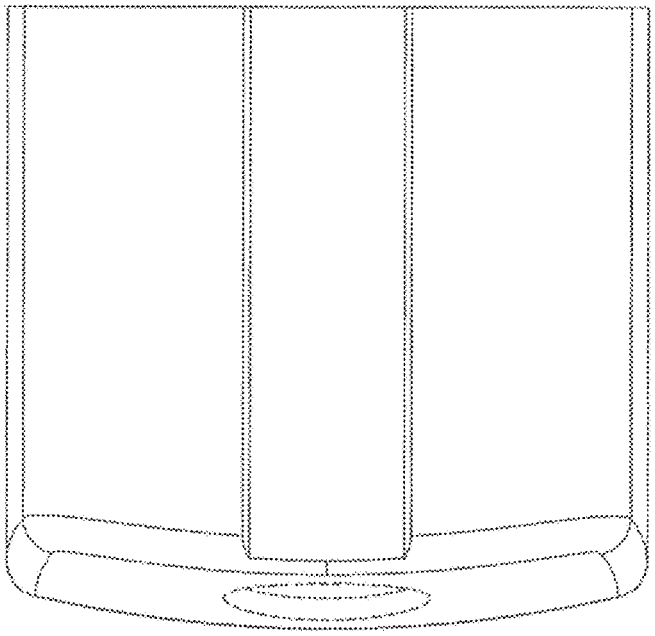
FIG. 1 is a top view of an OBD interface device or component of a vehicle information system of the present disclosure.
Figure 2:
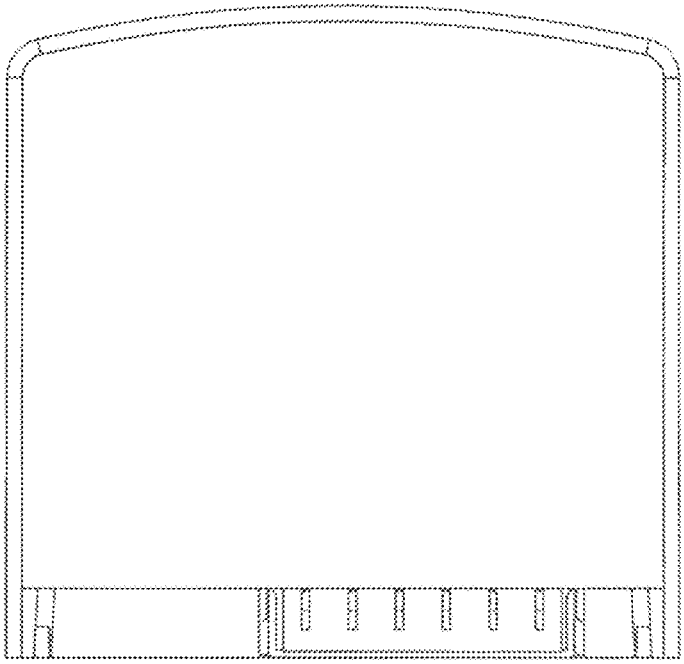
FIG. 2 is a bottom view of an OBD interface device or component or unit.
Figure 3:
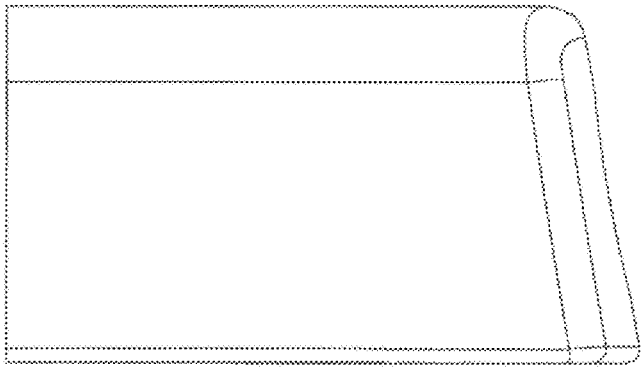
FIG. 3 is a right side view of an OBD interface device or component or unit.
Figure 4:
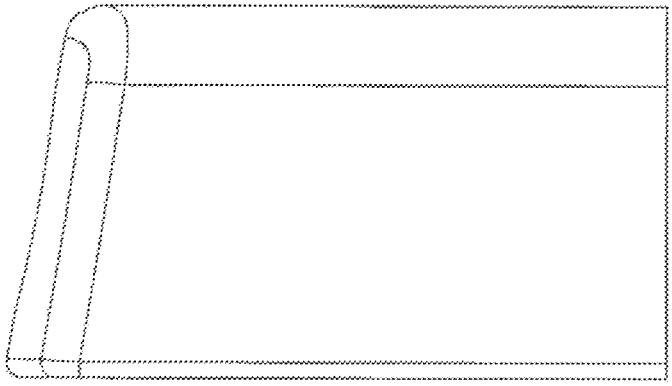
FIG. 4 is a left side view of an OBD interface device or component or unit.
Figure 5:
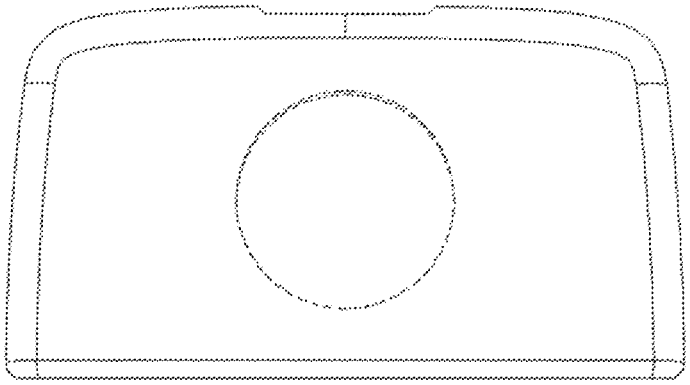
FIG. 5 is a rear view of an OBD interface device or component or unit.
Figure 6:
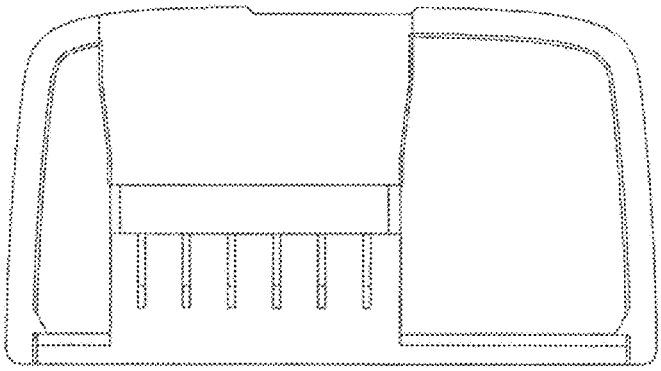
FIG. 6 is a front view of an OBD interface device or component or unit.
Figure 7:
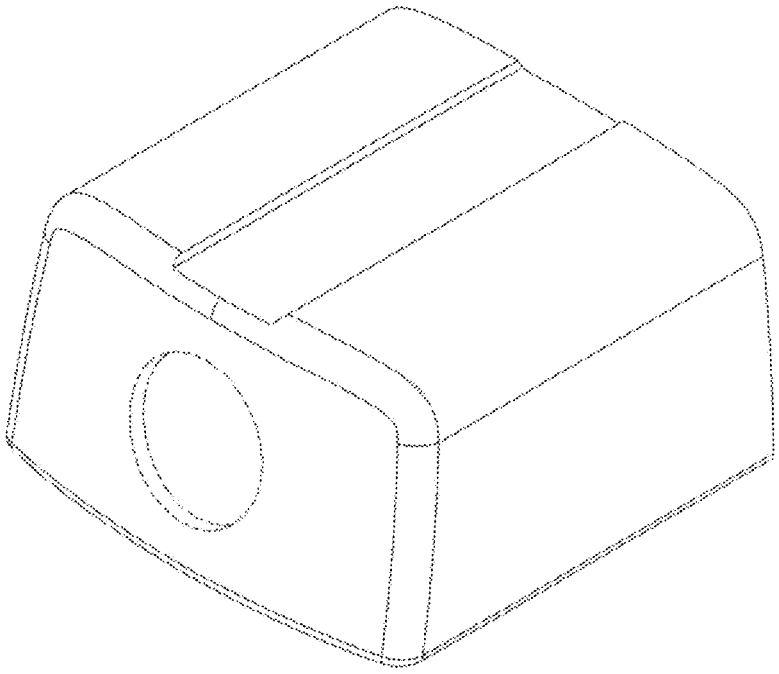
FIG. 7 is a rear-right side perspective view of an OBD interface device or component or unit.
Figure 8:
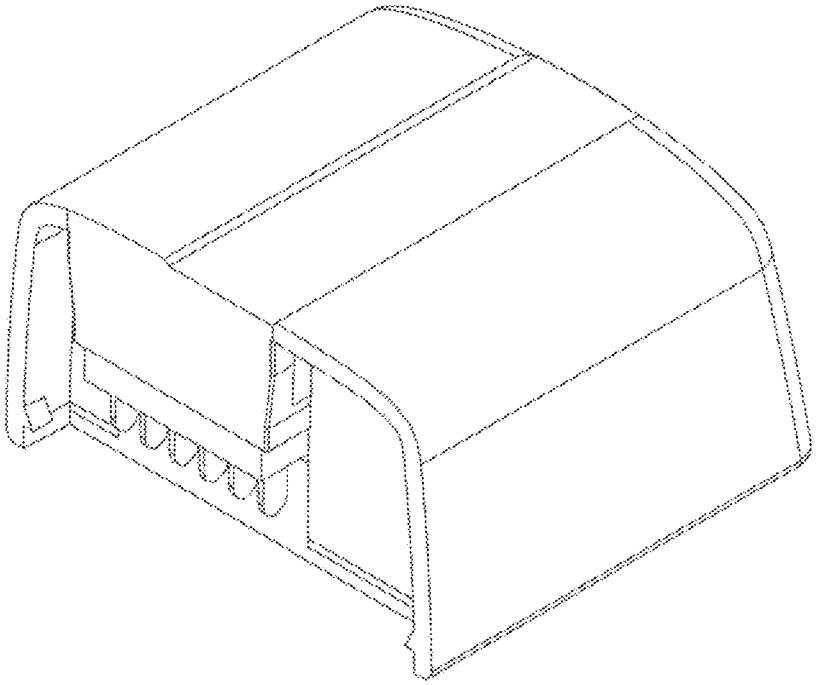
FIG. 8 is a front-right side perspective view of an OBD interface device or component or unit.
Figure 9:
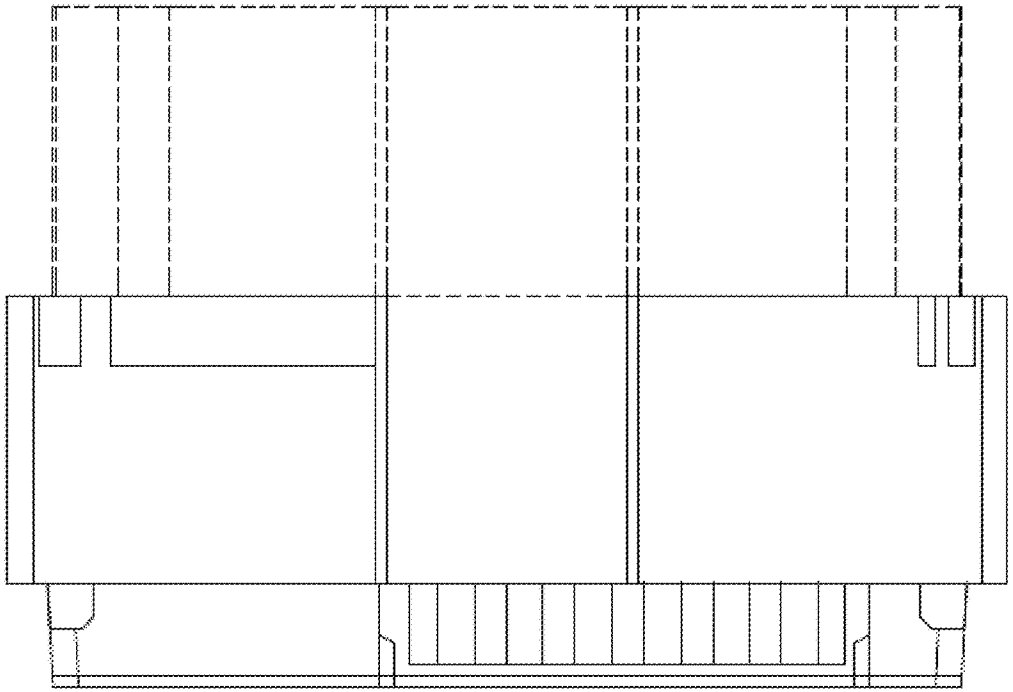
FIG. 9 is a top view of an OBD interface device or base unit of a vehicle information system of the present disclosure.
Figure 10:
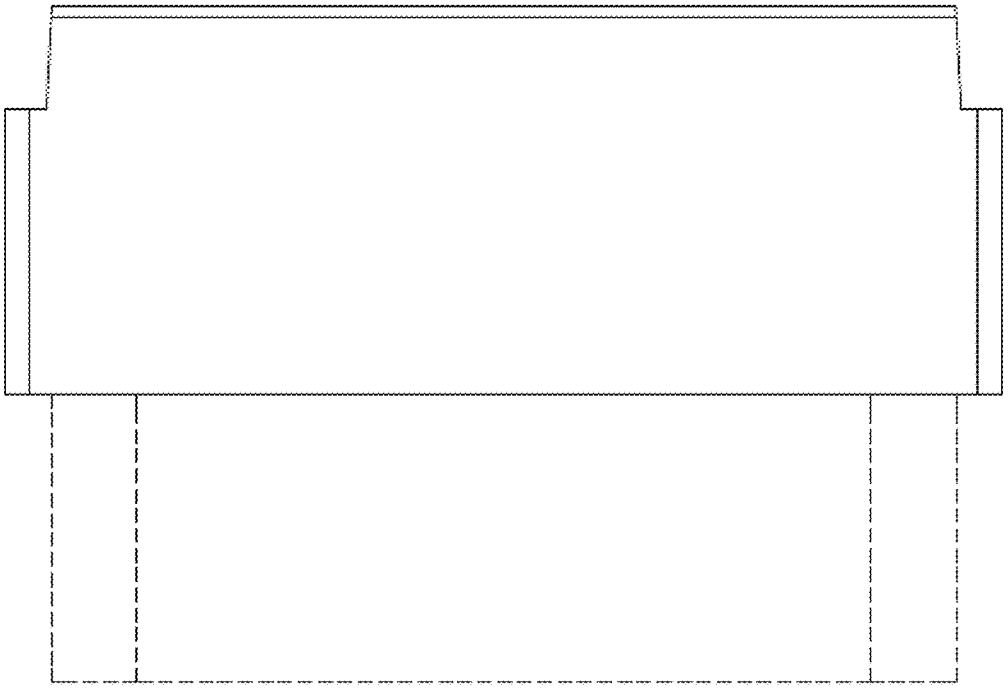
FIG. 10 is a bottom view of the OBD interface device or base unit.
Figure 11:
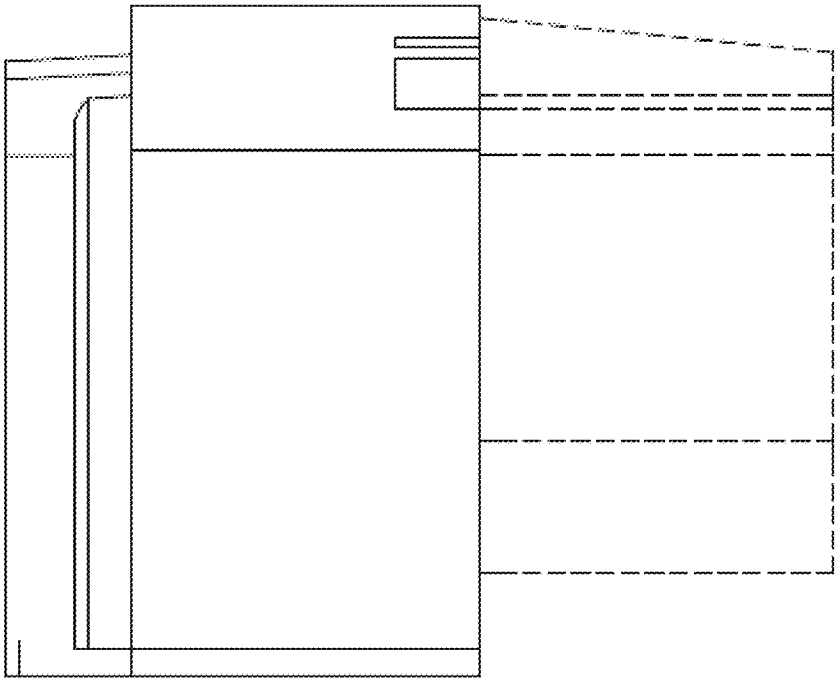
FIG. 11 is a right side view of the OBD interface device or base unit.
Figure 12:
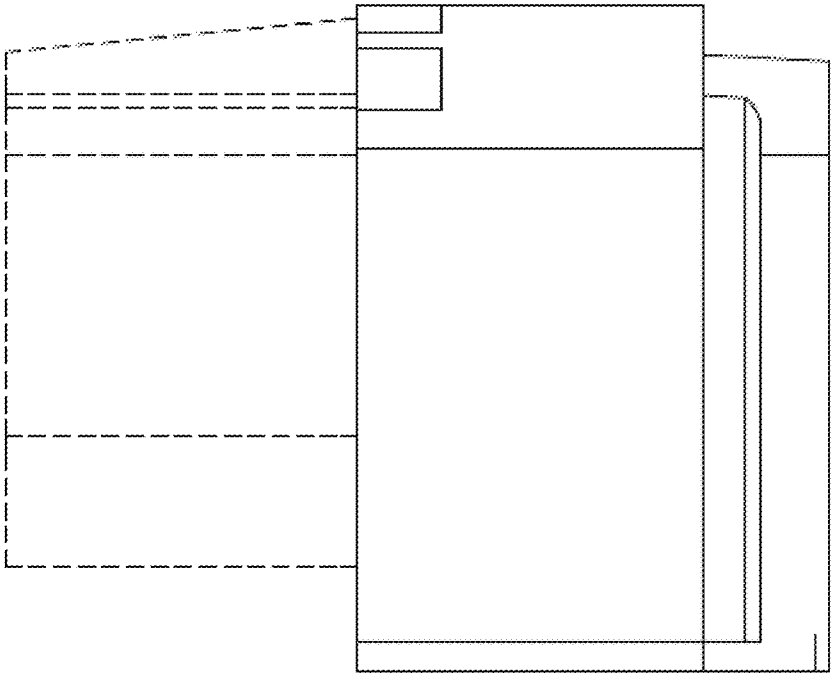
FIG. 12 is a left side view of the OBD interface device or base unit.
Figure 13:
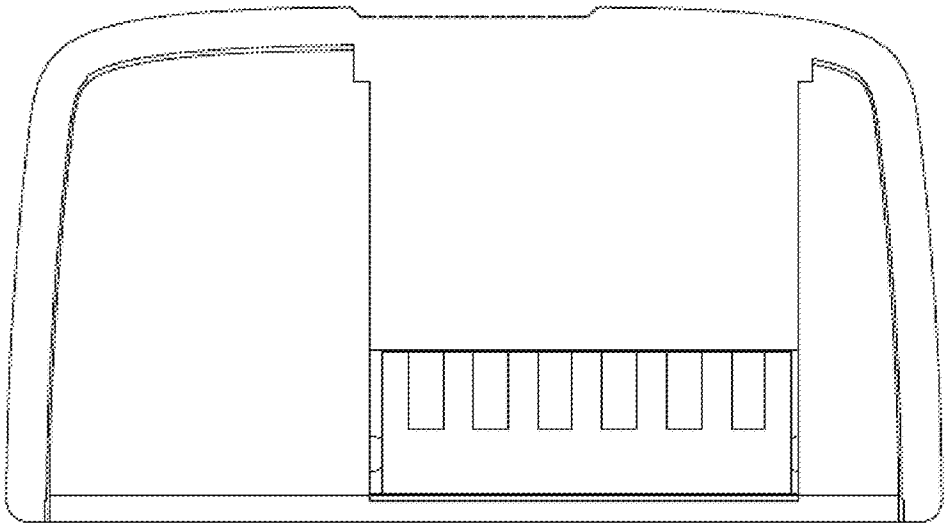
FIG. 13 is a rear view of the OBD interface device or base unit.
Figure 14:
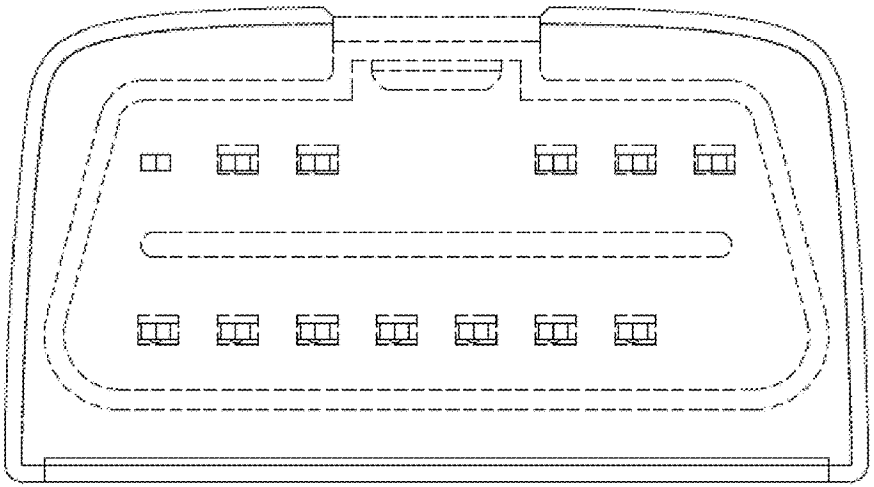
FIG. 14 is a front view of the OBD interface device or base unit.
Figure 15:
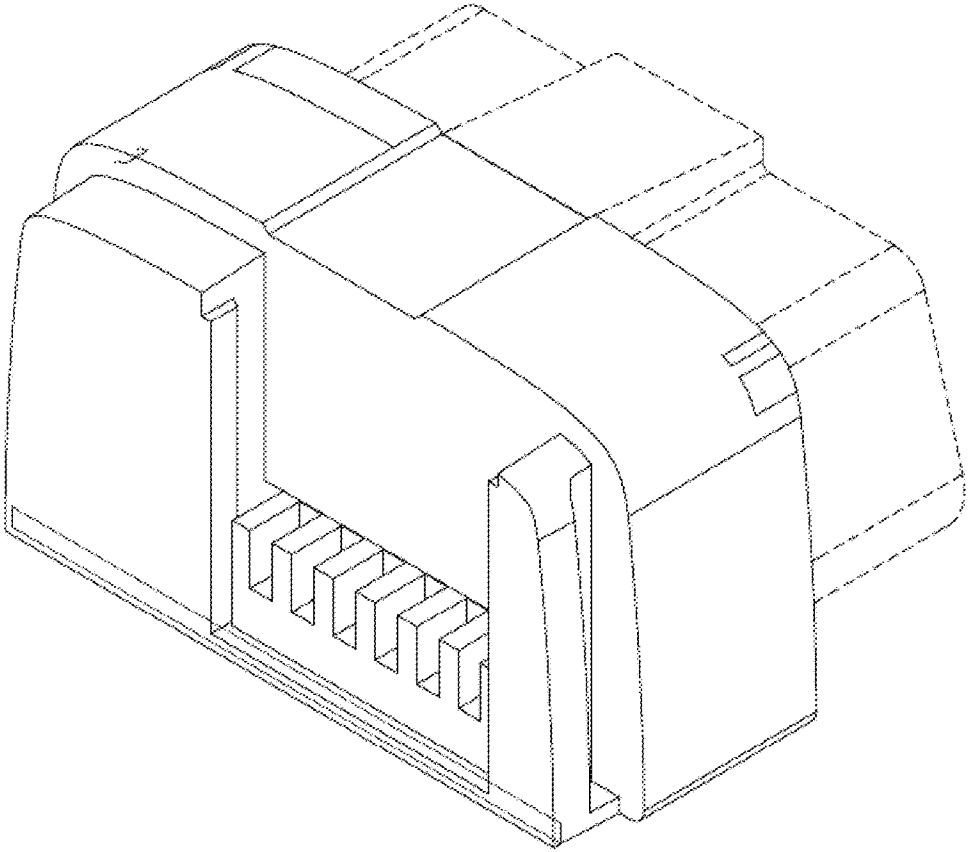
FIG. 15 is a rear-right side perspective view of the OBD interface device or base unit.
Figure 16:
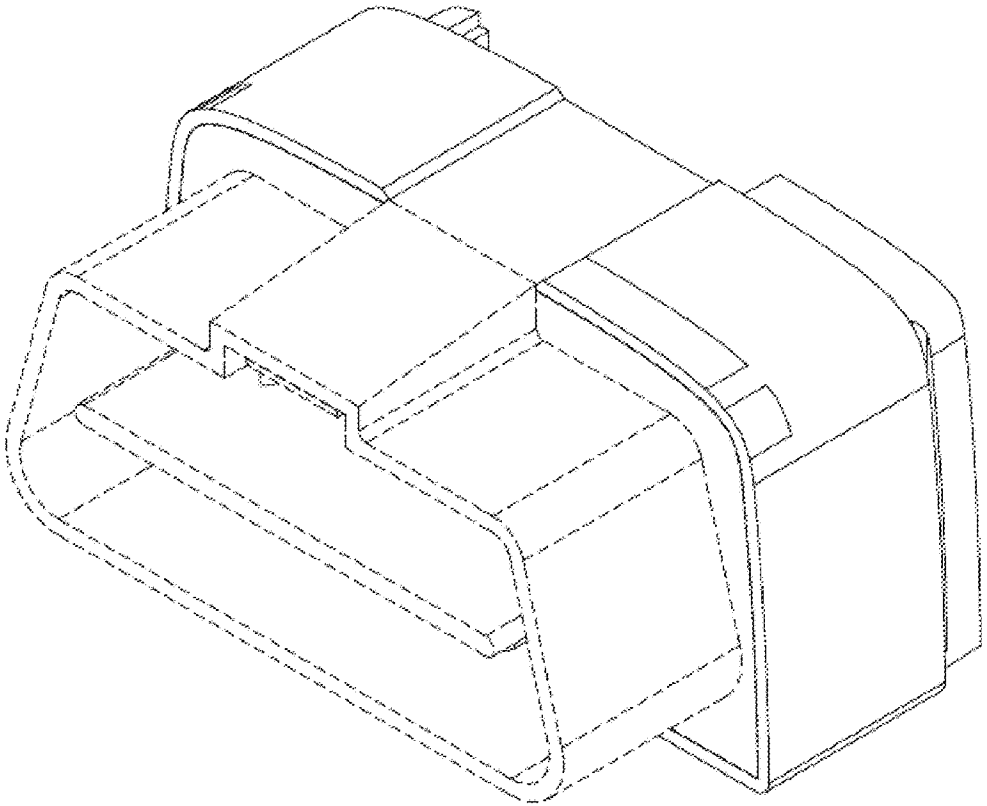
FIG. 16 is a front-right side perspective view of the OBD interface device or base unit.
Figure 17A:
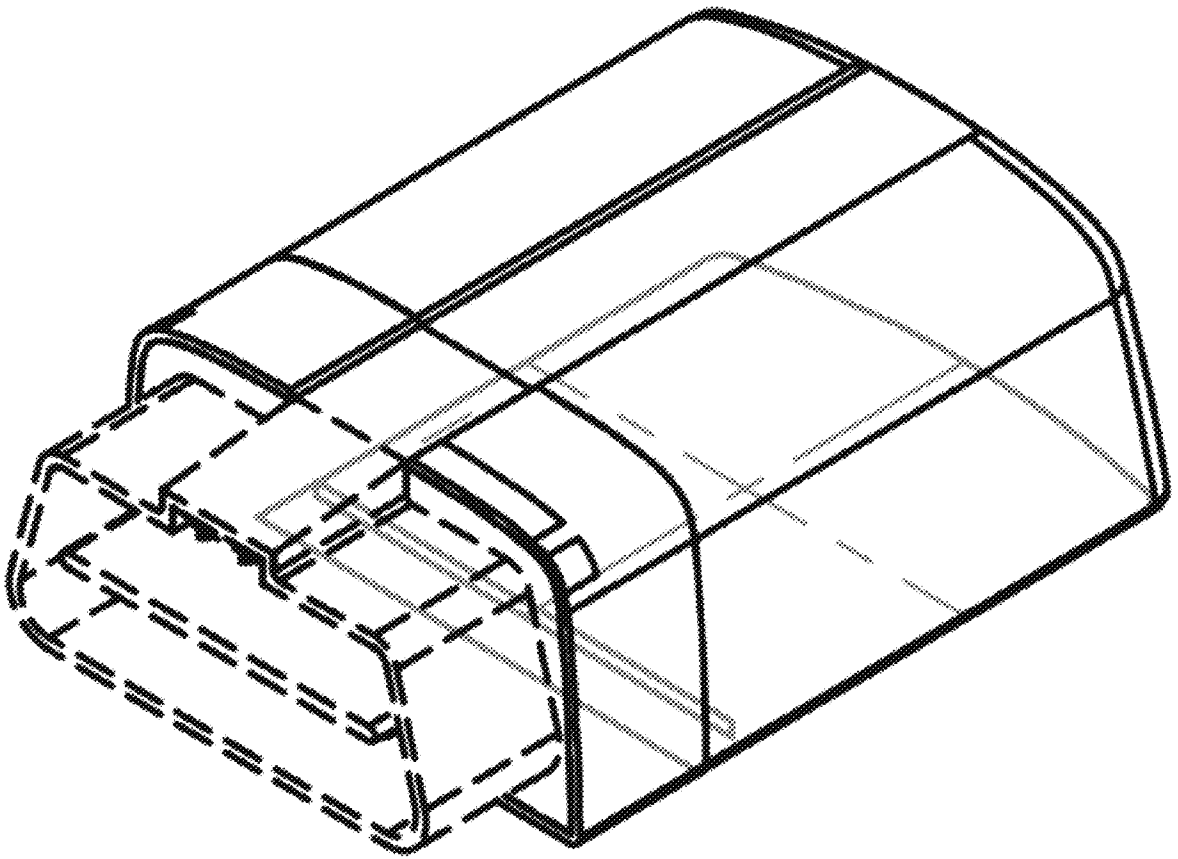
FIG. 17A is a top-front-right side perspective view of a base unit connected to a backpack unit of a vehicle information system of the present disclosure.
Figure 17B:
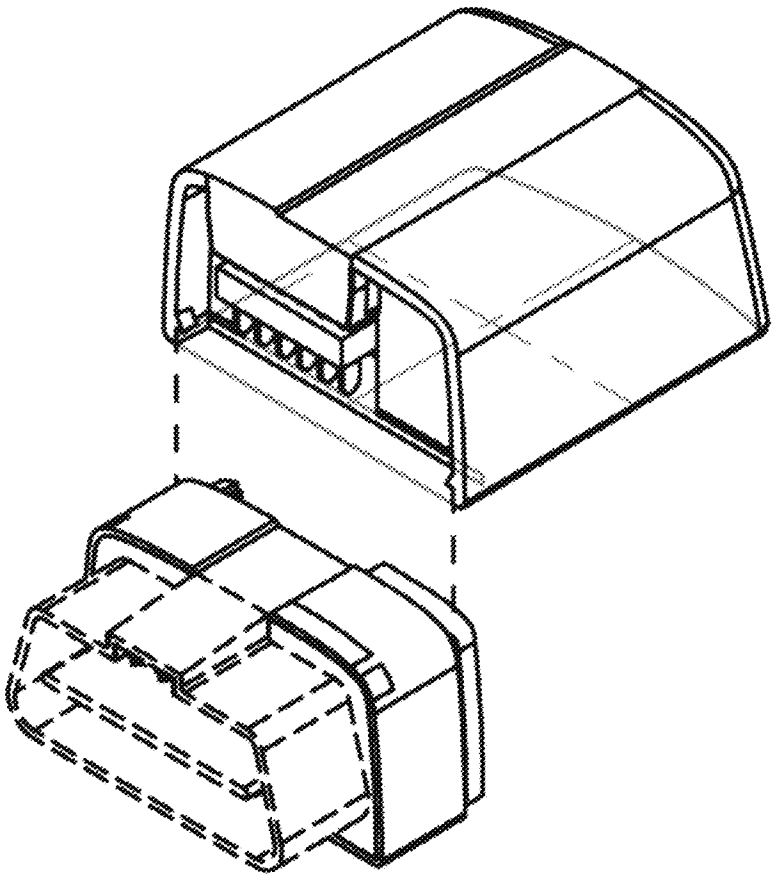
FIG. 17B is a top-front-right side perspective view of the base unit disengaged from the backpack unit.
Figure 17C:
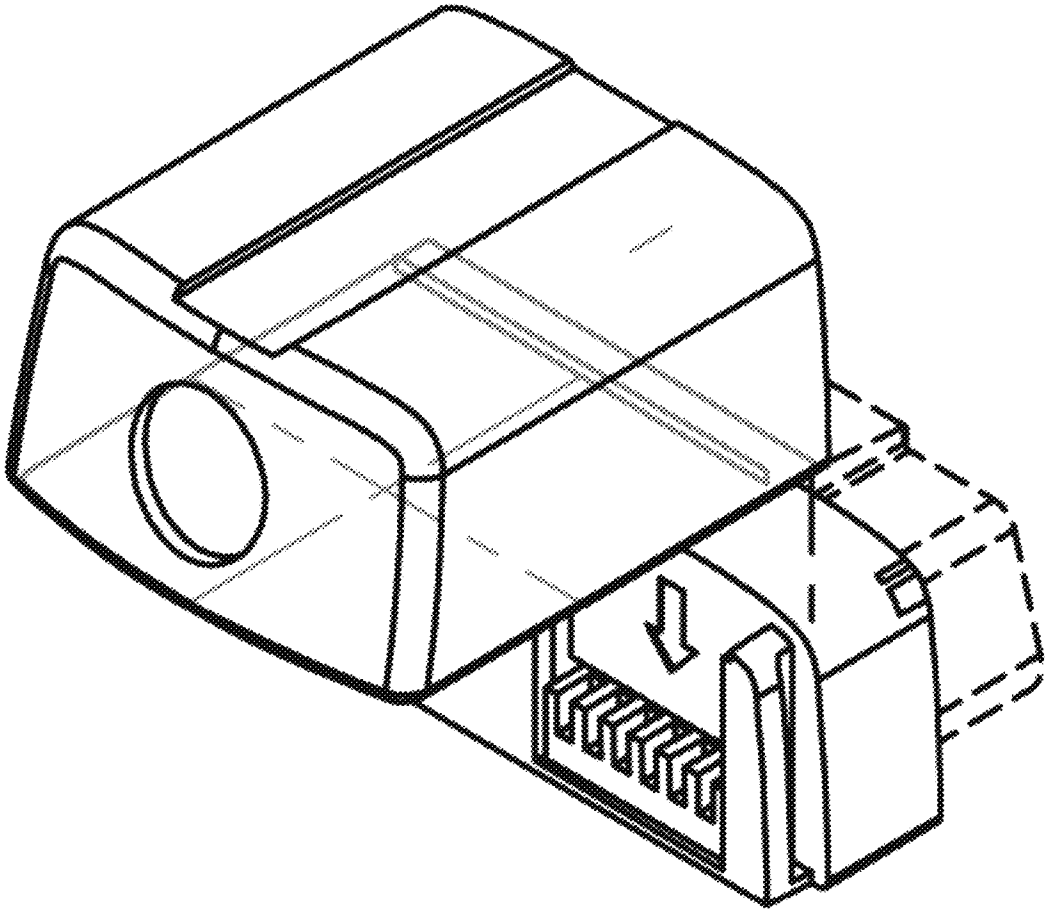
FIG. 17C is a top-rear-right side perspective view of the base unit disengaged from the backpack unit.
Figure 17D:
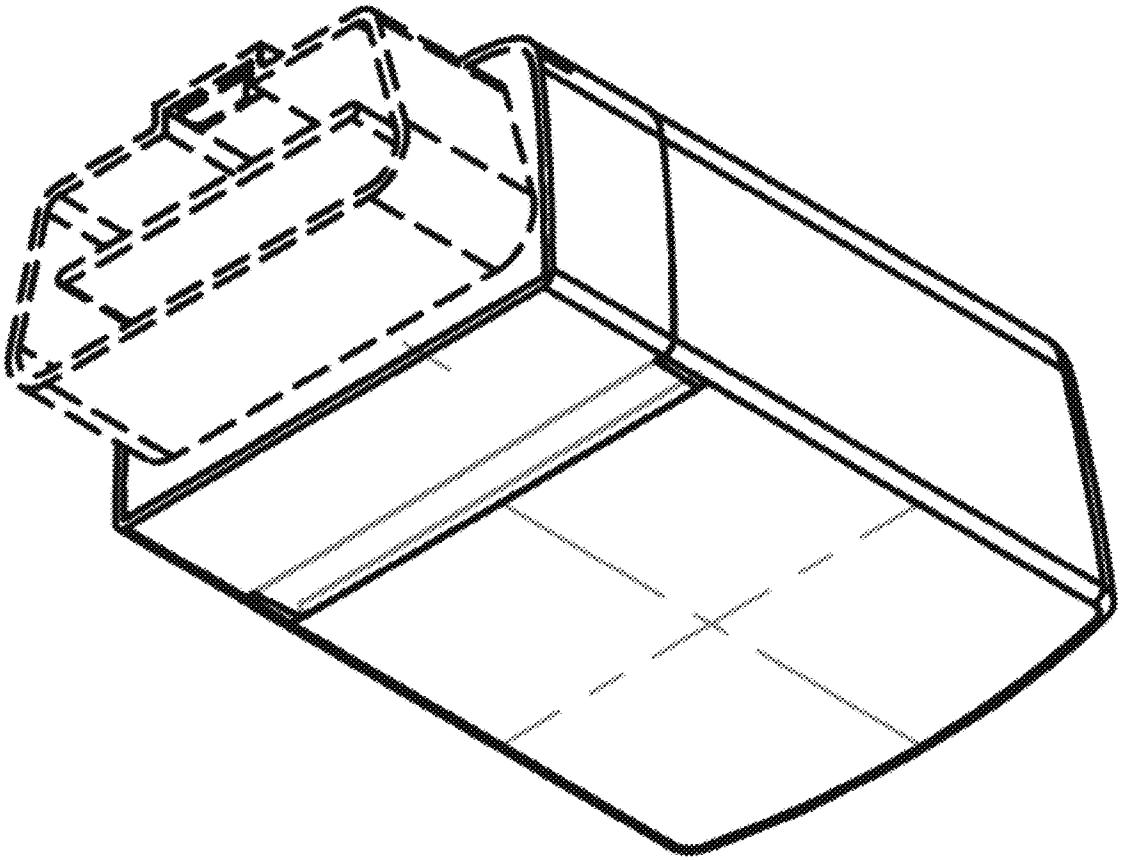
FIG. 17D is a bottom-front-right side perspective view of the base unit connected to the backpack unit.
Figure 17E:
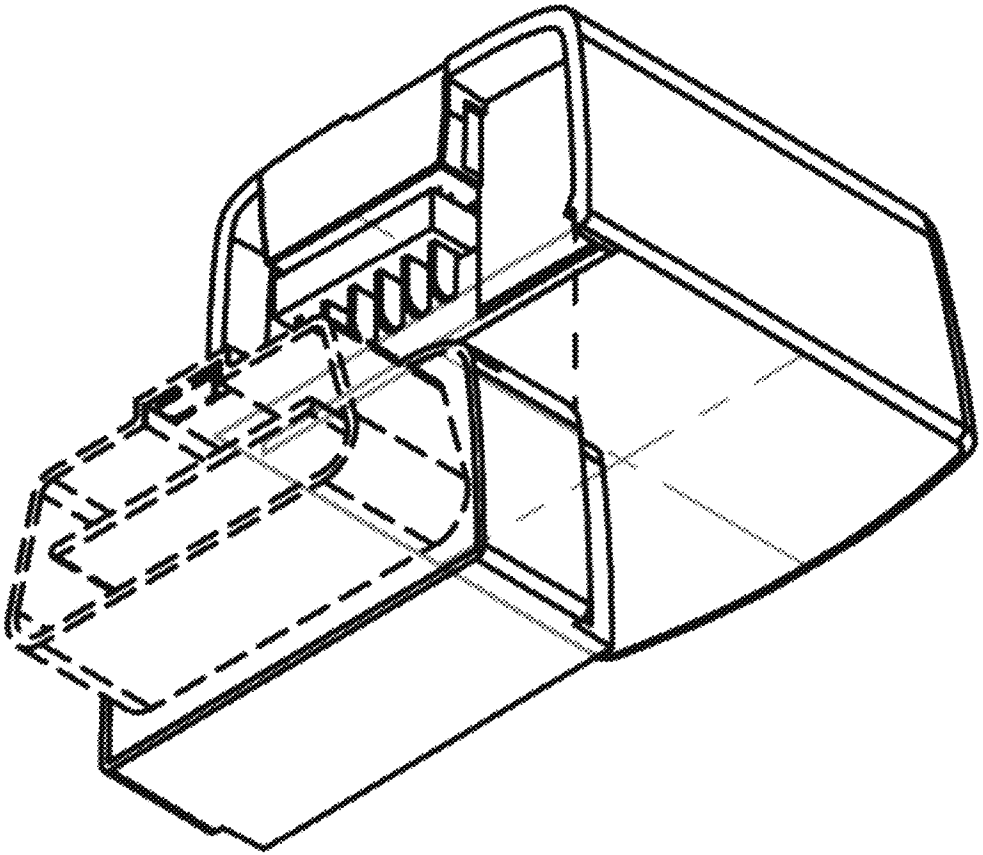
FIG. 17E is a bottom-front-right side perspective view of the base unit disengaged from the backpack unit.
Figure 17F:
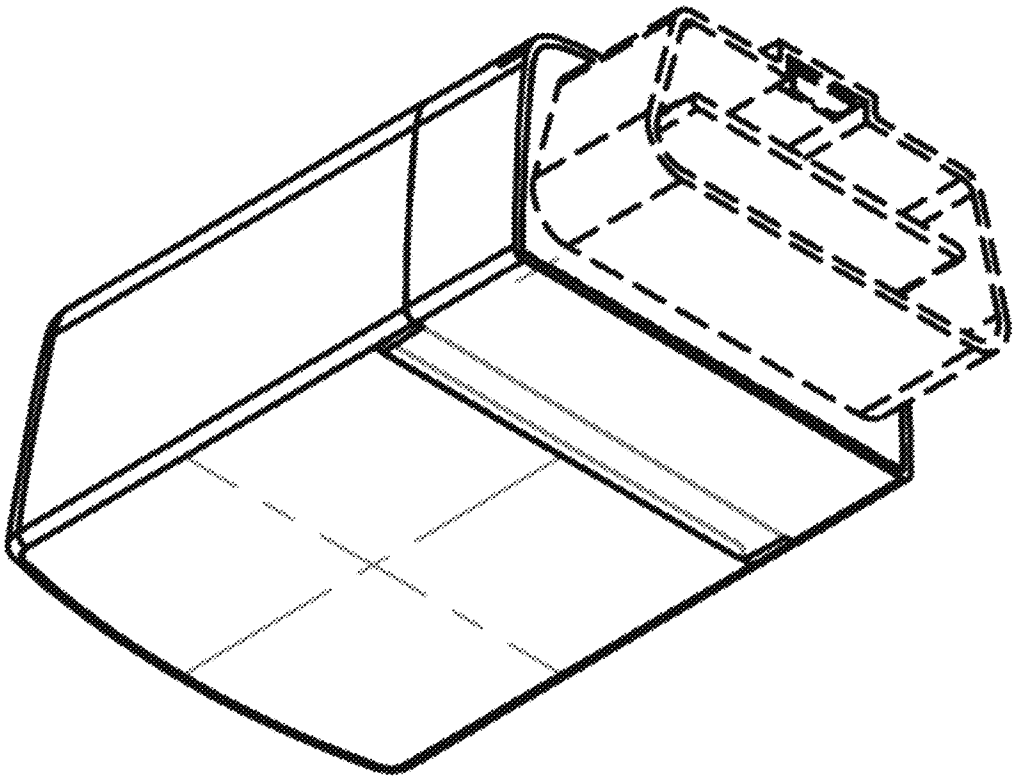
FIG. 17F is a bottom-front-left side perspective view of the base unit connected to the backpack unit.
Figure 17G:
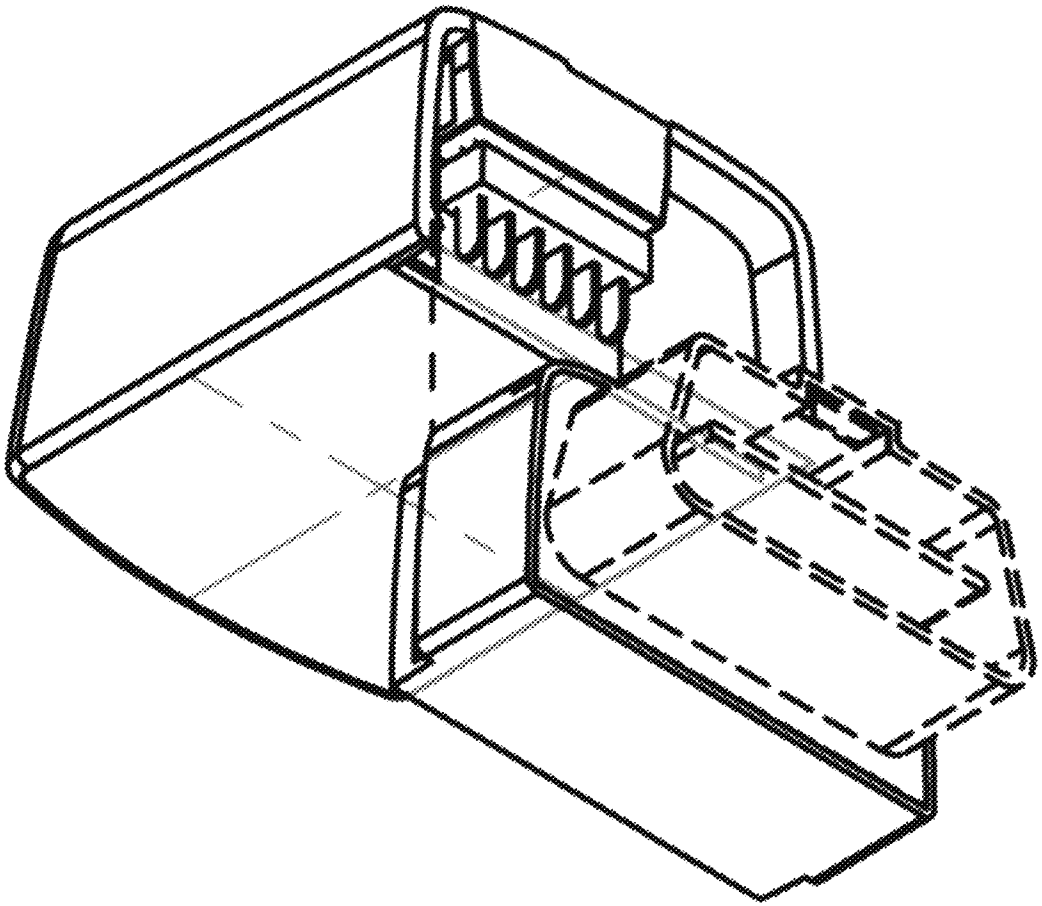
FIG. 17G is a bottom-front-left side perspective view of the base unit disengaged from the backpack unit.
Figure 17H:
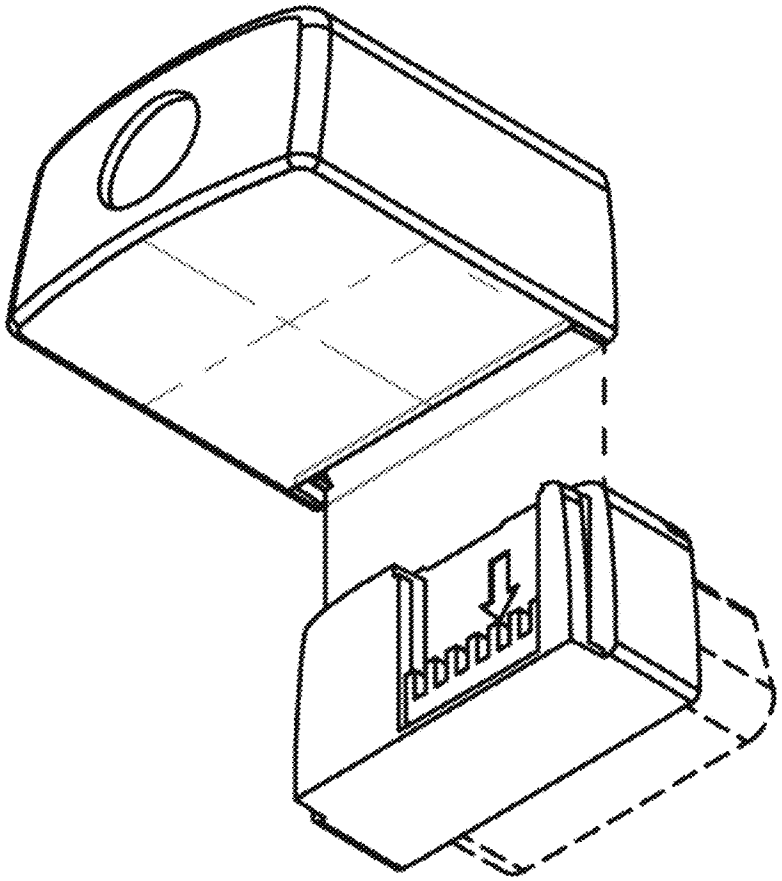
FIG. 17H is a bottom-rear-right side perspective view of the base unit disengaged from the backpack unit.
Figure 18:
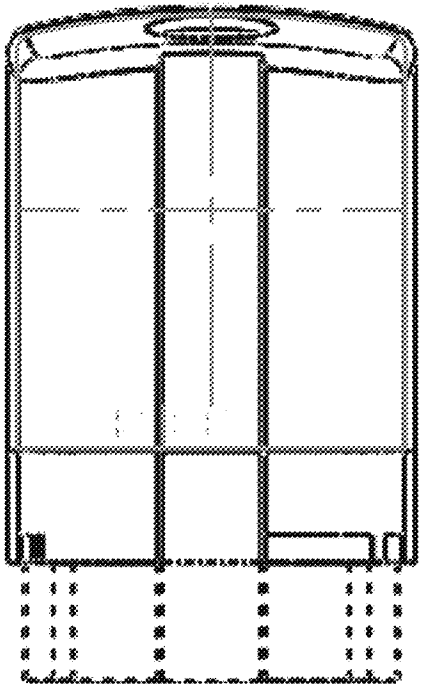
FIG. 18 is a top view of the base unit connected to the backpack unit.
Figure 19A:
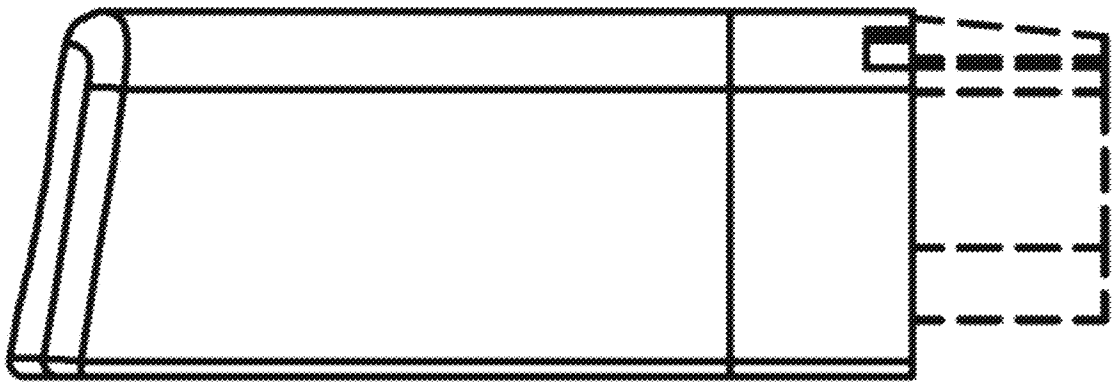
FIG. 19A is a left-side view of the base unit connected to the backpack unit.
Figure 19B:
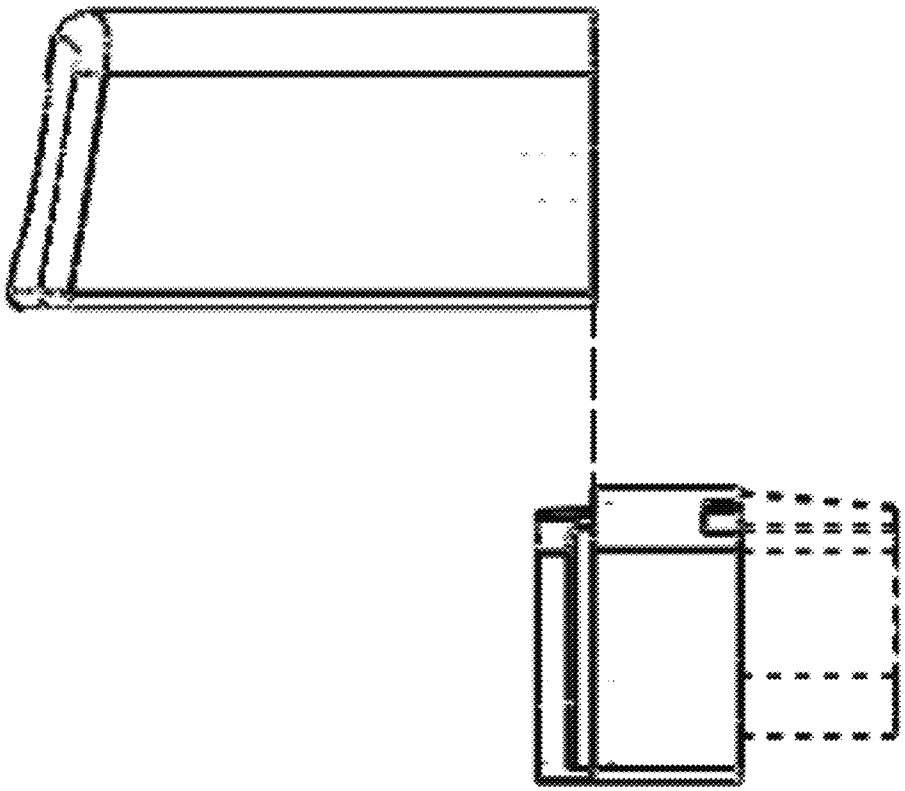
FIG. 19B is a left-side view of the base unit disengaged from the backpack unit.
Figure 19C:
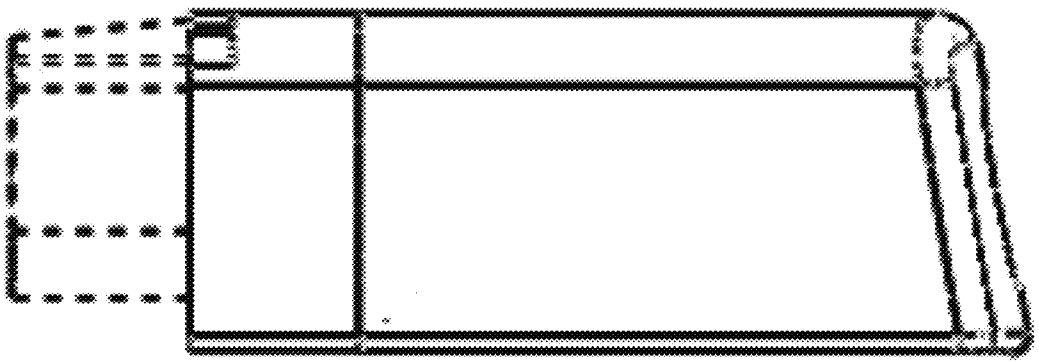
FIG. 19C is a right-side view of the base unit connected to the backpack unit.
Figure 19D:
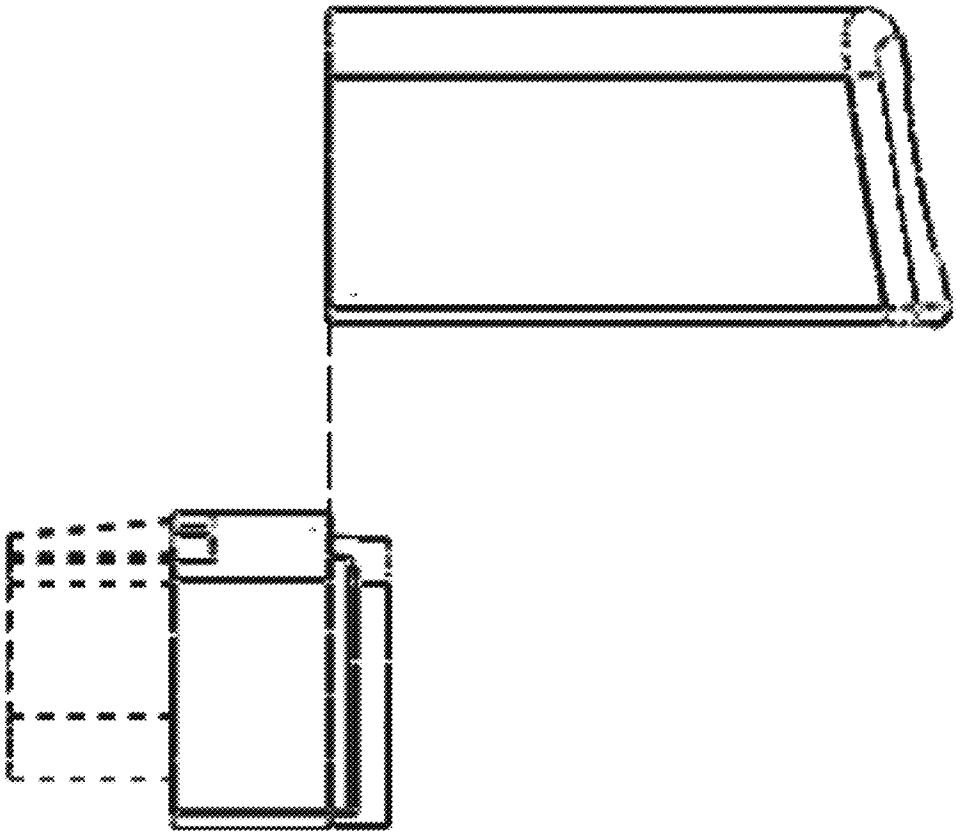
FIG. 19D is a right-side view of the base unit disengaged from the backpack unit.
Figure 20:
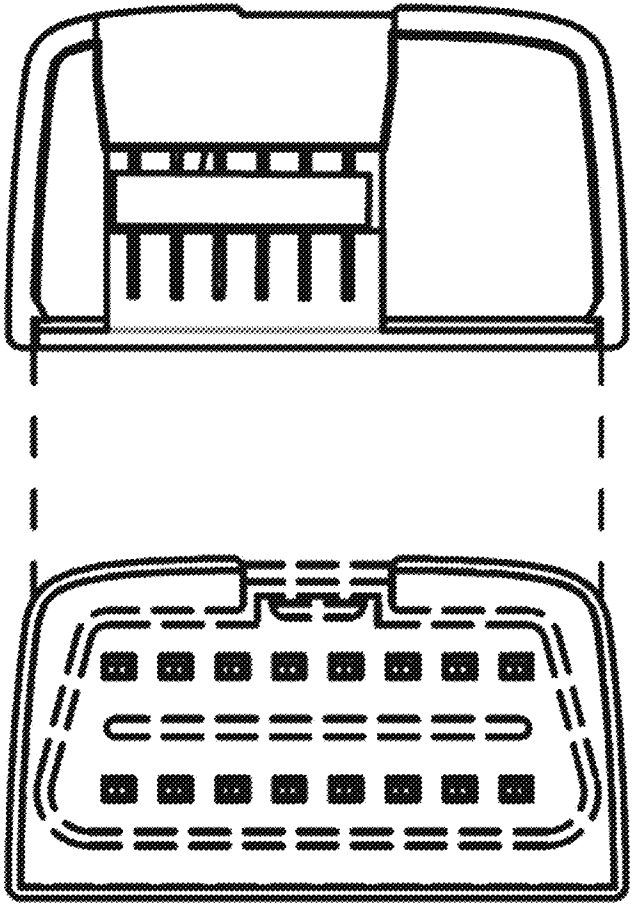
FIG. 20 is a front view of the base unit disengaged from the backpack unit.
Figure 21:
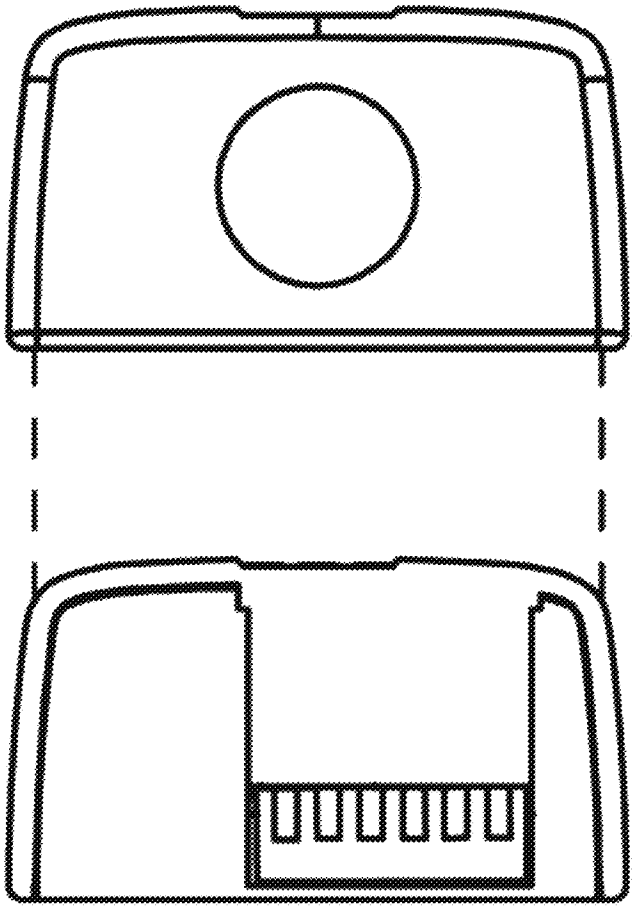
FIG. 21 is a rear view of the base unit disengaged from the backpack unit.
Figure 22:
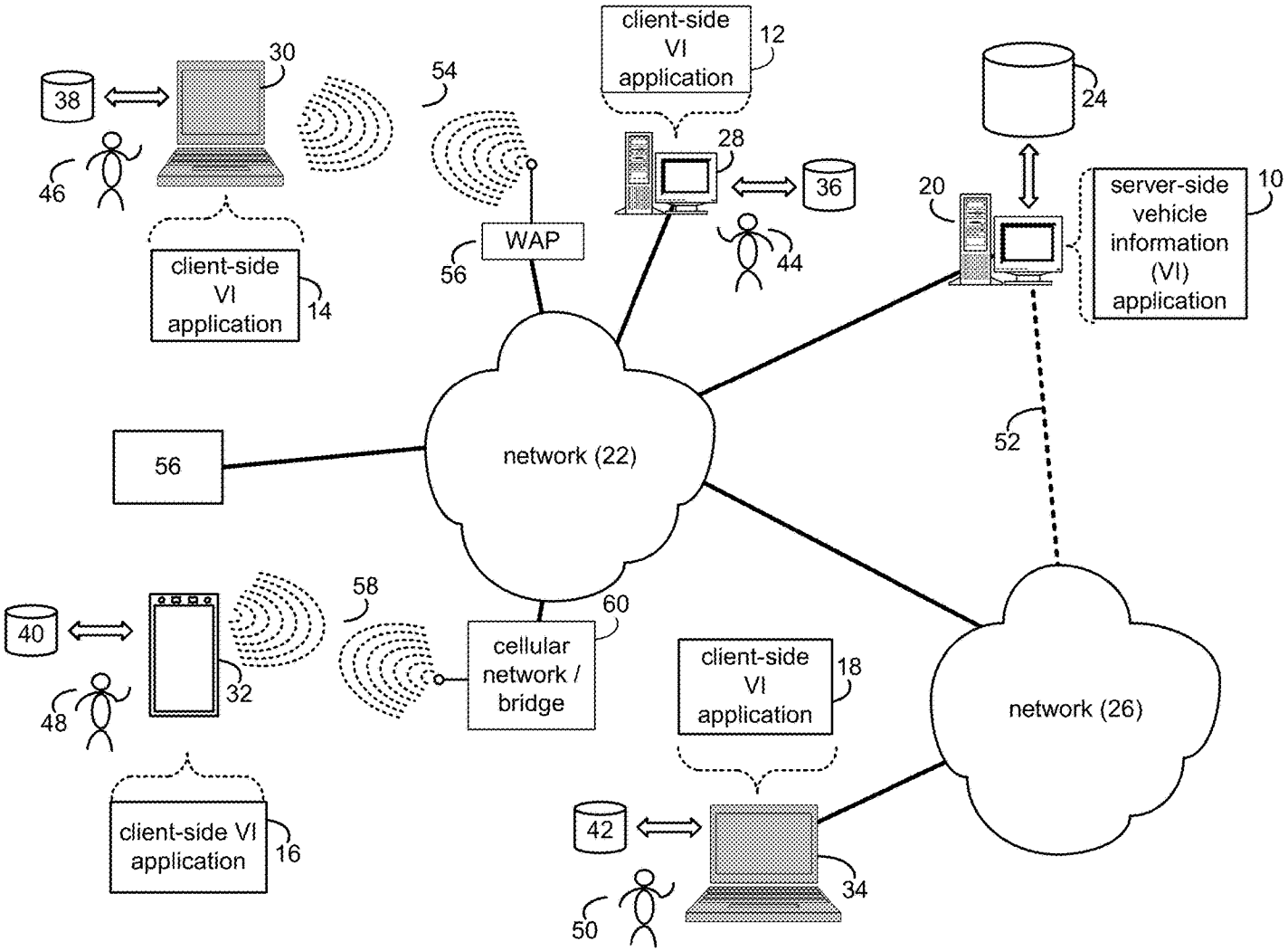
FIG. 22 is an overview of a system that can execute one or more a vehicle information processes in accordance with the present disclosure.
Figure 23:
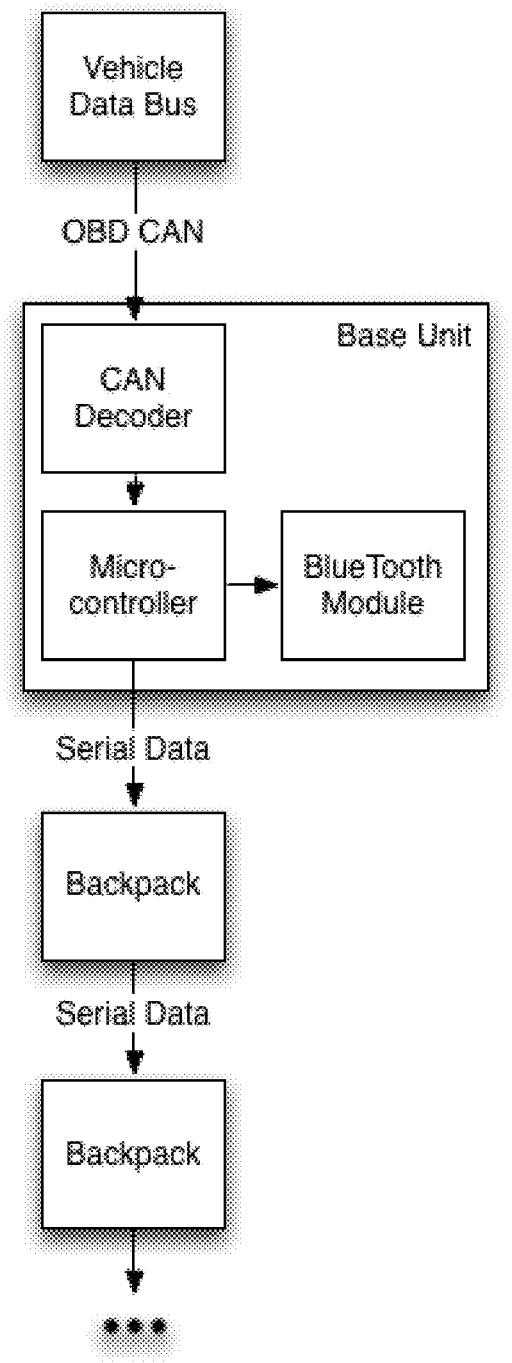
FIG. 23 depicts an example base unit and backpack configuration in accordance with the present disclosure.

The base unit may be responsible for interpreting the data from the vehicle and providing a data stream to one or more attached or communicatively coupled backpacks. Additionally, the base unit may supply the same stream of data to wireless devices via a Bluetooth module. Each backpack may be able to pass the serial data from the base unit to subsequent backpacks. FIG. 23 depicts an example base unit and backpack configuration.

Figure 24:
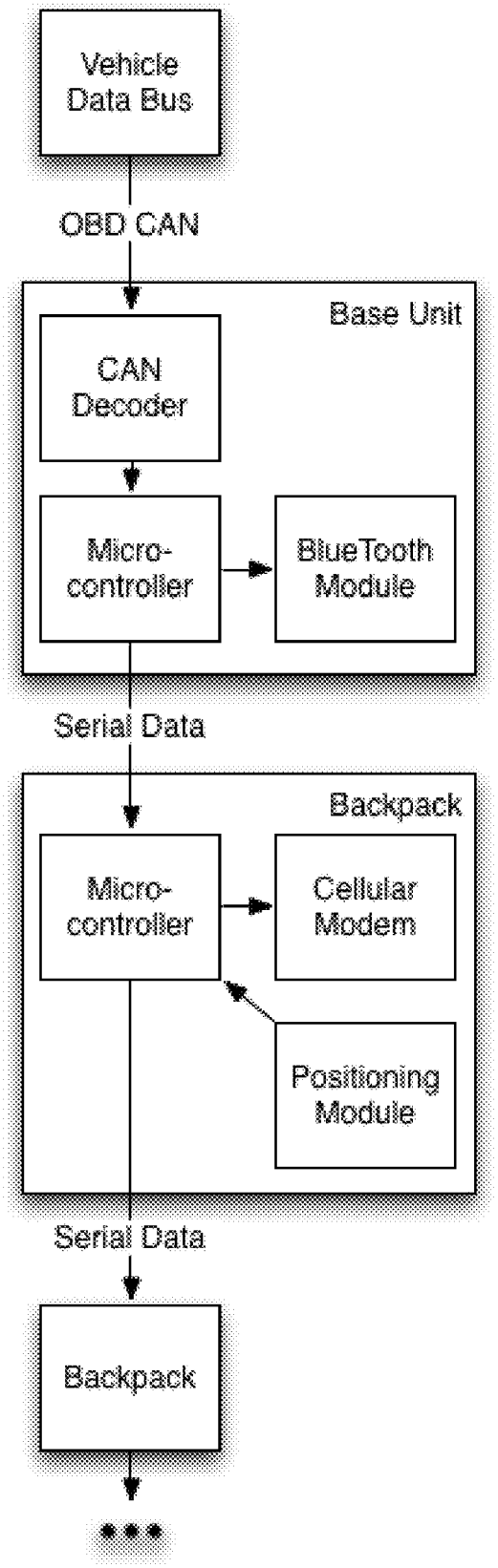
FIG. 24 also depicts an example base unit and backpack configuration in accordance with the present disclosure.
Figure 25:
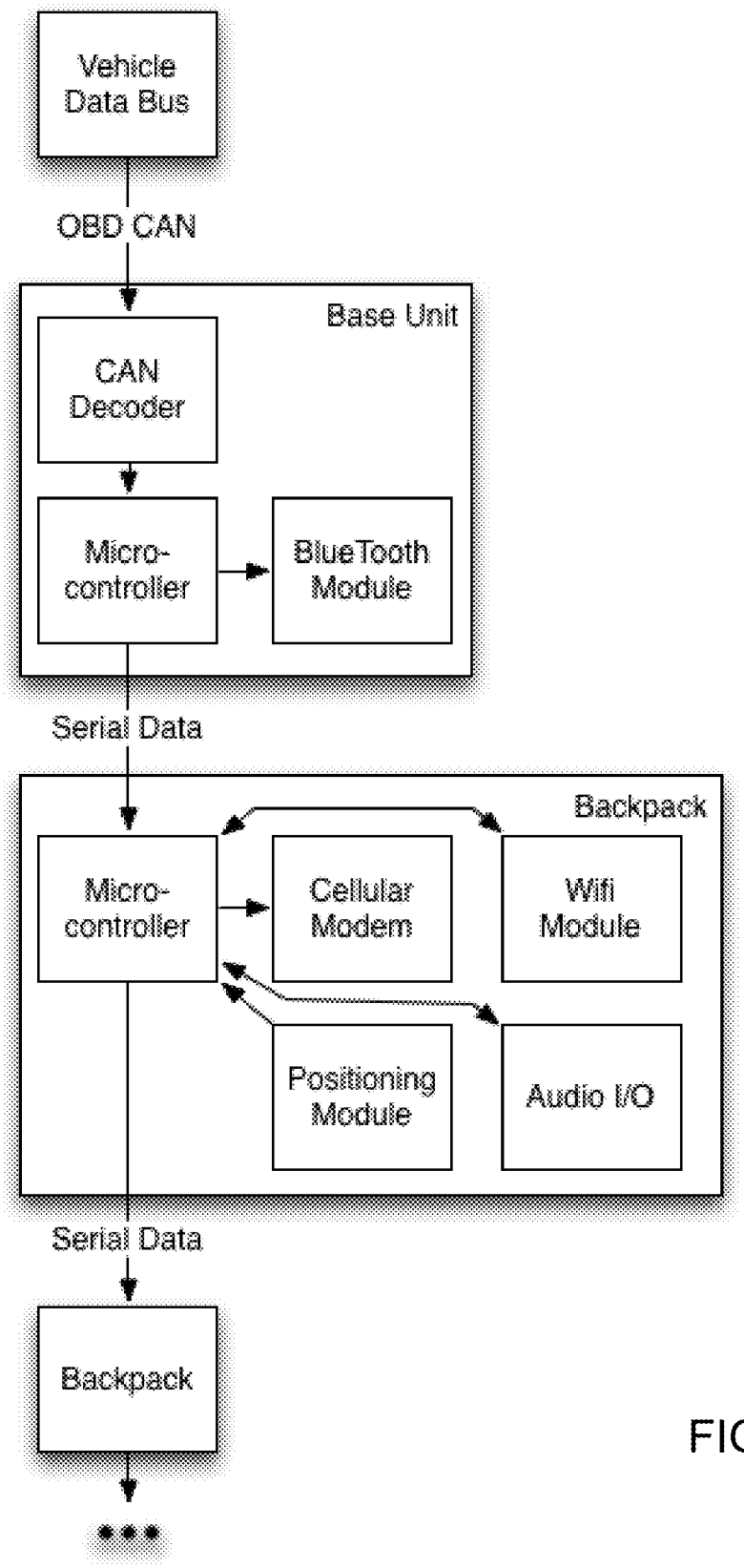
FIG. 25 also depicts an example base unit and backpack configuration in accordance with the present disclosure.

Each backpack may combine different sensor data with the data stream from the base unit and/or provide a separate transmission modality to stream or report data to other receivers. FIG. 24 depicts an example base unit and backpack configuration. FIG. 25 also depicts an example base unit and backpack configuration.

Some of the devices described here (e.g., the base unit and backpack) may be sold as a complete or combined system and may include LTE, GPS, and/or Wi-Fi hotspot capabilities, such as OBD interface device 100. Advanced accident detection capabilities may also be included.

Platform Description

Referring to FIG. 41, server-side vehicle information process 10 may reside on and may be executed by server computer 20, which may run the vehicle information platform and which may be in communication with network 22 (e.g., the Internet or a local area network). Examples of server computer 20 may include, but are not limited to: a personal computer, a server computer, a series of server computers, a mini computer, and/or a mainframe computer. The server computer 20 may be a distributed system and the operations of server computer 20 may execute on one or more processors, simultaneously and/or serially. For example, server computer 20 may be a symbolic representation of a cloud computing site, cloud environment, or cloud platform running multiple servers, computers, or virtual machines (e.g., a virtual machine host computer). Server computer 20 may execute one or more operating systems, examples of which may include but are not limited to: Microsoft Windows Server™; Novell Netware™; Redhat Linux™, Unix, or a custom operating system, for example.

The instruction sets and subroutines of server-side vehicle information process 10, which may be stored on storage device 24 coupled to server computer 20, may be executed by one or more processors (not shown) and one or more memory architectures (not shown) incorporated into server computer 20. Storage device 24 may include but is not limited to: a hard disk drive; a tape drive; an optical drive; a solid state storage device; a RAID array; a random access memory (RAM); and a read-only memory (ROM).

Server computer 20 may execute a web server application that allows for access to server computer 20 (via network 22) using one or more protocols, examples of which may include but are not limited to HTTP (i.e., HyperText Transfer Protocol). Network 22 may be in communication with one or more secondary networks (e.g., network 26), examples of which may include but are not limited to: a local area network; a wide area network; or an intranet, for example.

Client-side vehicle information processes 12, 14, 16, 18 may reside on and may be executed by client electronic devices 28, 30, 32, and/or 34 (respectively), examples of which may include but are not limited to personal computer 28, a television with one or more processors embedded therein or coupled thereto (not shown), laptop computer 30, data-enabled mobile telephone 32, notebook computer 34, a tablet (not shown), and a personal digital assistant (not shown), for example. Client electronic devices 28, 30, 32, and/or 34 may each be in communication with network 22 and/or network 26 and may each execute an operating system, examples of which may include but are not limited to Apple iOS™, Microsoft Windows™, Android™, Redhat Linux™, or a custom operating system.

The instruction sets and subroutines of client-side vehicle information processes 12, 14, 16, 18, which may be stored on storage devices 36, 38, 40, 42 (respectively) coupled to client electronic devices 28, 30, 32, 34 (respectively), may be executed by one or more processors (not shown) and one or more memory architectures (not shown) incorporated into client electronic devices 28, 30, 32, 34 (respectively). Storage devices 36, 38, 40, 42 may include but are not limited to: hard disk drives; tape drives; optical drives; solid state storage devices; RAID arrays; random access memories (RAM); read-only memories (ROM); compact flash (CF) storage devices; secure digital (SD) storage devices; and memory stick storage devices.

Client-side vehicle information processes 12, 14, 16, 18 and/or server-side vehicle information process 10 may be processes that run within (i.e., are part of) a cloud computing site, cloud computing application, cloud platform, or cloud environment. Alternatively, client-side vehicle information processes 12, 14, 16, 18 and/or server-side vehicle information process 10 may be stand-alone applications that work in conjunction with the cloud computing site, cloud computing application, cloud platform, or cloud environment. One or more of client-side vehicle information processes 12, 14, 16, 18 and server-side vehicle information process 10 may interface with each other (via network 22 and/or network 26).

Users 44, 46, 48, 50 may access server-side vehicle information process 10 directly through the device on which the client-side vehicle information process (e.g., client-side vehicle information processes 12, 14, 16, 18) is executed, namely client electronic devices 28, 30, 32, 34, for example. Users 44, 46, 48, 50 may access server-side vehicle information process 10 directly through network 22 and/or through secondary network 26. Further, server computer 20 (i.e., the computer that executes server-side vehicle information process 10) may be in communication with network 22 through secondary network 26, as illustrated with phantom link line 52.

The various client electronic devices may be directly or indirectly coupled to network 22 (or network 26). For example, personal computer 28 is shown directly coupled to network 22 via a hardwired network connection. Further, notebook computer 34 is shown directly coupled to network 26 via a hardwired network connection. Laptop computer 30 is shown wirelessly coupled to network 22 via wireless communication channel 54 established between laptop computer 30 and wireless access point (i.e., WAP) 56, which is shown directly coupled to network 22. WAP 56 may be, for example, an IEEE 802.11a, 802.11b, 802.11g, 802.11n, Wi-Fi, and/or Bluetooth device that is capable of establishing a wireless communication channel 54 between laptop computer 30 and WAP 56. Data-enabled mobile telephone 32 is shown wirelessly coupled to network 22 via wireless communication channel 58 established between data-enabled mobile telephone 32 and cellular network/bridge 60, which is shown directly coupled to network 22.

All of the IEEE 802.11x specifications may use Ethernet protocol and carrier sense multiple access with collision avoidance (i.e., CSMA/CA) for path sharing. The various 802.11x specifications may use phase-shift keying (i.e., PSK) modulation or complementary code keying (i.e., CCK) modulation, for example. Bluetooth is a telecommunications industry specification that allows e.g., mobile phones, computers, and personal digital assistants to be interconnected using a short-range wireless connection.

For the following discussion, server-side vehicle information process 10 will be described for illustrative purposes and server computer 20 may run server-side vehicle information application 10 to carry out some or all of the techniques and features described here. It should be noted that server-side vehicle information process 10 may interact with client-side vehicle information process 12 and may be executed within one or more applications that allow for communication with client-side vehicle information process 12. However, this is not intended to be a limitation of this disclosure, as other configurations are possible (e.g., stand-alone, client-side vehicle information processes and/or stand-alone server-side vehicle information processes). For example, some implementations may include one or more of client-side vehicle information processes 12, 14, 16, and 18 in place of or in addition to server-side vehicle information process 10.

Figure 44:
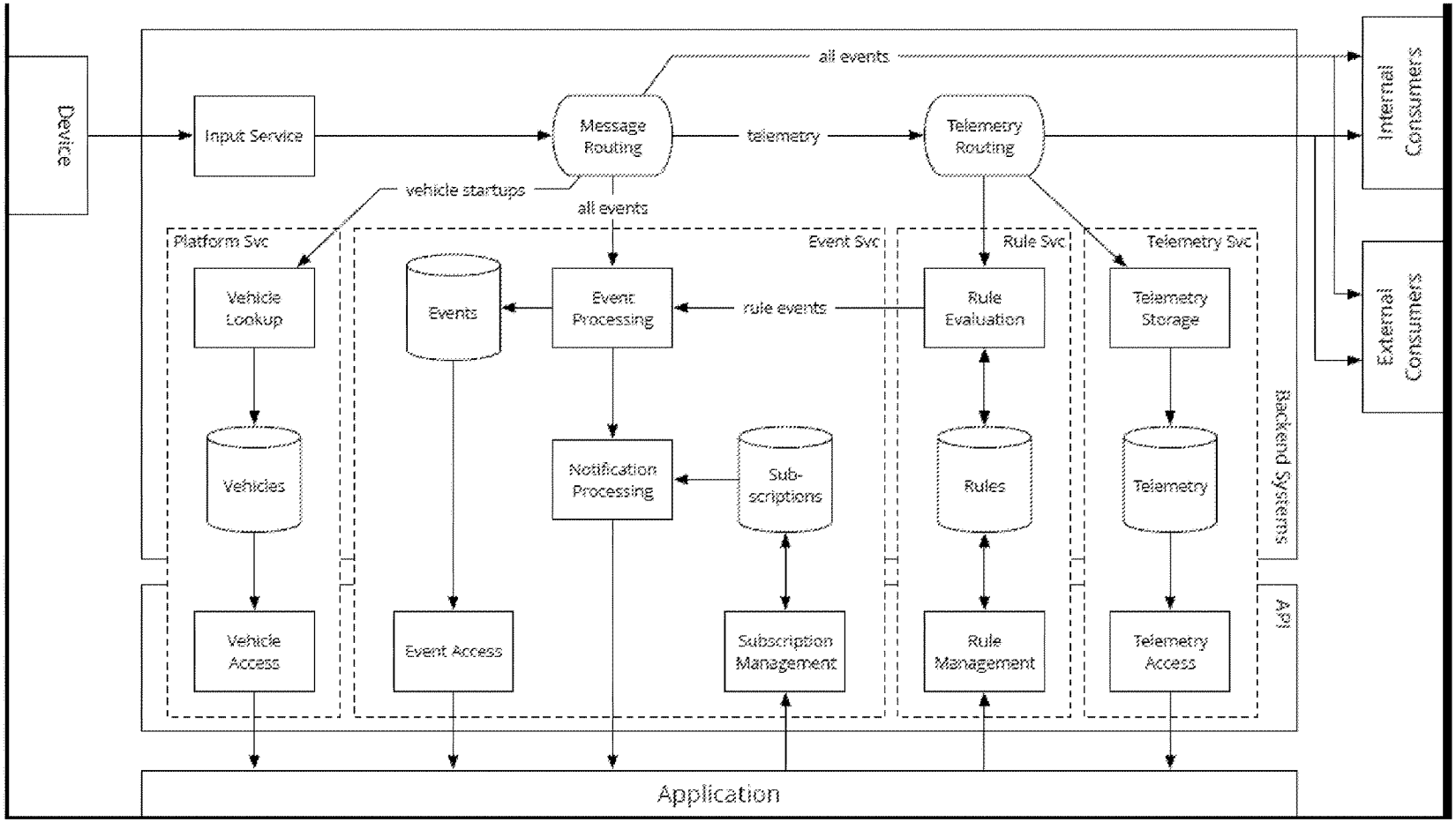
FIG. 44 is a data flow chart in accordance with an embodiment of a vehicle information platform of the present disclosure.
Figure 45:
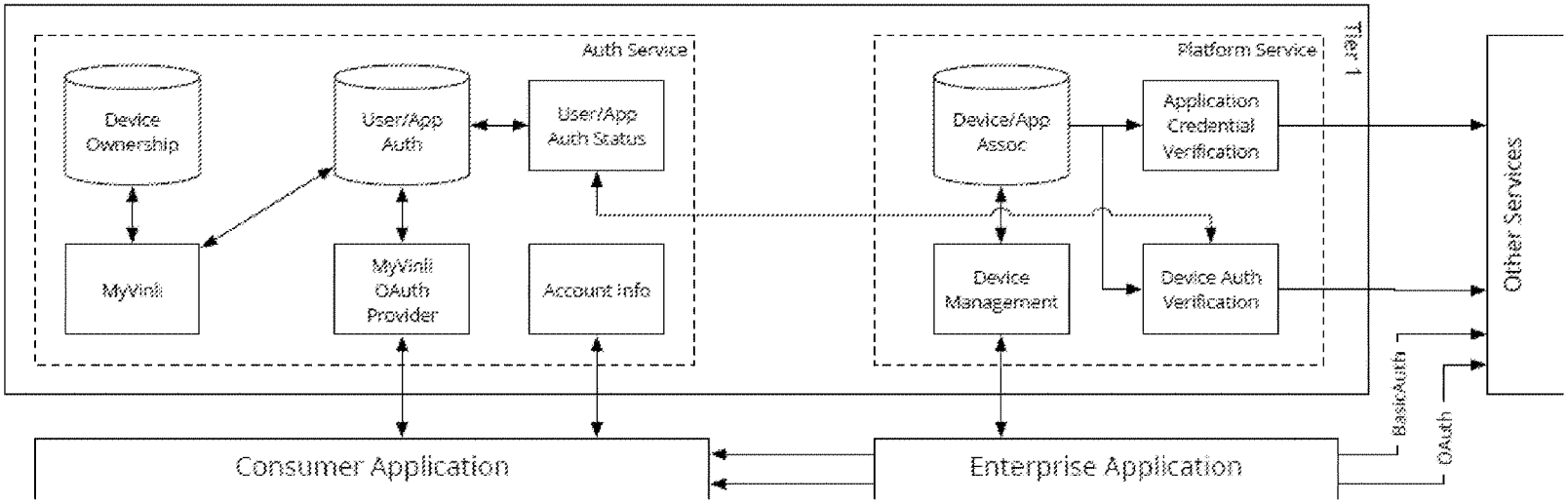
FIG. 45 is also a data flow chart in accordance with an embodiment of a vehicle information platform of the present disclosure.
Figure 46:
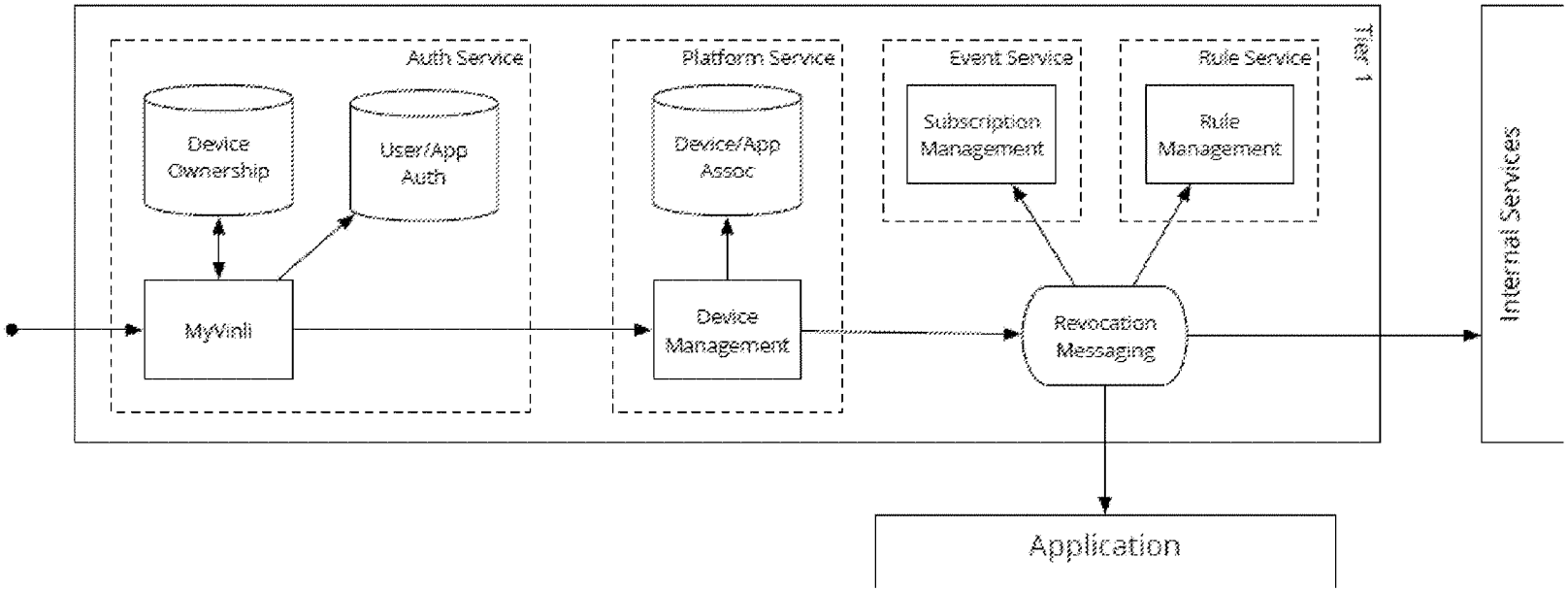
FIG. 46 is also a data flow chart in accordance with an embodiment of a vehicle information platform of the present disclosure.

Referring now also to FIGS. 44-46, there are shown example vehicle information platform data flows in accordance with the present disclosure. As shown in FIG. 44, the vehicle information platform may include one or more modules configured to perform the processes, applications, methods, and/ore services and related techniques and features described herein. Various APIs may allow one or more applications to interact with the vehicle information platform to provide services in connection with the OBD interface device in accordance with the data flows shown in FIG. 44. For example the platform service module ("Platform Svc") may provide Tier 1 services as described below. Further the event service module ("Event Svc") may provide event services as described below. Additionally the rule service and telemetry service modules may provide rule services and telemetry services, respectively, as described below.

Figure 47:
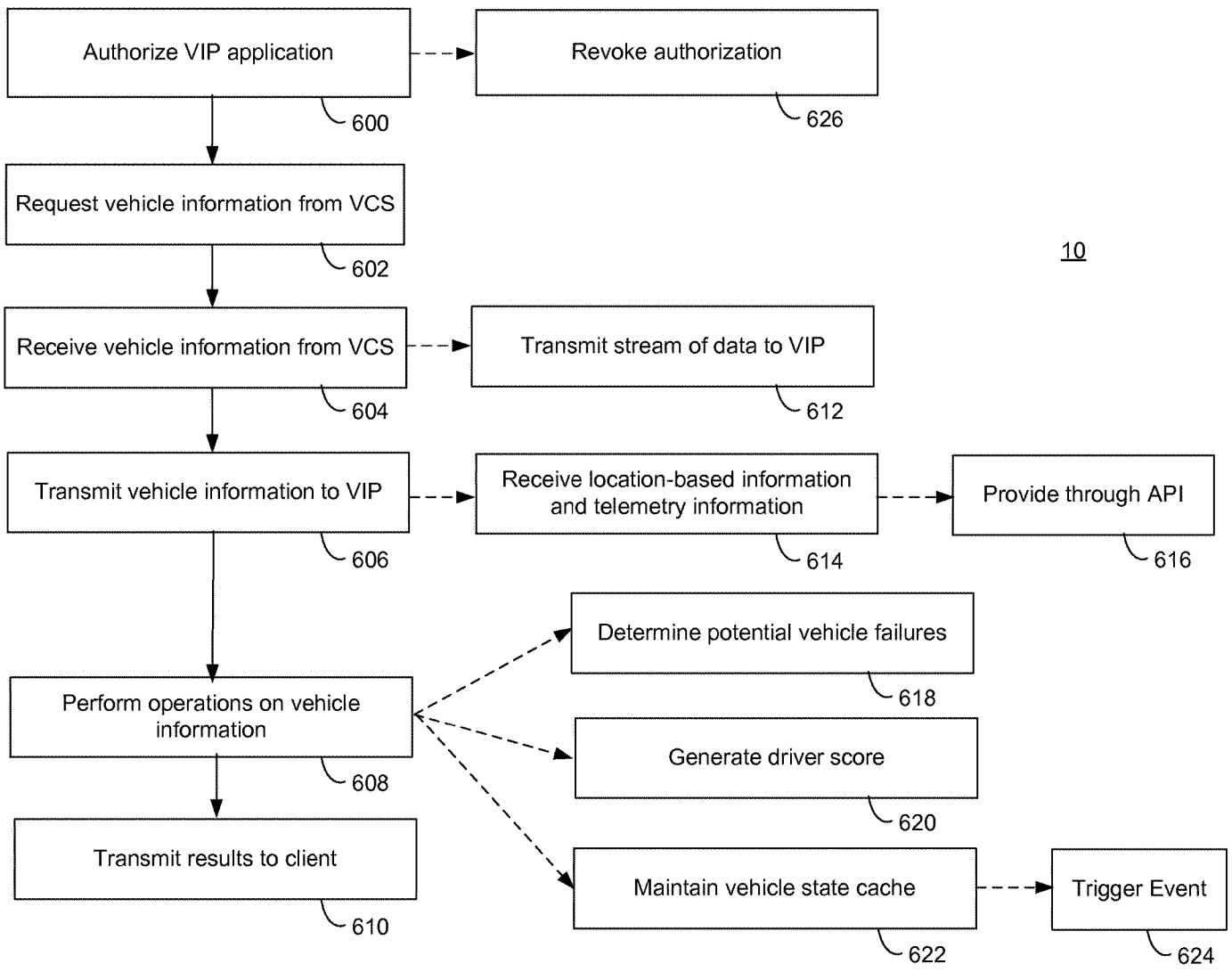
FIG. 47 is a process flow chart in accordance with an embodiment of a vehicle information platform (VIP) of the present disclosure.

As shown in FIG. 45, and as discussed below, the vehicle information platform may perform authorization services in connection with an OBD interface device and one or more applications. Referring now also to FIG. 47, an example vehicle information (VI) process 10 is shown. VI process 10 may authorize 600 a VIP application to access the OBD information device or information therefrom. For example, a user may purchase an OBD interface device and may sign up for a service account provided by the vehicle information platform (e.g., "MyVinli") at a website. The user may add the OBD interface device to his or her account by entering, for example, a "Case ID" printed on the OBD interface device.

The user may then authorize one or more applications to work with the OBD interface device via, in part, and for example, an Authorization Service module of the vehicle information platform (Auth Service as shown in FIG. 45). In an implementation, the user may visit the application's website and step through an OAuth flow, signing in with his or her vehicle information platform account. The user may grant access to the application for all of his or her OBD interface device. In response, the application may be given a token that can be used to retrieve account information, including an OBD interface device list. The application may now add one or more devices to its device list in the Platform Service.

VI process 10 may add the OBD interface device to a list of available devices for the vehicle information platform application. For example, the application may add the OBD interface device to its list of devices on the Platform Service. VI process 10 may verify permission for the vehicle information platform application to access the OBD interface device. The Platform Service may ensure with the "Auth Service" module that the user has granted access to the application. The application may call various vehicle information platform services with its APP_ID and SECRET_KEY (which may be set up in the Developer Portal). Each service may check the application credentials and check that the application has access to the OBD interface device involved. These operations may be referred to as the "BasicAuth" dataflow, as shown in FIG. 45.

The application may then get an OAuth token from the "Auth Service" module and call vehicle information platform services (as described below) with this OAuth token. Each vehicle information platform service may check with the Platform Service module to ensure that the OAuth token is valid (which in turn checks with the Auth Service module) and then check that the OBD interface device involved matches the token and is associated with the application. These operations may be referred to as the 'OAuth" dataflow, as shown in FIG. 45. In this way, VI process 10 may validate a token associated with the OBD interface device with the vehicle information platform.

Figure 32:
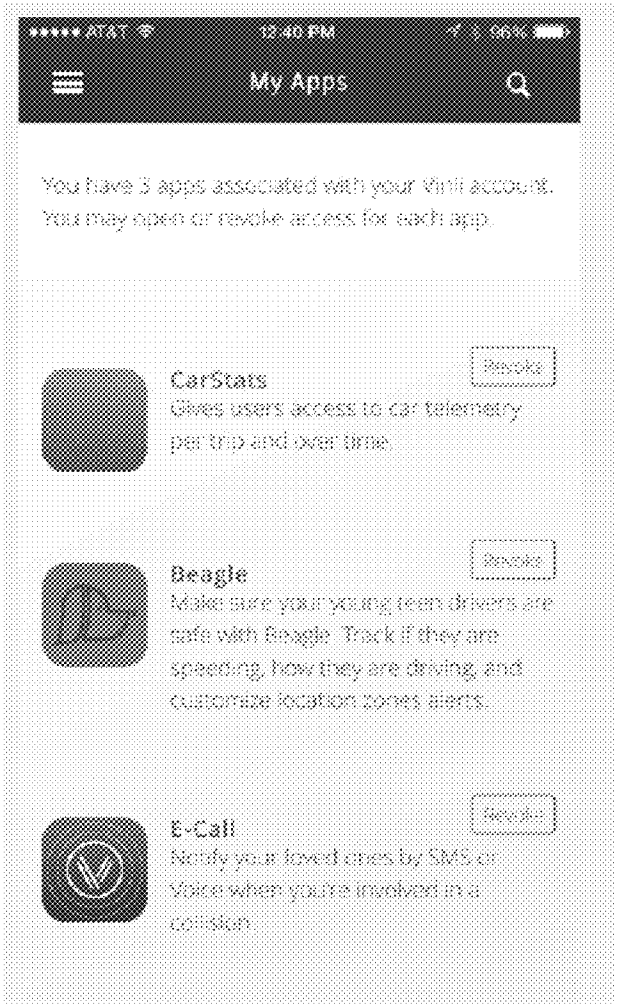
FIG. 32 depicts an example vehicle information platform application authorization/revocation GUI in accordance with the present disclosure.

Referring now to FIGS. 46 and 47, the vehicle information platform may revoke an authorization. VI process 10 may revoke authorization 626 for a vehicle information platform application to access the OBD interface device. When a user revokes access from an application, the following events occur. The user may confirm revocation on the vehicle information platform (e.g., via a website). VI process 10 may receive an indication to revoke authorization. The Auth Service module may notify the Platform Service module. The OBD interface device may be removed from the vehicle information platform application and the Platform Service module may initiate system-wide revocation of the authorization. Systems that have App/Device-specific persistence may be notified. Further, if a revocation notification is registered with the Platform Service module, it may be called. Referring now also to FIG. 32 an example vehicle information platform application authorization/revocation GUI in accordance with the present disclosure is shown. As shown, the vehicle information platform may allow a user to revoke authorization to one or more applications.

Referring now also to FIG. 47, an example vehicle information (VI) process 10 is shown. In an embodiment, VI process 10 may request 602 vehicle information from a vehicle computer system (VCS). The request may be made via an OBD interface device. The VCS may be designed and implemented by the vehicle manufacture to output data to an OBD port on the vehicle. VI process 10 may further receive 604 the vehicle information from the VCS, via the OBD interface device. The vehicle information may be any information described herein received at the OBD port or transmitted by the OBD interface device related to the corresponding vehicle (e.g., speed, location, fuel level, diagnostics, etc.)

Further, VI process 10 may transmit 606 the vehicle information to a vehicle information platform (VIP). In an embodiment, VI process 10 may transmit 612 a curated stream of data from the OBD interface device to the VIP. The curated stream of data may include a collected set of parameters from the vehicle computer system based on at least one of an initial priority and a priority generated by a VIP application. Further, the curated stream of data may be adaptable based on a vehicle model. The set of parameters collected by the OBD interface device from the vehicle computer system may be configurable based on parameters supported by the vehicle model. Further, the vehicle information platform may include a Web API (application programming interface) which may provide access over HTTP/SSL to the data (i.e., vehicle information) collected from the OBD interface device. This set of tools provides two tiers of services for applications to consume.

Tier 1 services may provide access and functionality around the "raw" data gathered from customers' devices (e.g., client electronic devices). These may include: a Platform Service, which provides the administrative actions for an application such as managing devices, getting vehicle information, and monitoring transactions; a Telemetry Service, which provides access to time-series data for all vehicle telemetry gathered on a device-by-device basis; an Event Service, which provides access to vehicle events as well as the ability to create subscriptions to these events; and a Rule Service, which provides tools to create rules based on vehicle parameter limits or geofences. In this way, VI process 10 may receive 614 location-based information from the OBD interface device. VI process 10 may also provide 616 the location-based information and telemetry information (or other vehicle information) via an application programming interface (API) for use in a vehicle information platform application. As discussed below, the VIP or a VIP application may perform 608 one or more operations on the vehicle information at the VIP.

Figure 30:
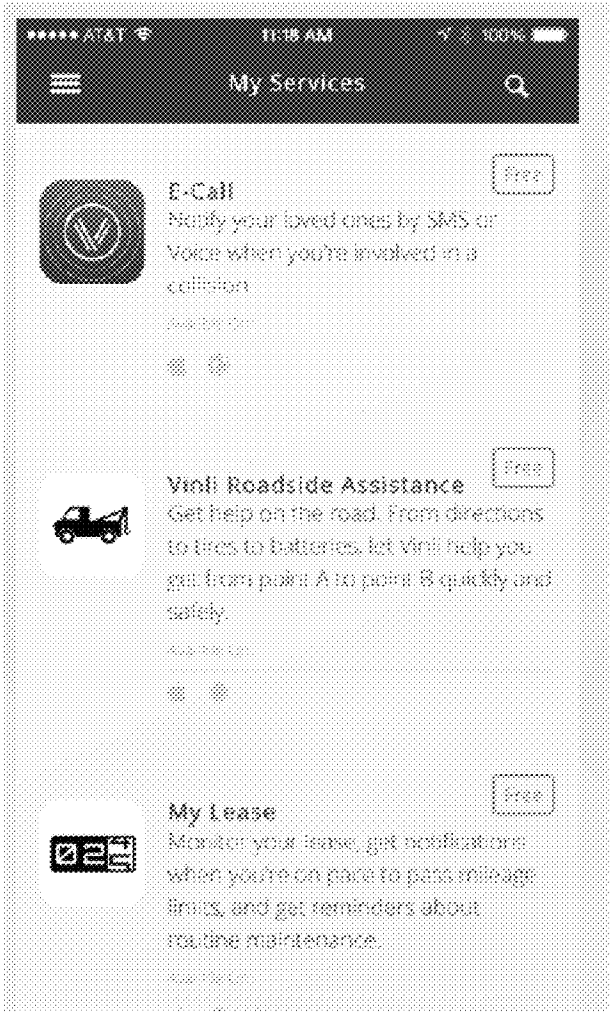
FIG. 30 depicts an example vehicle information platform services graphical user interface (GUI) in accordance with the present disclosure.
Figure 31:
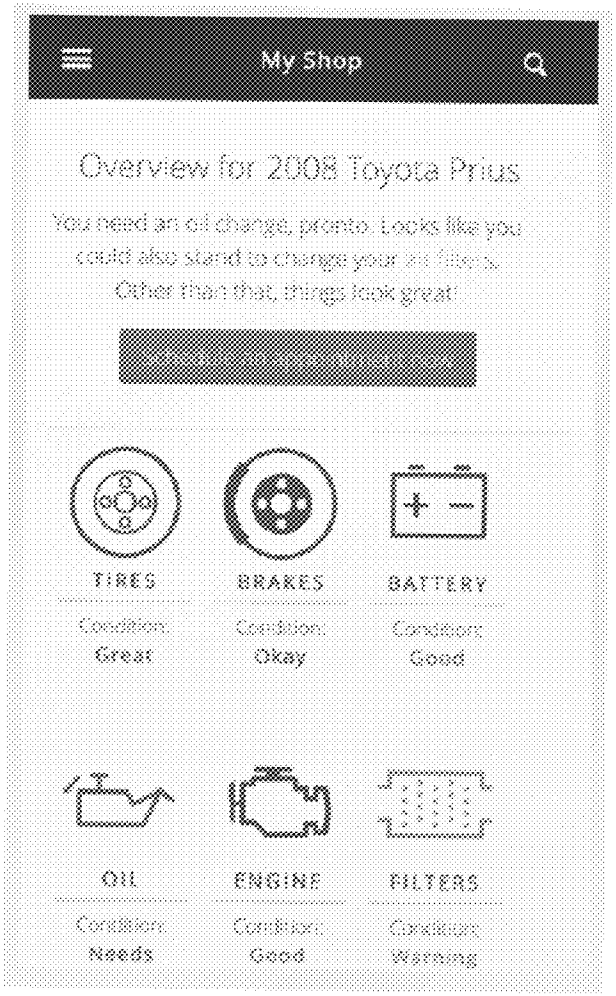
FIG. 31 also depicts an example vehicle information platform services GUI in accordance with the present disclosure.

Tier 2 services may provide a bit more analysis and "expertise" on top of the data provided by Tier 1. These services may include: a Trip Service, which may automatically detects "trips" for a given OBD interface device or vehicle and gives telemetry and other information on a trip-by-trip basis; a Diagnostic Service, which provides access to detailed diagnostic information about a device (DTC Codes aka "Check Engine Light") including historical diagnostics; a Behavioral Service, which provides "report cards" for given devices or vehicles based on the driver's behavior and other factors; and a Safety Service, which provides access to collision history and collected safety information. On or more of these vehicle information platform API "Services" may be described below. Referring now to FIGS. 30 and 31, example vehicle information platform services graphical user interfaces (GUIs) in accordance with the present disclosure are shown. As shown an discussed below, the vehicle information platform may provide emergency call, roadside assistance, lease, and diagnostic services.

In an embodiment, VIP process 10 may collect vehicle-model-specific data from a plurality of OBD interface devices across a plurality of cohorts. The cohorts may be, for example, geographic, age-based, temperature-based, environment-based, driver habit based, etc. For example, VI process 10 may analyze vehicle information or vehicle model specific data to determine 618 potential failures in the vehicle model for the plurality of cohorts.

Further, in an embodiment, VIP process 10 may generate 620 a driver score based on vehicle information received from a plurality of OBD interface devices, as discussed below in connection with driver report cards, for example. The vehicle information may be from a plurality of vehicles having the same model.

Further, in an implementation VI process 10 may define a set of boundaries for a space which a vehicle can occupy in accordance with a VIP application rule, as discussed in more detail below. VI process 10 may maintain 622 a vehicle state cache. The vehicle state cache may comprise a set of at least one of parameters and messages used to determine whether the vehicle is inside the set of boundaries. Additionally, VI process 10 may trigger 624 an event in response to determining that the vehicle moved outside the set of boundaries. VI process 10 may transmit 610 results (e.g., notifications of events, driver score, etc.) from the one or more operations on the vehicle information to a client electronic device (e.g., smartphone, tablet, etc.)

Calls to the vehicle information platform may be authenticated by an Application. Each Application may be assigned an App ID and an App Secret when it is created. Both of these may be required for an API call to be authenticated. API calls may occur over HTTP/SSL. Calls over HTTP may be rejected at the socket level. Each request may include the App ID and App Secret in the Authorization header of the request. This may takes the form of a standard BasicAuth header where the App ID is the username and the App Secret is the password. An Application with an App ID and App Secret may request a list of all of its devices using CURL with and CURL may set the Authorization header. HTTP libraries may handle BasicAuth given the username and password (i.e., App ID and App Secret). The secret may be reset from an App Management page of a Developer Portal.

Authentication for actions on behalf of users, such as adding a device to an application, may be handled using OAuth 2. To get started with an OAuth 2 workflow, developers may first create a client within their application for each platform they would like to support. This may be done via the Developer Portal. In general, there may be two types of OAuth 2 clients, those that expect response tokens and those that expect response codes.

Token clients are those clients that cannot be secured against leaking their secret, e.g. web clients and mobile apps. They are directly granted a token by the authentication service in exchange for their ID, redirect URI, and the user's approval. Code clients are those clients that can be secured against leaking their secret, e.g. server clients.

Code clients use a user-facing component to obtain a code from the authentication service in exchange for their ID, redirect URI, and the user's approval. The user-facing component then hands the code to the secure client. The secure client can then obtain an access token from the authentication service in exchange for its ID, secret, and the authentication code.

To initiate the authentication flow, the client directs the user to a URI. After user authentication and application approval, the user may be redirected to the provided redirect URI, which may match the redirect URI registered for the client. The requested access token, authentication code, or an error will be in the fragment (e.g., after the #) portion of the URI. Vehicle information platform SDKs (software development kits) may also provide authentication support to handle the details for clients and ease integration.

The vehicle information platform may provide pagination on list responses. This pagination varies slightly depending on the type of data being returned. Two main types of pagination are provided Resource List, which may be for use with lists of relatively static resources (i.e. devices, groups, etc.); and Stream, which may be for use with rapidly changing time-series data (i.e. vehicle telemetry, location, etc.). The Resource List Pagination may use offset and limit to page through a sorted lists of objects. By default this sorting is based on the creation time and is sorted in chronological order, but this sorting can be modified by using the sortBy and sortDirection parameters.

The API will return, as part of the meta property's pagination field in the response, the following properties: count, which may be the total number of items available regardless of pagination; limit, which may be the limit used for the list returned (this will be the limit requested by the client unless one was not passed, in which case the default for this method will be returned, or unless the limit requested by the client was larger than the max allowed for the method, in which case the maximum allowable limit will be returned); offset, which may be the offset used for the list returned (this will be the offset requested by the client unless one was not passed in the call, in which case 0 will be returned); and links, which may be an object containing URLs for traversing the pages of the list * first—URL for the first page * last—URL for the last page * next—URL for the next page (if the current page is the last page, this field will not be returned.) * prev—URL for the previous page (If the current page is the first page, this field will not be returned.)

Pagination may be done within the context of any other URL parameters passed. For instance, if a client requests transactions since Jan. 1, 2014 until Feb. 1, 2014 in chronological order, passing an offset of 0 will return the transactions starting on January 1st. Incrementing the offsetvalue will page through only the results that fall within the original constraints (i.e. the last page will contain the last transaction prior to February 1st). The totalCount returned will be the total available resources that match the constraints (in this case, since and until). As with all other requests, attempting to increase the offset beyond totalCount will result in an empty response.

Stream Pagination may use the since and until parameters to traverse a constantly growing list of items. The most important use of this type of pagination is when dealing with historical data from Telemetry Services. In this situation, data are constantly being added to the front of the list as vehicles report additional telemetry information. In order to keep consistent paging, time constraints are placed on the data returned. In this way a single URL will continue to return the same set of data, even as more data are added to the front of the list.

Other commands and/or parameters may include: remaining—the number of items previous to the last item in the returned results and after the since parameters; limit—the limit used for the list returned (this will be the limit requested by the client unless one was not passed, in which case the default for this method will be returned, or unless the limit requested by the client was larger than the max allowed for the method, in which case the maximum allowable limit will be returned); and links—an object containing URLs for traversing the pages of the list * prior—URL for the next (older) page (If the current page is the oldest page, this field will not be returned.)

The vehicle information platform API interaction may include date and time formatting. As part of URLs, dates can be submitted in two ways: ISO8601 formatted or Unix Time. Both are accepted by the platform APIs and will be converted equally. In general, Unix Time may be completely unambiguous, is smaller in footprint (for URLs and storage), does not need to be URL encoded, and is available easily in all major languages, however, ISO 8601 may be much easier to read and debug. The vehicle information platform may handle the dates without issue. The vehicle information platform APIs will return dates as ISO 8601 formatted strings. This makes working with the API with debugging tools much easier as the dates will already be easily human-readable. All major date libraries are able to parse ISO 8601 natively. Pagination metadata that uses the "Stream Pagination" will generally return URLs with Unit Time query parameters. This avoids any issue with URL encoding and provides for slightly smaller URLs.

The root element in interaction with the vehicle information platform may be the OBD interface device. Each OBD interface device has an associated OBD interface device ID by which it is referred to within the platform. However, before an application can access any data or perform any actions on a OBD interface device, it must be authorized by the owner of the device. Enterprise-level applications may require specific approval from the vehicle information platform and may be able to manage a specific block of devices that are "owned" by the application.

The platform may include a "List all Devices" service which may return a paginated list of devices that are registered with an application sorted chronologically by when OBD interface device was added. This service may have request and response instructions and formatting. The platform may also include "Get a Device," "Register a Device," and "Deregister a Device" services for OBD interface devices. One or more of the following services or methods may be provided through the API.

The "Register a Device" and "Deregister a Device" services may only be accessible by Enterprise applications. Consumer applications may gain and lose devices as users authorize access via the OAuth flow in the vehicle information platform. An application may register a device after it has been authorized by the owner of the device, as discussed above. This step may be necessary before an application can access any data from the device or perform any actions on the device. A two-step process may allow for managing device authorization independent of user action. A device may be removed without requiring a user to revoke access to the device.

Deregistering a Device from an application prevents the application from accessing that device's data. This may have several various effects on other sections of the vehicle information platform. For instance, Event Services may remove any Rules associated with the device, Safety Services may remove any Emergency Contact actions from the Device (if the application registered the Device with Safety Services), and Diagnostic Services may remove any DTC alerts for the Device registered by the Application. Deregistering a Device may be an Application-level action that will have no effect on any other Application that has been authorized for the Device.

The vehicle information platform may also include "Vehicle" Services. The vehicle information platform may keep track of which vehicle an OBD interface device is or has been plugged into and provides detailed information regarding the specifics about the vehicle. This may allow applications to better personalize the experience of a user as well as the information necessary to classify users and their data by vehicle. Only vehicles which are associated with an OBD interface device to which the application has access may be viewed.

Vehicle-device association may be time-based. An OBD interface device plugged into one vehicle will be associated with that vehicle until it is plugged into a different vehicle. The vehicle information platform keeps track of this history for application use. In the case of a device that is shared between multiple vehicles, the same vehicle will appear multiple times in the history. When a vehicle is first added to the system (when an OBD interface device is plugged into a specific vehicle for the first time), only the VIN number may be available. At some point in time the vehicle information platform will update the vehicle information with Year, Make, Model, and Trim in addition to even more detailed information (available through the Vehicle's "self" link).

One or more of the following services may also be provided through, in part, the API. A "List All of a Device's Vehicles" service may returns the vehicles associated with the given OBD interface device in chronological order. A "List a Device's Latest Vehicle" service may return the vehicle most recently associated with the given device if it exists. If the device has not been associated with a vehicle, a null vehicle object is returned. Basic vehicle information may be returned as part of this response. Following the vehicle's "self" link may provide full detailed information about the vehicle. A "Get Information About a Vehicle" service may return detailed information about a vehicle. This information may include, but is not limited to: Year, Make, Model, Trim, Engine Information, Transmission Information, and Available Options. A "Get All Transactions for this Application" service may return a list of all transactions performed by a particular Application. The results may be returned in reverse-chronological order and may use the "Stream Pagination" method.

A collection of Telemetry Services provided through the API may provide the full history of vehicle telemetry transmitted by an OBD interface device. This history is made available in three different formats across three separate, but similar API methods: Messages—Time-series of the raw, unfiltered messages from a device; Locations—Time-series of locations with corresponding vehicle parameters returned as valid GeoJSON; and Snapshots—Time-series history of one or more vehicle parameters. Common across all three of these methods may be the way in which the time-series data is accessed. These follow the "Stream Pagination" pattern described above and allow for pagination in time.

The pattern in which each parameter is reported is different and somewhat unpredictable depending on the type of vehicle or the vehicle's condition. There are a few parameters that may be sent as often as possible (e.g., RPM, Vehicle Speed, etc.), and location may be sent with every message when available. There are also some parameters that may never change for a vehicle such as Fuel Type or O2 Sensor Locations. All parameters provided by a vehicle may be reported at least once every minute or so after startup.

A "Get a List of Telemetry Messages" service may return the latest limit number of telemetry messages that occurred before or at the until time and after the since time. If the until time is not specified, then the service will return snapshots until the current time when the call is made. These messages may be sent at least every five seconds and include the latest value of parameters captured by the vehicle information platform OBD interface device since the last message sent. The following results format may be followed. Until—Results will contain snapshots whose timestamps are less than or equal to the until value. If an until value is not specified, the current time when the call is made will be used as the untilvalue. Since—Results will contain snapshots whose timestamps are greater than the since value. If a since value is not specified, no lower limit will be placed on the returned snapshots. Limit—Results will contain no more than limit number of snapshots. The "Get a Specific Telemetry Message" service may return a particular message by messageId. This may be primarily used when a specific message is referenced by a different service.

A "Locations" service may return the latest limit number of points of the OBD interface device's location before or at the until time and after the since time. If the until time is not specified, then the service will return snapshots until the current time when the call is made. The location property contains a valid GeoJSON FeatureCollection object consisting of Point features for each location. The timestamp for each location is the in the properties field of the feature. Additionally, selected or all parameters that were recorded at each location can also be included in the properties field. When all is specified, this method acts just like the Device Messages method below, but it is formatted as valid GeoJSON.

The following request format may be followed for telemetry related services. Fields—may be all or a comma-separated list of parameter keys to be included in the properties field. Until—Results will contain snapshots whose timestamps are less than or equal to the until value. If an until value is not specified, the current time when the call is made will be used as the untilvalue. Since—Results will contain snapshots whose timestamps are greater than the since value. If a since value is not specified, no lower limit will be placed on the returned snapshots. Limit—Results will contain no more than limit number of snapshots.

A "Telemetry Snapshots" service may return the latest limit number of telemetry snapshots that contain at least one of the requested parameters that occurred before or at the until time and after the since time. If the until time is not specified, then the service will return snapshots until the current time when the call is made.

Event Services may allow an application to create and manage complex sets of Rules that are evaluated on particular devices or groups of devices. These Rules are constructed using the parameters provided by the vehicle information platform OBD interface device. As data is streamed from the OBD interface device to the vehicle information platform, each snapshot is evaluated by the Event Service to see if the new information causes the device to leave or enter the boundaries of a given rule. A Rule may represent a continuity of states that the vehicle is either inside of (covered) or outside of (not covered). The API routes provided by the Event Services may work in concert to provide both access to the historical events for a Device as well as web-hooks for an application to receive immediate notification when an event occurs. The normal life-cycle of working with Event Service may be: Create a Subscription for a particular event type for a device; the event occurs for that device; a corresponding event is created; Event Service looks for all Subscriptions for which this Event qualifies; A Notification is created that contains all the relevant information; The Notification is POSTed to the URL listed in the Subscription; and Links within the Notification allow the application to explore the related information directly.

There are several types of events that the platform may track on a device-by-device basis. These include: startup, shutdown, rule-enter, rule-leave, dtc-code-detect, dtc-code-clear, collision, trip-started, trip-orphaned, trip-stopped, and trip-completed.

Almost all events occur in the context of a higher-level object. For example, startup and shutdown events occur in relation to a given Vehicle, rule-enter and rule-leave events occur in relation to a given Rule. This information is available as part of the event object property. Additionally, subscriptions can specifically reference a given object. For example, a subscription to startup events can optionally reference a particular Vehicle; in this way, an application will only be notified of startups where the Device is attached to a particular Vehicle. Subscriptions for event types rule-enter, rule-leave, or rule-* must reference a single Rule. When creating the subscription, the Rule is checked to ensure that it belongs to this particular OBD interface device.

A "Get All Events for a Device" service may return the list of all events for a given Device in reverse-chronological order. Each Event includes information regarding the device, the object involved in the event, and associated metadata. The following fields may be included within an event response: id—ID of the event; timestamp—Timestamp when the event occurred; deviceId—ID of the device; eventType—Type of event; object—Information about the object of the event (i.e. the associated Rule or Vehicle); meta—Optional data depending on the type of event (For instance, for a rule-enter or rule-leave event, the meta property includes information about the Rule itself and the state and direction of the event); and links—object including links to associated data.

The following results format may be followed, which may be similar to those described above. Type—(optional) filter events for those of a given type. Until—Results will contain snapshots whose timestamps are less than or equal to the until value. If an until value is not specified, the current time when the call is made will be used as the untilvalue. Since—Results will contain snapshots whose timestamps are greater than the since value. If a since value is not specified, no lower limit will be placed on the returned snapshots. Limit—Results will contain no more than limit number of snapshots. A "Get a Specific Event" service may returns information about a specific event.

In order to receive notification for vehicle events, an application may subscribe to events for each OBD interface device individually. Each Subscription may relate to a given event or class of events from a given Device and specifies the external URL that will be called when the event occurs and any additional application that should be included. For a Notification Payload, when a subscription is triggered, an HTTP call using the "POST" method is made to the Subscription's URL. This call uses content-type of "application/json" and sends a JSON representation including a notification root object along with representations of the Event that triggered the notification and the associated Subscription.

The appData attribute of the subscription property includes the Application-specific data from which the Subscription was created, if applicable. For example, the Subscription triggered may be associated with a Rule. In this case, additional information is made available in the Notification including a representation of the Rule in the metaproperty. Additionally, a useful property firstEval is provided that lets an Application know whether or not this is the first evaluation of the Rule. The first evaluation of a Rule in which it can be established that the OBD interface device is covered or not covered by the boundaries will result in a notification. Using the firstEval property, an App can determine if the device was previously in a different state or was just in an unknown state.

To Create a Subscription (e.g., via a service or method of the API), a subscription must include, at a minimum an eventType and a url. Additionally, if the subscription references a given Rule, it must be included in the object. When creating a Subscription to a Rule's events, identification of the Rule may be required. An application can only subscribe to Rule events for Rules to which it has access. A special eventType (rule-*) can be used to subscribe to both rule-enter and rule-leave events. AppData may be given so that this is passed on to the App whenever the subscription is triggered.

The vehicle information platform may provide a "Get all Subscriptions for a Device" service, "Get a Specific Subscription" service, and "Delete a Subscription service. Subscriptions may be primarily immutable. The url and appData properties may be updated, however, the "functional" parts of the Subscription (e.g., eventType, object, etc.) may not be modifiable.

Each time a subscription is triggered by an event, a new Notification is created that represents the event, subscription, and subsequent actions taken by the vehicle information platform to notify the application. A Notification state maybe useful in debugging notification handlers on an application. This state, responseCode, and response properties will inform as to the result of Event Services' attempt to call the notification URL. A notification will be linked to one subscription and may include additional metadata depending on the trigger of the subscription and in the case of subscriptions to Rules, this metadata may be represented in Fields included in a notification response, which may include: id—ID of the notification; eventId—ID of the event that triggered the notification; eventType—Type of the associated event; eventTimestamp—Time that the associated event occurred; subscriptionId—ID of the subscription that this notification is associated with; url—URL that was called by Event Service (this is copied from the subscription at the creation of the notification); payload—String of the payload exactly as it was posted to the above URL; state—Current state of the notification (state values may include created, queued, complete, or error).

The state of a notification starts as created and moves to queued as soon as it is placed in the notification queue to be processed. Once the notification has been posted to the callback URL, the state will be moved to complete if the HTTP transaction was completed and a response code in the 200 s was received. If the HTTP call is not able to be completed or a response code other than the 200 s, the state will become error. If the notification is in the complete or error state, the fields following will be available in the response: responseCode—HTTP code received from the URL above; response—String of the response from the URL above; notifiedAt—Time that the HTTP call was initiated; and respondedAt—Time that the HTTP call was completed (if successful).

A "Get a Specific Notification" service, a "Get Notifications for a Subscription" service, and a "Get Notifications for an Event" service may be provided through the vehicle information platform API. For example, the "Get Notifications for an Event" service may return the notifications that were triggered for any subscription associated with a given event.

In addition to transmitting real-time vehicle telemetry information, the OBD interface device may interrogate the vehicle for the status of, for example, a malfunction indicator lamp (MIL) or "Check Engine Light". If the device detects that the MIL is illuminated, it requests the active diagnostic trouble codes (DTCs) for the vehicle. All of this information is sent to the vehicle information platform and can be accessed via the Diagnostic Service API.

A "Device DTC" service may the list of all DTC Codes for a given OBD interface device. A "DTC History" service may provides historical information for DTC codes for a given vehicle. Each time a new DTC code is seen, it triggers a DTC Event. These events either resolve when the DTC code is no longer seen or remain "open" until the code is resolved. A state query param may be used to filter the response. Valid values are active and inactive. These will filter the response to only include either DTC codes that are still on presently or not. The absence of the state query param will not filter the response and so the response will contain the full history DTC codes.

A "DTC Info" service may get information about a DTC code. There may be a lot of information encoded in the DTC codes reported by a vehicle. This method is meant to provide this information for a given DTC code so that an application can present useful information to the end-user.

The OBD interface device detects vehicle ignition and shutdown and sends those events to the vehicle information platform. From these events, a service may organize the telemetry data into logical "Trips" for organizing users' activities in an application. A "Trip" service provides access to a catalog of these trips by device or by vehicle and provides mirrors of the Telemetry Services methods centered around these trips. Trips may be created asynchronously, either because they have to be constructed by post-processing or after bulk data upload for a given device.

A "List All of a Device's Trips" service or method may return a list of all trips that a given vehicle with corresponding OBD interface device has taken. This may include trips that have not yet been completed. A "Get Details of a Trip" service may, for each trip, provide more detailed information regarding overall trip statistics. This may include start and stop location as well as other statistical information which may be of interest. These items include: averageLoad—average engine load (in percent) of the trip; averageMovingSpeed—average speed while the vehicle was in motion (eliminates times when the vehicle had a speed of 0); averageSpeed—average speed (in kph) of the trip; distance—total distance traveled (in meters) by the vehicle during this Trip; distanceByGPS—total distance traveled (in meters) according to GPS (this is more accurate for longer trips, but for shorter trips, it may be inaccurate due to the time to get a fix at the start of a trip); distanceByVSS—total distance traveled (in meters) according to the speed of the vehicle (this tends to be more accurate over shorter time periods); duration—time (in milliseconds) between the start and end of this trip; fuelConsumed—estimated amount of fuel (in liters) consumed during this trip; fuelEconomy—estimated fuel economy (in miles per gallon) during this trip; hardAccelCount—the number of times the Vehicle experienced a hard acceleration during this trip; hardBrakeCount—the number of times the Vehicle experienced a hard stop during this trip; maxSpeed—the maximum speed (in kph) reported for the Vehicle during the Trip; stdDevMovingSpeed—the standard deviation of the speed while the vehicle was in motion; and stopCount—the number of times the Vehicle came to a stop. All of the detailed information described above may be available via a "Get Trips by Device" or "Get Trips by Vehicle" method or service.

Based on long-term driving data, the vehicle information platform may calculate and keeps track of behavioral statistics for particular OBD interface devices and corresponding vehicles. Scores reported by a "Behavioral" services method are meant to convey a driver's overall risk categorization based on historical data gathered by the vehicle information platform OBD interface device. These scores may not be be-all-end-all measures of the likelihood that a driver will be involved in a collision. Safe driving involves so many other factors that are not measurable by the vehicle information platform OBD interface device, however Behavioral Services may attempt to categorize risk based on available data.

The results of such an analysis are "Report Cards" for both a single Trip and for a Device's lifetime. Each report is based on the results of three categories of behavior: Driver Behavior—the risk based on driving habits detected from the vehicle telemetry including aggressive inputs, erratic driving, speeding, etc.; Vehicle Condition—the risk based on data gathered about vehicle's maintenance condition; and Travel Patterns—the risk based on where the driver travels most frequently.

Report Card related services may produce, in part, a driver report card, which may include letter grades for trips associated with an OBD interface device. They may be represented as school-like grades such as A or C. For example, a "Report Cards for a Device" service may return a report card based on historical data for a specified period. In some cases, not enough information was gathered to generate a report card. In these cases, the grades will be reported as "I" (for "Incomplete"). A "Lifetime Report Card for a Device" service may returns a report card based on all historical data available for a given OBD interface device. A "Report Card for a Trip" service may return a trip-specific report card which may include the same data as the Long-Term and Lifetime report card but may be specific for a particular Trip. In some cases, the trip is too short to generate the data necessary for the report card analysis to be run. In these cases, the grades will be reported as "I".

The vehicle information platform OBD interface device is able to detect when a collision occurs based on internal sensor and select vehicle telemetry data. Using vehicle information platform's Safety Services, an application can access collision history and retrieve detailed collision details. The platform's Event Services can be used to set up subscriptions to collision events, which can be also used.

A "Get a list of Collisions for a Device" service may return a list of registered collisions for one or more vehicles associated with a given OBD interface device. A "Get a list of Collisions for a Vehicle service may return a list of registered collisions for a given vehicle. A "Get a specific Collision" service may specific collision for a given vehicle.

Vehicle information process 10 and/or vehicle information application 10 may represent one or more services or applications that may run with the vehicle information platform described here.

For example, a predictive maintenance application may be executed in order to predict when certain maintenance should be performed on a vehicle. The vehicle information platform may collect data from the base unit and/or the backpack. The data may show that there are 1000 vehicles of make A and model B in a database associated with the vehicle information platform. The data may also show that, for example, when make A and model B vehicles reach 60,000 miles, 75% of the vehicles have a check engine light that switches because a certain part X requires placement. As such, owners of make A and model B vehicles may be informed (e.g. pushed from the vehicle information platform to the owner's data-enabled cellular telephone or smartphone, or an application associated therewith) that as they reach 60,000 miles, it is likely that they need to replace part X of the vehicle.

The vehicle information platform may be associated with a service provider that administers the vehicle information platform and provides services to one or more of users, manufacturers, and other businesses. For example, the service provider may provide large scale statistics to automobile manufacturers. The automobile manufacturer may express an interest in purchasing data from the service provider. For example, the automobile manufacturer may wish to know the mean time for failure of a certain part in a certain make/model vehicle sold by the automobile manufacturer.

Figure 29:
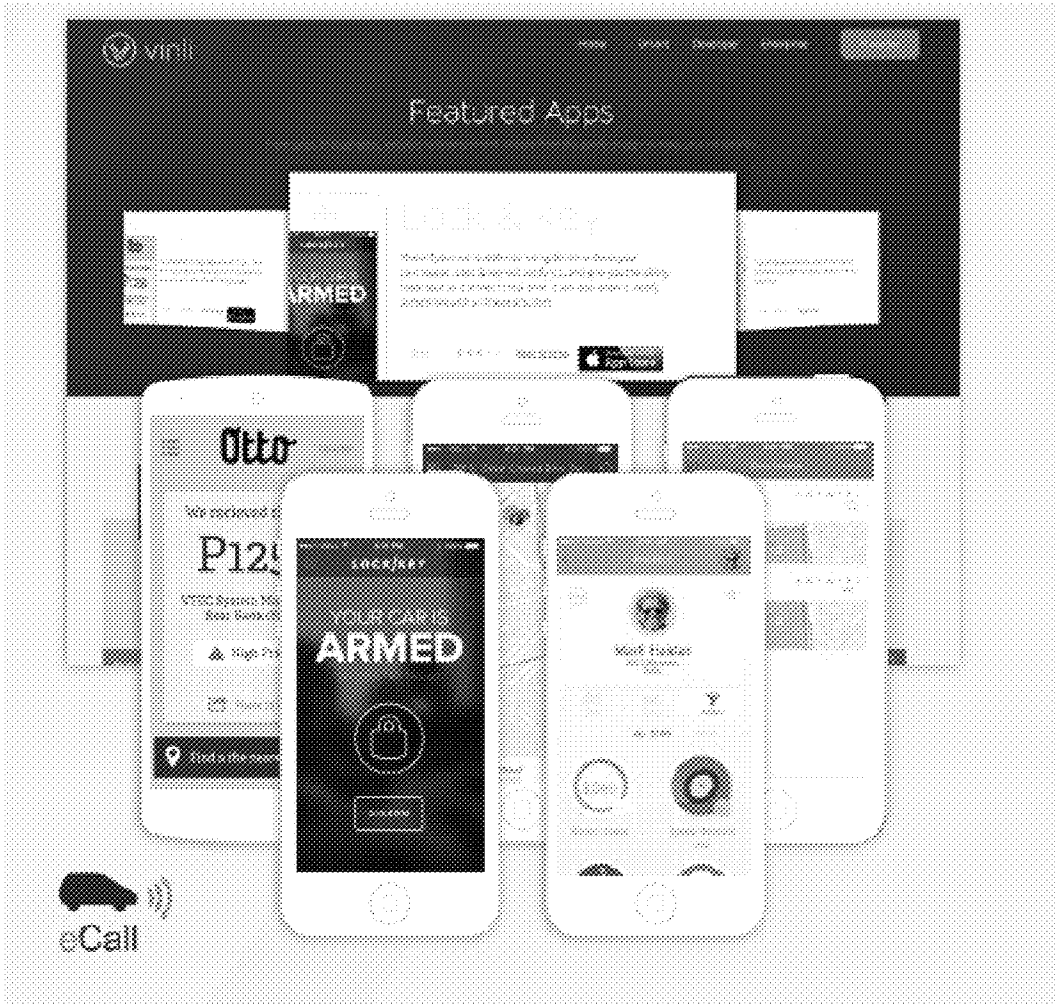
FIG. 29 depicts an example vehicle information platform application store in accordance with the present disclosure.

Applications for the accessing, analyzing, and using data from the vehicle information platform may be available from an application store or may otherwise be provided to users. The vehicle information platform application store may include downloadable vehicle information platform applications and may be accessible via one or more client electronic devices. Referring now also to FIG. 29, an example vehicle information platform application store in accordance with the present disclosure is shown.

Figure 35:
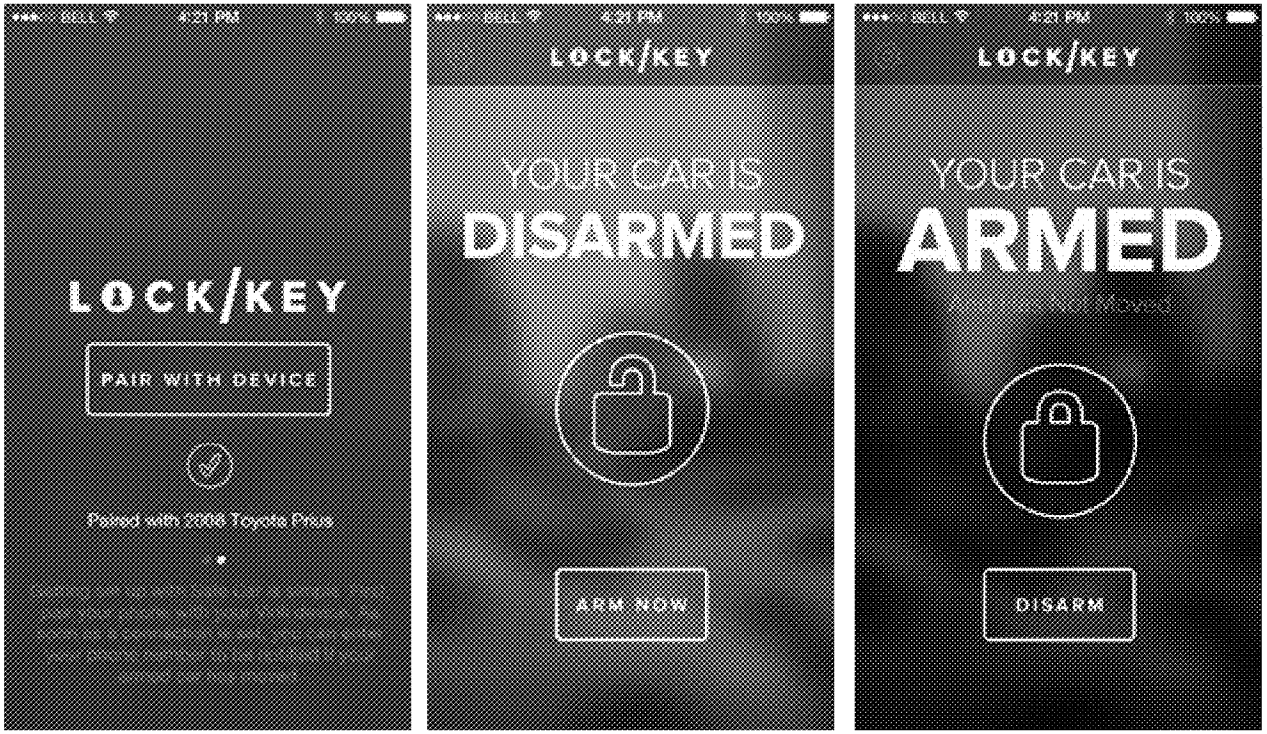
FIG. 35 depicts example vehicle security application GUIs in accordance with the present disclosure.
Figure 36:
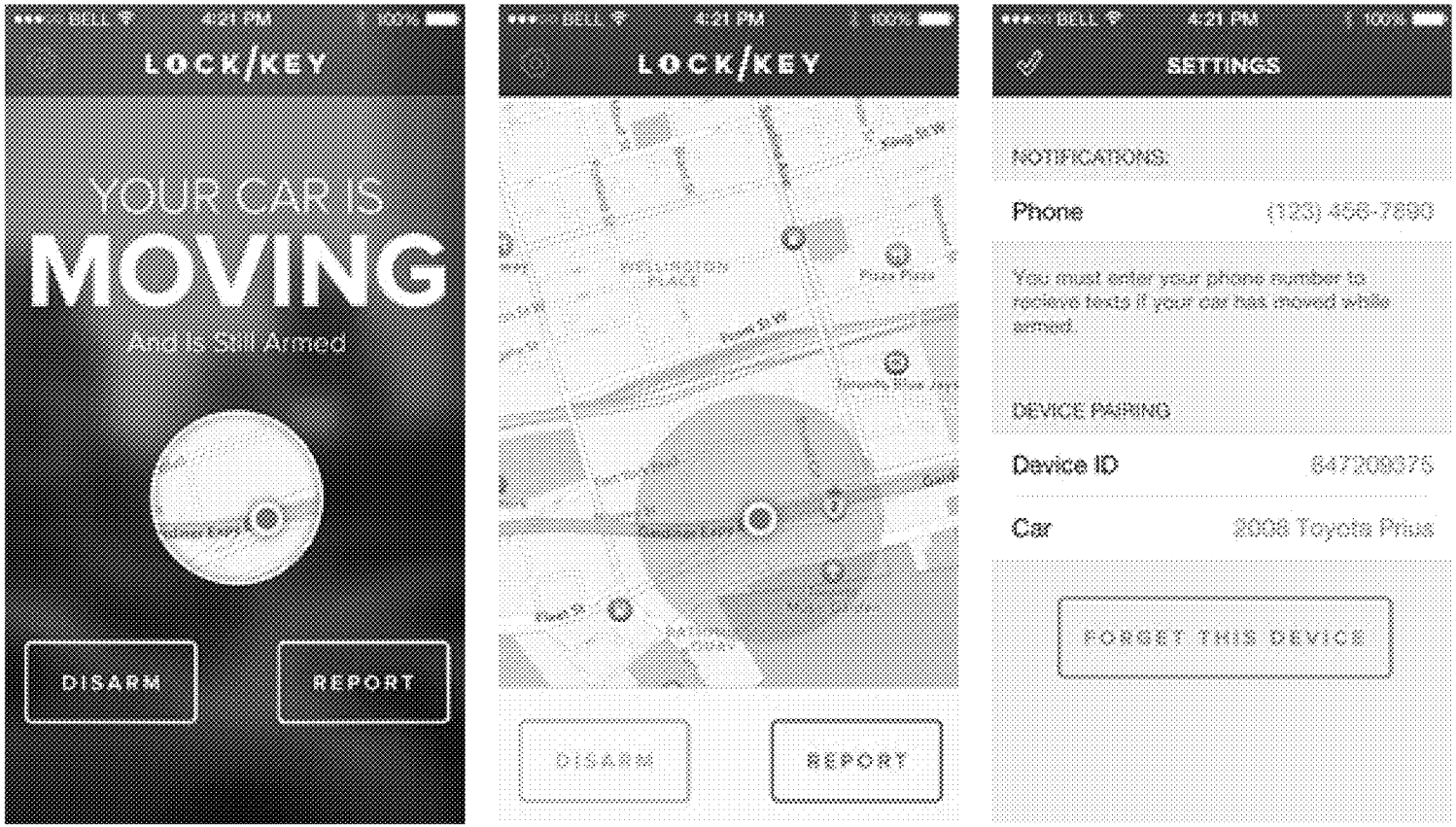
FIG. 36 also depicts example vehicle security application GUIs in accordance with the present disclosure.
Figure 40:
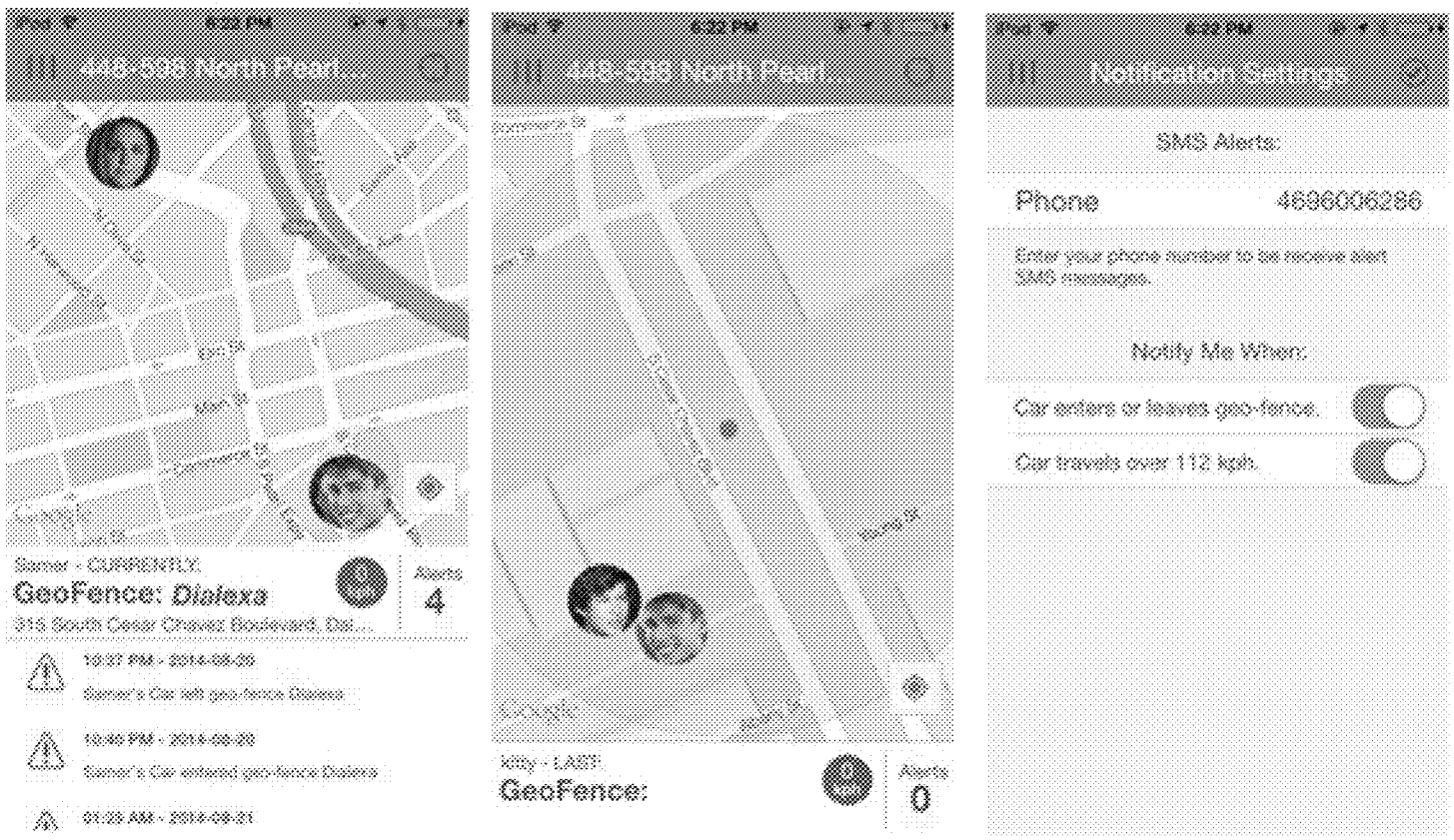
FIG. 40 depicts example diagnostic/maintenance application GUIs in accordance with the present disclosure.

For example, an application may provide a user a history of where the user' car has traveled. An application may also lock a car to a geofence. For example, a user may park a car, press a button on the user's smartphone (or the phone may through, e.g., GPS, that it is leaving the car, and the vehicle information platform may automatically create a geofence around that car. If the car leaves the geofence, then the user may receive an indication (e.g., text message) indicating so. In this way, the vehicle information system may serve as a location-based car alarm. If someone hijacks, breaks into, or, drives away a user's car (i.e., outside the geofence), an event may be triggered in the vehicle information platform and a notification may be sent to the owner and/or to the police. Such an application may also tell a driver where he or she parked or when he or she parked. Referring now also to FIGS. 35 and 36, example vehicle security application GUIs in accordance with the present disclosure are shown. As shown, the vehicle security application may use geofence services, as described below, to notify a driver is his/her vehicle is locked, stolen, moving, etc. Further, referring now also to FIG. 40, example geofence application GUIs in accordance with the present disclosure are shown. As shown, geofence information and services provided by the vehicle information platform may be used to monitor driver (e.g., teenagers, etc.) location and notify a parent when his/her child has moved outside the geofence. In an implementation, a similar application may notify a parent when his/her child is speeding or otherwise driving dangerously.

In an implementation, an application may keep track of when a trip starts and when a trip ends, or when the car is turned on or off. Based on that information, an application can use the data the car has gathered, analysis it, and determine areas of fast acceleration or deceleration, hard breaking, how hard turns were taken, trip frequency, and fastest and slowest trip time. In this way, an application may provide a trip-by-trip analysis built on a behavioral or driver risk model determines through the vehicle information platform. For example, it can be determined if the driver often drives in dangerous areas (i.e., areas prone to car accidents or filled with bad drivers). In this way, a report card for a driver's behavior or habits, and driver risk may be determined using the vehicle information platform. Such an application may provide valuable feedback to the driver and may makes driving more social, allowing the driver to share trips and earn badges. Both slow/careful, as well as more adventurous drivers, may earn badges.

Such driver information may be used to calculate a driver score, which may be used like a credit score for drivers. The driver score may be sold or provided to an insurance company in an anonymized fashion. The user may decide to submit, link, or otherwise identify (e.g., opt-in) with the driver score information (e.g., via VIN number). The insurance company may then identify and provide the driver with a discount or lower rate. Drivers may be classified as good, bad, dangerous, or safe divers and may use the score or data to improve driving habits and get better insurance rates.

In an implementation, an application may connect a driver's home and car, allowing for the driver to set a home thermostat or automatically closing a garage door. Another application may alert an owner when children or other drivers of the owner's car speed, drive recklessly, get into an accident, or skip school.

Figure 37:
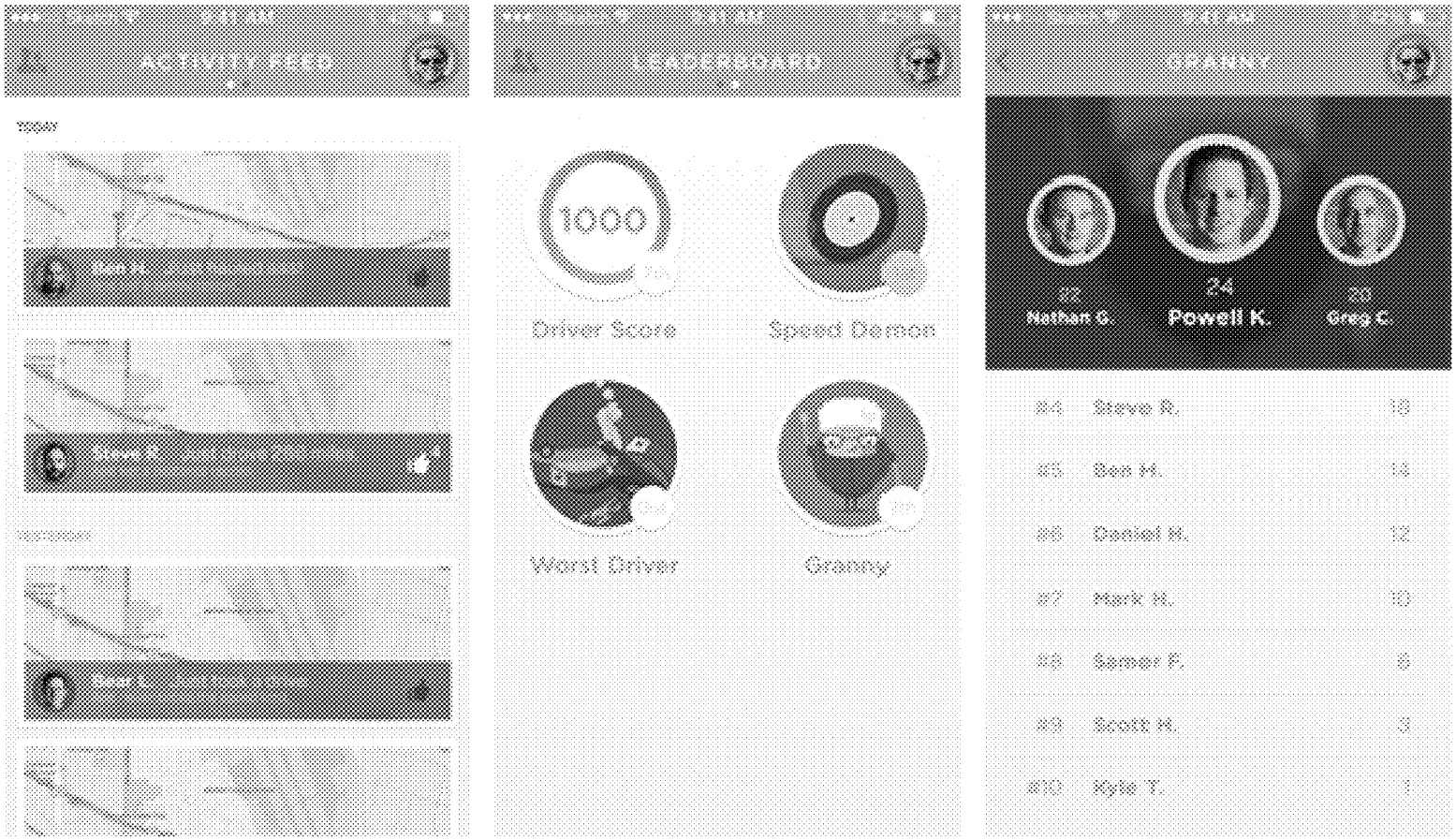
FIG. 37 depicts example drive/race application GUIs in accordance with the present disclosure.

Further, an application may track a car's location during a race, may record video o the race, and may log hundreds of engine readings, combining them into an interactive interface that let's the driver share with friends. Additional applications and services not discussed here may also be provided through the vehicle information platform. Referring now also to FIG. 37, example drive/race application GUIs in accordance with the present disclosure are shown. As shown, the drive/race application may allow the driver to share drive/race maps and information with friends, among other features.

In an implementation, the vehicle information platform may perform vehicle telemetry event processing. Some OBD devices for commercial or personal use may deal primarily in continuous telemetry streaming or snapshotting of a vehicle state at a given time. These devices may tie into larger systems that allow for straightforward processing of vehicle telemetry data against business rules on a large scale. For consumers and businesses that have boundaries and rules that govern allowed vehicle movement or behavior, there may be a need for a system to manage these rules in a centralized place that can handle events for a large number of vehicles at once. Using the techniques and features described herein, the near real-time evaluation of telemetry gathered from OBD data maybe performed in a way that is tolerant of non-sequential and inconsistent data.

Figure 26:
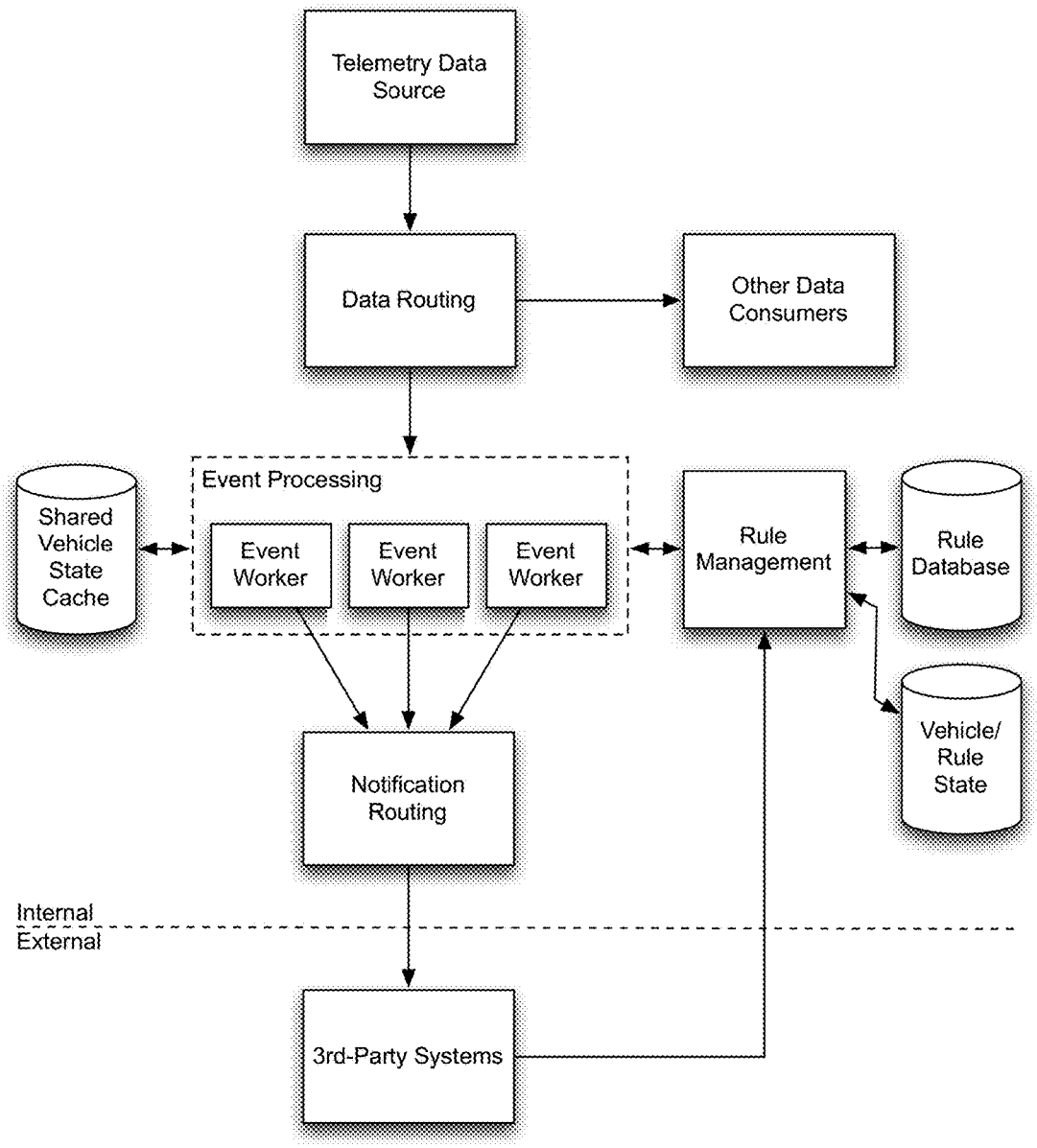
FIG. 26 is an example diagrammatic flowchart illustrating vehicle telemetry event processing in accordance with the present disclosure.

Referring now to FIG. 26, an example diagrammatic flowchart illustrating vehicle telemetry event processing is shown. Data may be fed from a telemetry data source (vehicle OBD port or other source) into a data routing system that may send data to both the Event Processing System and other data consumers. Event processing nay be subscribed to the same data that other systems (such as telemetry storage and behavioral analysis, etc.) use. The data may be sent to one or more event workers. Each of these workers may behave independently from the others, and may deal with one telemetry snapshot at a time.

A rule may include a set of boundaries. Each boundary (with the exception of geospatial boundaries) may represent a single scalar parameter and a set of one or two boundary end points. Geospatial boundaries may include a simple polygon. The combination of these boundaries may produce a simple, convex area in N-space that may cover a subset of vehicle states. Based on this space, the system may track, with respect the each rule, whether a vehicle is known to be covered or not covered by all of the boundaries at a given point in time. The system may then emit events to consuming clients when a vehicle enters or leaves this space.

Figure 27:
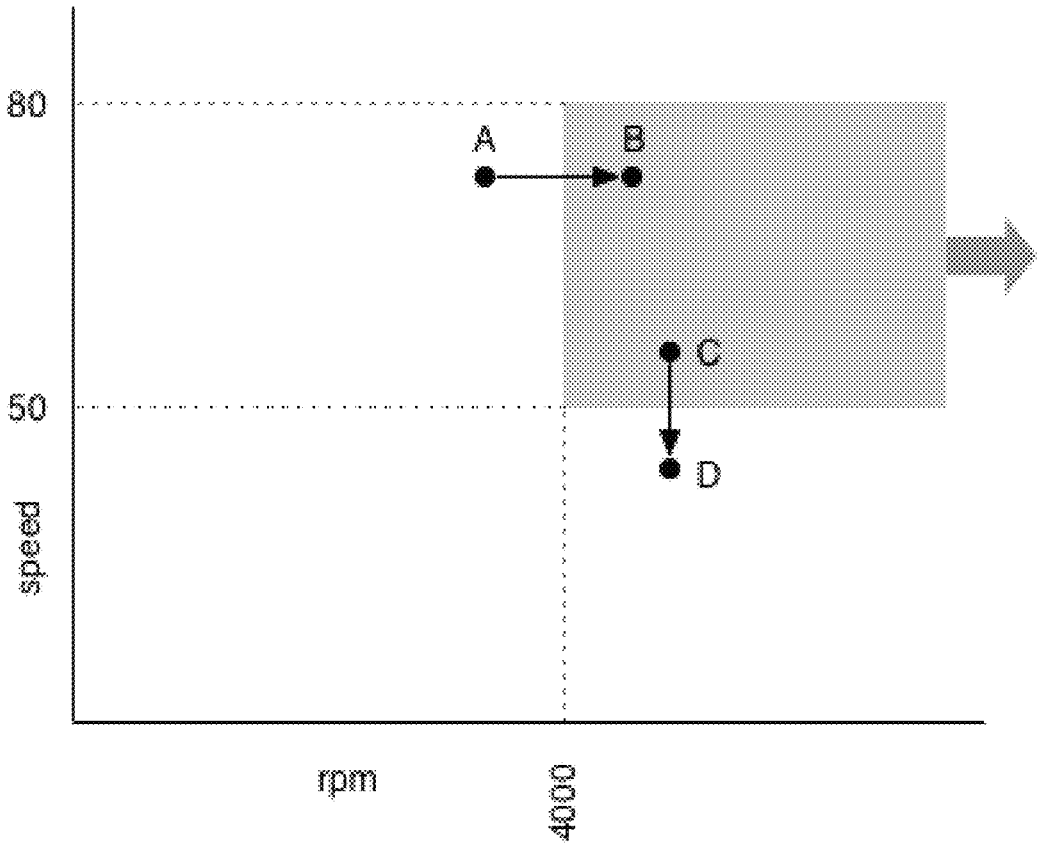
FIG. 27 depicts an example set of boundaries that may be used in vehicle telemetry event processing in accordance with the present disclosure.

Referring now to FIG. 27, an example set of boundaries that may be used in vehicle telemetry event processing in accordance with the present disclosure is shown. Given a set of boundaries (speed∈[50, 80] and rpm∈[4000, ∞)), a vehicle at A moving to B would "enter" the rule, while a vehicle at C moving to D would "leave" the rule.

Each snapshot may include a subset of the total parameters. Additionally, each rule may have a set of parameters upon which it is based. Since the reporting of parameter values in the snapshot may not correlate with those expected for a rule, the system may maintain a shared "Vehicle State Cache" that keeps track of a temporally limited memory of vehicle state. In this way, if a vehicle has one snapshot that includes the "speed" value and another later on that includes the "rpm" value, the cache may still allows for evaluation as to the vehicle's relationship to a rule, even across multiple workers.

One or more of the following techniques and features may be included. Vehicle telemetry event processing may be used to alert users of when a vehicle enters or leaves a given geographic area. Vehicle telemetry event processing may also be used to alert users of when a driver of a vehicle exceeds a given speed. Vehicle telemetry event processing may further be used to alert users of when a driver of a vehicle exceeds a given speed within a given geographic area. Additionally, vehicle telemetry event processing may be used to monitor for a set of vehicle conditions that may indicate a vehicle collision.

The vehicle telemetry event processing techniques and features described herein may work as part of a larger platform that may allow these events to be triggered on the back-end without putting any responsibility on the side of the device. A single place to manage and administer rules and boundaries for many devices may be provided. The system may then offload any reactive actions to the backend.

Figure 34:
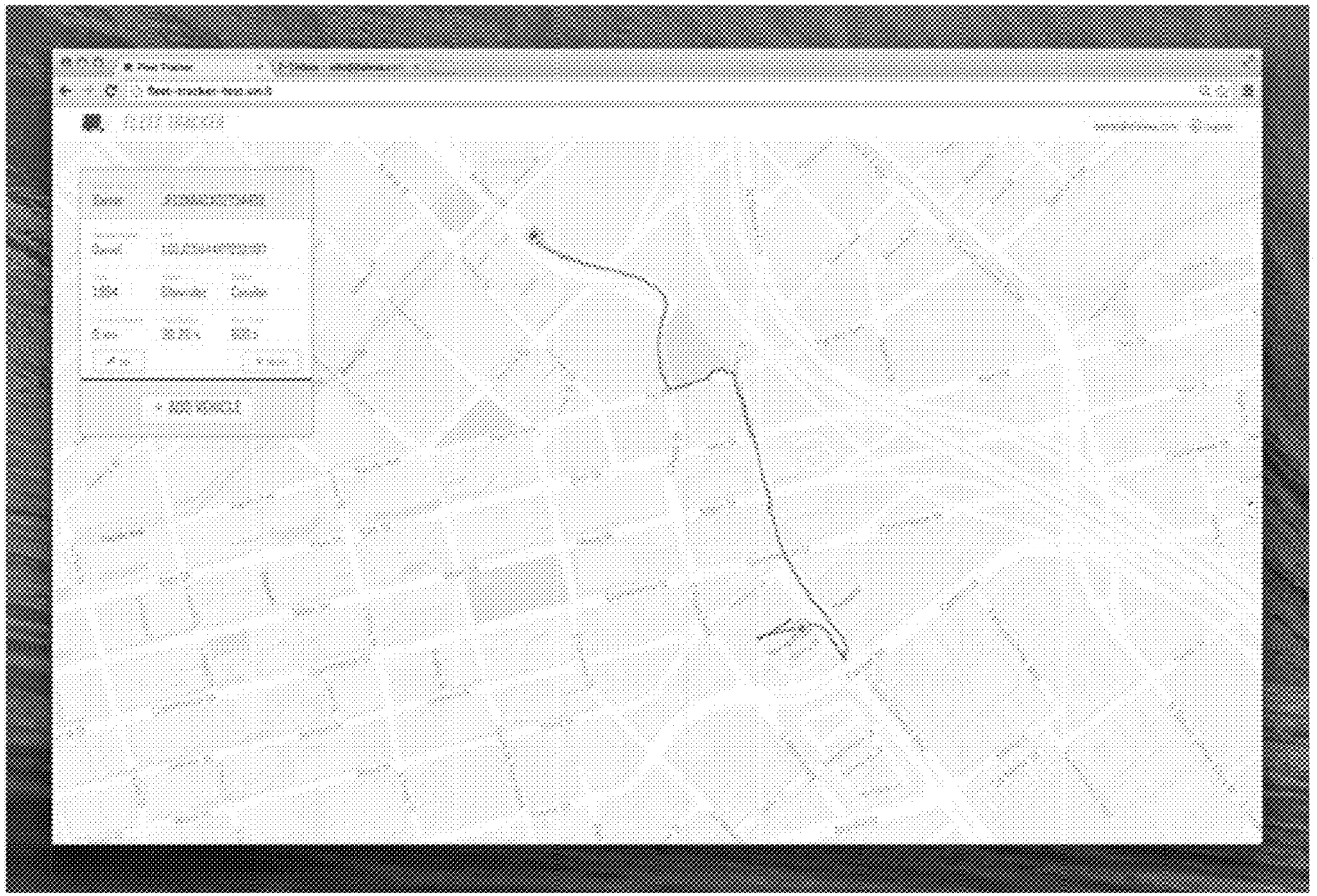
FIG. 34 depicts an example fleet tracker application GUI in accordance with the present disclosure.

In an implementation, fleet tracking applications and services may be provided. Such an application may allow businesses to track and manage their vehicle fleets, and may be customize based on business need. Referring now also to FIG. 34, an example fleet tracker application GUI in accordance with the present disclosure is shown. As will be discussed below, vehicle and location information may be pulled from enterprise vehicles and used by platform services and applications to allow for enterprise fleet tracking.

In an implementation, a developer kit may be provided to allow developers to more easily and efficiently develop applications for the vehicle information system and/or protocol. The developer kit may include a simulator (e.g., that works with a client electronic device or is a stand alone device) so that the developer does not have to actually use a vehicle for development purposes.

In an implementation the vehicle information system and platform may be open to developers. The vehicle information platform may include an open-web platform for developers, which may be secure, flexible, and robust. Developers may use web, desktop, and mobile SDKs provided by the service provider administering the vehicle information platform. Developers may have previously only been able to create applications for certain makes and models of cars. Using the techniques and features described here, developers may create applications that work on some or on almost all cars and models using the application programming interface (API) described herein. Further details regarding the API may be found in Appendix E.

Further, developers may start with hardware devices (e.g., base unit and backpack) and may extend the capabilities of the vehicle information platform by creating additional backpacks that may connect physically to the original backpack or base unit or wirelessly.

Developer tools may include SDK's for iOS, Android and Window, sample code, documentation, and/or developer kits. Applications may be created and managed at a granular level. A Beta developer program may be provided.

Figure 33:
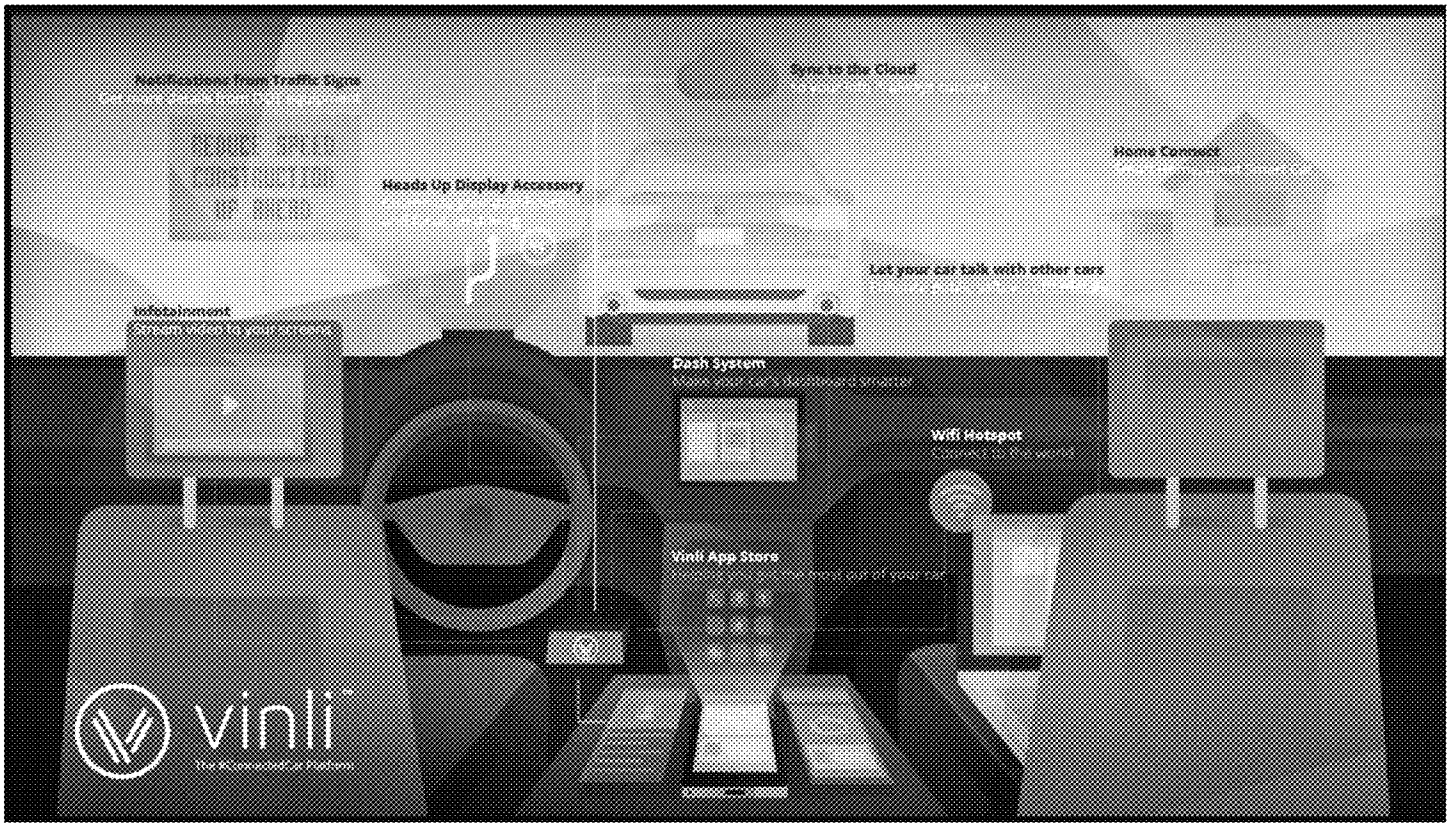
FIG. 33 depicts an example features of a vehicle information platform in accordance with the present disclosure.

Referring now also to FIG. 33, example features of a vehicle information platform in accordance with the present disclosure are shown. For example, in various implementations and embodiments, the vehicle information platform in combination with various services and applications may allow for traffic and driving notifications, video streaming, Wi-Fi hotspots, home appliance and device connection, and improved dashboard systems.

A number of implementations have been described. Nevertheless, it will be understood that various modifications may be made without departing from the spirit and scope of the disclosure. For example, various forms of the flows shown above may be used, with steps re-ordered, added, or removed. Accordingly, other implementations are within the scope of the following claims.

In various embodiments, modules or software can be used to practice certain aspects of the invention. For example, software-as-a-service (SaaS) models or application service provider (ASP) models may be employed as software application delivery models to communicate software applications to clients or other users. Such software applications can be downloaded through an Internet connection, for example, and operated either independently (e.g., downloaded to a laptop or desktop computer system) or through a third-party service provider (e.g., accessed through a third-party web site). In addition, cloud computing techniques may be employed in connection with various embodiments of the invention. In certain embodiments, a "module" may include software, firmware, hardware, or any reasonable combination thereof.

Various embodiments of the systems and methods may include and/or utilize a computer device. In various embodiments, a computer may be in communication with a server or server system utilizing any suitable type of communication including, for example, wired or wireless digital communications. In some embodiments, the server or server system may be implemented as a cloud computing application or in a similar manner and may provide various functionality of the systems and methods as SaaS.

The examples presented herein are intended to illustrate potential and specific implementations of the present invention. The examples are intended primarily for purposes of illustration of the invention for those skilled in the art. No particular aspect or aspects of the examples are necessarily intended to limit the scope of the present invention.

The figures and descriptions of the present invention have been simplified to illustrate elements that are relevant for a clear understanding of the present invention, while eliminating, for purposes of clarity, other elements. Those of ordinary skill in the art may recognize, however, that these sorts of focused discussions would not facilitate a better understanding of the present invention, and therefore, a more detailed description of such elements is not provided herein.

The processes associated with the present embodiments may be executed by programmable equipment, such as computers. Software or other sets of instructions that may be employed to cause programmable equipment to execute the processes may be stored in any storage device, such as, for example, a computer system (non-volatile) memory, an optical disk, magnetic tape, or magnetic disk. Furthermore, some of the processes may be programmed when the computer system is manufactured or via a computer-readable memory medium.

It can also be appreciated that certain process aspects described herein may be performed using instructions stored on a computer-readable memory medium or media that direct a computer or computer system to perform process steps. A computer-readable medium may include, for example, memory devices such as diskettes, compact discs of both read-only and read/write varieties, optical disk drives, and hard disk drives. A computer-readable medium may also include memory storage that may be physical, virtual, permanent, temporary, semi-permanent and/or semi-temporary.

A "computer," "computer system," "component," "computer device," or "processor" may be, for example and without limitation, a processor, microcomputer, minicomputer, server, mainframe, laptop, personal data assistant (PDA), wireless e-mail device, cellular phone, pager, processor, fax machine, scanner, or any other programmable device configured to transmit and/or receive data over a network. Computer systems and computer-based devices disclosed herein may include memory for storing certain software applications used in obtaining, processing, and communicating information. It can be appreciated that such memory may be internal or external with respect to operation of the disclosed embodiments. The memory may also include any means for storing software, including a hard disk, an optical disk, floppy disk, ROM (read only memory), RAM (random access memory), PROM (programmable ROM), EEPROM (electrically erasable PROM) and/or other computer-readable memory media. In various embodiments, a "host," "engine," "loader," "filter," "platform," or "component" may include various computers or computer systems, or may include a reasonable combination of software, firmware, and/or hardware.

In various embodiments of the present invention, a single component may be replaced by multiple components, and multiple components may be replaced by a single component, to perform a given function or functions. Except where such substitution would not be operative to practice embodiments of the present invention, such substitution is within the scope of the present invention. Any of the servers, for example, may be replaced by a "server farm" or other grouping of networked servers (e.g., a group of server blades) that are located and configured for cooperative functions. It can be appreciated that a server farm may serve to distribute workload between/among individual components of the farm and may expedite computing processes by harnessing the collective and cooperative power of multiple servers. Such server farms may employ load-balancing software that accomplishes tasks such as, for example, tracking demand for processing power from different machines, prioritizing and scheduling tasks based on network demand, and/or providing backup contingency in the event of component failure or reduction in operability.

In general, it may be apparent to one of ordinary skill in the art that various embodiments described herein, or components or parts thereof, may be implemented in many different embodiments of software, firmware, and/or hardware, or modules thereof. The software code or specialized control hardware used to implement some of the present embodiments is not limiting of the present invention. For example, the embodiments described hereinabove may be implemented in computer software using any suitable computer programming language such as .NET, SQL, MySQL, or HTML using, for example, conventional or object-oriented techniques. Programming languages for computer software and other computer-implemented instructions may be translated into machine language by a compiler or an assembler before execution and/or may be translated directly at run time by an interpreter.

Examples of assembly languages include ARM, MIPS, and x86; examples of high level languages include Ada, BASIC, C, C++, C#, COBOL, Fortran, Java, Lisp, Pascal, Object Pascal; and examples of scripting languages include Bourne script, JavaScript, Python, Ruby, PHP, and Perl. Various embodiments may be employed in a Lotus Notes environment, for example. Such software may be stored on any type of suitable computer-readable medium or media such as, for example, a magnetic or optical storage medium. Thus, the operation and behavior of the embodiments are described without specific reference to the actual software code or specialized hardware components. The absence of such specific references is feasible because it is clearly understood that artisans of ordinary skill would be able to design software and control hardware to implement the embodiments of the present invention based on the description herein with only a reasonable effort and without undue experimentation.

Various embodiments of the systems and methods described herein may employ one or more electronic computer networks to promote communication among different components, transfer data, or to share resources and information. Such computer networks can be classified according to the hardware and software technology that is used to interconnect the devices in the network, such as optical fiber, Ethernet, wireless LAN, HomePNA, power line communication or G.hn. The computer networks may also be embodied as one or more of the following types of networks: local area network (LAN); metropolitan area network (MAN); wide area network (WAN); virtual private network (VPN); storage area network (SAN); or global area network (GAN), among other network varieties.

For example, a WAN computer network may cover a broad area by linking communications across metropolitan, regional, or national boundaries. As the systems and methods described herein aim to minimize I/O transactions, they may be useful in situations, such as cloud computing configurations, where I/O transactions are performed over a WAN or other network with long I/O delays. The network may use routers and/or public communication links. One type of data communication network may cover a relatively broad geographic area (e.g., city-to-city or country-to-country) which uses transmission facilities provided by common carriers, such as telephone service providers.

In another example, a GAN computer network may support mobile communications across multiple wireless LANs or satellite networks. In another example, a VPN computer network may include links between nodes carried by open connections or virtual circuits in another network (e.g., the Internet) instead of by physical wires. The link-layer protocols of the VPN can be tunneled through the other network. One VPN application can promote secure communications through the Internet. The VPN can also be used to separately and securely conduct the traffic of different user communities over an underlying network. The VPN may provide users with the virtual experience of accessing the network through an IP address location other than the actual IP address which connects the access device to the network.

The computer network may be characterized based on functional relationships among the elements or components of the network, such as active networking, client-server, or peer-to-peer functional architecture. The computer network may be classified according to network topology, such as bus network, star network, ring network, mesh network, star-bus network, or hierarchical topology network, for example. The computer network may also be classified based on the method employed for data communication, such as digital and analog networks.

Embodiments of the methods, systems, and tools described herein may employ internetworking for connecting two or more distinct electronic computer networks or network segments through a common routing technology. The type of internetwork employed may depend on administration and/or participation in the internetwork. Non-limiting examples of internetworks include intranet, extranet, and Internet. Intranets and extranets may or may not have connections to the Internet. If connected to the Internet, the intranet or extranet may be protected with appropriate authentication technology or other security measures. As applied herein, an intranet can be a group of networks which employ Internet Protocol, web browsers and/or file transfer applications, under common control by an administrative entity. Such an administrative entity could restrict access to the intranet to only authorized users, for example, or another internal network of an organization or commercial entity. As applied herein, an extranet may include a network or internetwork generally limited to a primary organization or entity, but which also has limited connections to the networks of one or more other trusted organizations or entities (e.g., customers of an entity may be given access an intranet of the entity thereby creating an extranet).

Computer networks may include hardware elements to interconnect network nodes, such as network interface cards (NICs) or Ethernet cards, repeaters, bridges, hubs, switches, routers, and other like components. Such elements may be physically wired for communication and/or data connections may be provided with microwave links (e.g., IEEE 802.12) or fiber optics, for example. A network card, network adapter or NIC can be designed to allow computers to communicate over the computer network by providing physical access to a network and an addressing system through the use of MAC addresses, for example. A repeater can be embodied as an electronic device that receives and retransmits a communicated signal at a boosted power level to allow the signal to cover a telecommunication distance with reduced degradation. A network bridge can be configured to connect multiple network segments at the data link layer of a computer network while learning which addresses can be reached through which specific ports of the network. In the network, the bridge may associate a port with an address and then send traffic for that address only to that port. In various embodiments, local bridges may be employed to directly connect local area networks (LANs); remote bridges can be used to create a wide area network (WAN) link between LANs; and/or, wireless bridges can be used to connect LANs and/or to connect remote stations to LANs.

In various embodiments, a hub may be employed which contains multiple ports. For example, when a data packet arrives at one port of a hub, the packet can be copied unmodified to all ports of the hub for transmission. A network switch or other devices that forward and filter OSI layer 2 datagrams between ports based on MAC addresses in data packets can also be used. A switch can possess multiple ports, such that most of the network is connected directly to the switch, or another switch that is in turn connected to a switch. The term "switch" can also include routers and bridges, as well as other devices that distribute data traffic by application content (e.g., a Web URL identifier or other data location information as described herein). Switches may operate at one or more OSI model layers, including physical, data link, network, or transport (i.e., end-to-end). A device that operates simultaneously at more than one of these layers can be considered a multilayer switch. In certain embodiments, routers or other like networking devices may be used to forward data packets between networks using headers and forwarding tables to determine an optimum path through which to transmit the packets.

As employed herein, an application server may be a server that hosts an API to expose business logic and business processes for use by other applications. Examples of application servers include J2EE or Java EE 5 application servers including WebSphere Application Server. Other examples include WebSphere Application Server Community Edition (IBM), Sybase Enterprise Application Server (Sybase Inc), WebLogic Server (BEA), JBoss (Red Hat), JRun (Adobe Systems), Apache Geronimo (Apache Software Foundation), Oracle OC4J (Oracle Corporation), Sun Java System Application Server (Sun Microsystems), and SAP Netweaver AS (ABAP/Java).

Also, application servers may be provided in accordance with the .NET framework, including the Windows Communication Foundation, .NET Remoting, ADO.NET, and ASP.NET among several other components. For example, a Java Server Page (JSP) is a servlet that executes in a web container which is functionally equivalent to CGI scripts. JSPs can be used to create HTML pages by embedding references to the server logic within the page. The application servers may mainly serve web-based applications, while other servers can perform as session initiation protocol servers, for instance, or work with telephony networks. Specifications for enterprise application integration and service-oriented architecture can be designed to connect many different computer network elements. Such specifications include Business Application Programming Interface, Web Services Interoperability, and Java EE Connector Architecture.

In various embodiments, the computer systems, data storage media, or modules described herein may be configured and/or programmed to include one or more of the above-described electronic, computer-based elements and components, or computer architecture. In addition, these elements and components may be particularly configured to execute the various rules, algorithms, programs, processes, and method steps described herein.

Implementations of the present disclosure and all of the functional operations provided herein can be realized in digital electronic circuitry, or in computer software, firmware, or hardware, including the structures disclosed in this specification and their structural equivalents, or in combinations of one or more of them. Implementations of the disclosure can be realized as one or more computer program products, i.e., one or more modules of computer program instructions encoded on a computer readable medium for execution by, or to control the operation of, a data processing apparatus. The computer readable medium can be a machine-readable storage device, a machine readable storage substrate, a memory device, or a combination of one or more of them. The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them.

A computer program (also known as a program, software, software application, script, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions or computer program products and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. These may also be referred to as computer readable storage media. The processor and the memory can be supplemented by, or incorporated in, special purpose logic circuitry.

To provide for interaction with a user, implementations of described herein can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Implementations of the present disclosure can be realized in a computing system that includes a back end component, e.g., as a data server, or that includes a middleware component, e.g., an application server, or that includes a front end component, e.g., a client computer having a graphical user interface or a Web browser through which a user can interact with an implementation of the present disclosure, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

While this disclosure contains many specifics, these should not be construed as limitations on the scope of the disclosure or of what may be claimed, but rather as descriptions of features specific to particular implementations of the disclosure. Certain features that are described in this disclosure in the context of separate implementations can also be provided in combination in a single implementation. Conversely, various features that are described in the context of a single implementation can also be provided in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

In each instance where an HTML file is mentioned, other file types or formats may be substituted. For instance, an HTML file may be replaced by an XML, JSON, plain text, or other types of files. Moreover, where a table or hash table is mentioned, other data structures (such as spreadsheets, relational databases, or structured files) may be used.

While various embodiments have been described herein, it should be apparent, however, that various modifications, alterations and adaptations to those embodiments may occur to persons skilled in the art with the attainment of some or all of the advantages of the invention. The disclosed embodiments are therefore intended to include all such modifications, alterations and adaptations without departing from the scope and spirit of the invention. Accordingly, other embodiments and implementations are within the scope of the following claims. For example, the actions recited in the claims can be performed in a different order and still achieve desirable results.

What is claimed is:

1. A vehicle information system comprising:

a vehicle information platform executed by one or more servers to provide one or more Tier 1 and Tier 2 services;

a plurality of different telemetry data sources that supply vehicle information to the vehicle information platform, wherein the vehicle information is normalized to create normalized vehicle information, the normalized vehicle information is placed into a queue, and the normalized vehicle information is egressed to be accessed and consumed by one or more applications; and an application programming interface corresponding to the vehicle information platform configured to provide one or more applications access over HTTP/SSL to the normalized vehicle information, wherein the one or more applications consume the normalized vehicle information and access the one or more Tier 1 and Tier 2 services on the vehicle information platform without regard for which of the plurality of different telemetry data sources the normalized vehicle information originated, wherein the one or more Tier 1 services include authorization services, platform services, event services, rule services, and telemetry services, and wherein the one or more Tier 2 services include trip services, diagnostic services, behavioral services, and safety services.

2. The vehicle information system of claim 1, wherein the one or more applications are accessible via one or more client electronic devices.

3. The vehicle information system of claim 1, wherein:

at least one of the plurality of different telemetry data sources is an OBD interface device comprising a housing comprising a user facing endface and an engine facing endface, the engine facing endface comprising an OBD connector and a support, the OBD connector and support arranged to suspend the OBD interface device relative to an OBD output port of a vehicle; and an OBD interface in electrical communication with the OBD connector; wherein the first transmitter and the first receiver comprise one or more of a cellular antenna, GPS antenna, or Wi-Fi antenna.

4. The vehicle information system of claim 1, wherein:

the platform services provide administrative actions for the one or more applications, the administrative actions including managing one or more devices, getting the vehicle information, and monitoring transactions.

5. The vehicle information system of claim 1, further comprising:

a software development kit for developing the one or more applications operable on a client electronic device operating system.

6. The vehicle information system of claim 1, wherein the telemetry services provide access to time-series data for vehicle telemetry gathered on a device-by-device basis.

7. The vehicle information system of claim 1, wherein the event services provide access to vehicle events and ability to create subscriptions to the vehicle events.

8. The vehicle information system of claim 1, wherein the rule services provide tools to create rules based on vehicle parameter limits or geofences.

9. A method of consuming vehicle data from more than one different telemetry data source, the method comprising:

collecting the vehicle data from the more than one different telemetry data source, the more than one different telemetry data source selected from the group comprising a telematics control unit, a mobile device, a dash camera, and other cloud-based services for telematics data;

normalizing the vehicle data collected from the more than one different telemetry data source to create normalized vehicle data;

placing the normalized vehicle data into a queue for utilization by one or more Tier 1 and Tier 2 services, wherein the one or more Tier 1 and Tier 2 services operate independent of one another but communicate with each other over the queue, wherein the one or more Tier 1 and Tier 2 services include authorization services, platform services, event services, rule services, telemetry services, trip services, diagnostic services, behavioral services, and safety services; and egressing the normalized vehicle data from the queue to be accessed and consumed by one or more applications over an application programming interface without regard for which of the more than one different telemetry data source the normalized vehicle data originated.

10. The method of claim 9, further comprising:

defining a set of boundaries for a space which a vehicle can occupy in accordance with a vehicle information platform application rule;

maintaining a vehicle state cache, comprising a set of at least one of parameters and messages, used to determine whether the vehicle is inside the set of boundaries; and triggering an event in response to determining that the vehicle moved outside the set of boundaries.

11. The method of claim 9, wherein one of the more than one different telemetry data sources is a plurality of OBD interface devices, the method further comprising:

collecting vehicle-model-specific data from the plurality of OBD interface devices across a plurality of cohorts; and analyzing the vehicle-model-specific data to determine potential failures in the vehicle model for the plurality of cohorts.

12. The method of claim 9, wherein one of the more than one different telemetry data sources is a plurality of OBD interface devices, the method further comprising:

generating a driver score based on the vehicle information received from the plurality of OBD interface devices;

wherein the vehicle data is from a plurality of vehicles having the same model; and wherein the driver score is further based on a geographic area of the vehicles.

13. The method of claim 9, further comprising:

verifying permission for the one or more applications to consume the normalized data from the queue.

* * * * *